US010947922B2

(12) United States Patent
Yamada et al.

(10) Patent No.: US 10,947,922 B2
(45) Date of Patent: Mar. 16, 2021

(54) ENGINE CONTROLLER AND ENGINE CONTROL METHOD

(71) Applicant: TOYOTA JIDOSHA KABUSHIKI KAISHA, Toyota (JP)

(72) Inventors: Takafumi Yamada, Okazaki (JP); Hiroyuki Shibata, Toyota (JP); Shunsuke Kurita, Mie-gun (JP); Takahiro Anami, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 41 days.

(21) Appl. No.: 16/454,192

(22) Filed: Jun. 27, 2019

(65) Prior Publication Data

US 2020/0018253 A1 Jan. 16, 2020

(30) Foreign Application Priority Data

Jul. 13, 2018 (JP) ..... JP2018-133204
Oct. 12, 2018 (JP) ..... JP2018-193335
Oct. 12, 2018 (JP) ..... JP2018-193337

(51) Int. Cl.
*F02D 41/24* (2006.01)
*F02D 13/02* (2006.01)
(Continued)

(52) U.S. Cl.
CPC ..... *F02D 41/2445* (2013.01); *F02D 13/0234* (2013.01); *F02D 41/0002* (2013.01);
(Continued)

(58) Field of Classification Search
CPC ..... F02D 41/2445; F02D 13/0234; F02D 41/0002; F02D 41/0077; F02D 41/2438;
(Continued)

(56) References Cited

U.S. PATENT DOCUMENTS 3,880,125 A * 4/1975 Kammerer ..... F02M 69/32 123/494
4,275,694 A * 6/1981 Nagaishi ..... G01F 1/86 123/463
(Continued)

FOREIGN PATENT DOCUMENTS

JP H6-307273 A 11/1994
JP H116267 A * 3/1999
(Continued)

*Primary Examiner* — Sizo B Vilakazi
*Assistant Examiner* — Brian R Kirby
(74) *Attorney, Agent, or Firm* — Oliff PLC

(57) ABSTRACT

A first intake air amount an engine is calculated based on a detected value of an intake air flow rate of an air flowmeter. A second intake air amount is calculated based on any one of a detected value of an intake pipe pressure and a throttle opening degree instead of the detected value of the intake air flow rate. When it is determined that the intake pulsation is not large, a difference amount of the second intake air amount from the first intake air amount is calculated. A corrected second intake air amount, which is a sum of the second intake air amount and the difference amount, is set as an intake air amount calculated value when it is determined that the intake pulsation is large.

15 Claims, 20 Drawing Sheets

(51) Int. Cl.
*F02D 41/00* (2006.01)
*F02D 41/30* (2006.01)

(52) U.S. Cl.
CPC ..... *F02D 41/0077* (2013.01); *F02D 41/2438* (2013.01); *F02D 41/2451* (2013.01); *F02D 41/3005* (2013.01); *F02D 2041/001* (2013.01); *F02D 2200/0406* (2013.01); *F02D 2200/101* (2013.01); *F02D 2200/1002* (2013.01); *F02D 2200/703* (2013.01)

(58) Field of Classification Search
CPC ..... F02D 41/2451; F02D 41/3005; F02D 2041/001; F02D 2200/0406; F02D 2200/1002; F02D 2200/101; F02D 2200/703; F02D 2041/1413; F02D 2200/0414; F02D 2200/0404; F02D 2200/0402; F02D 2041/1433; F02D 41/182; F02D 41/18; F02D 41/3094; F02D 41/2429; F02D 41/0047; F02D 13/0203
USPC ..... 701/102–104
See application file for complete search history.

(56) References Cited

U.S. PATENT DOCUMENTS 4,412,520 A * 11/1983 Mitsuyasu ..... F02D 41/32 123/488
4,599,694 A * 7/1986 Aposchanski ..... F02D 41/26 701/103
4,644,474 A * 2/1987 Aposchanski ..... F02D 41/263 123/494
4,736,302 A * 4/1988 Kinugawa ..... F02D 41/263 701/103
4,736,725 A * 4/1988 Iwaki ..... F02D 41/18 123/480
4,773,375 A * 9/1988 Okino ..... F02D 41/04 123/488
5,549,080 A * 8/1996 Uchikawa ..... F02D 13/0234 123/90.16
5,619,974 A 4/1997 Rodefeld et al.
5,832,403 A * 11/1998 Kowatari ..... G01F 1/6965 701/103
6,196,197 B1 * 3/2001 Yamada ..... F02D 41/182 123/480
6,334,083 B1 * 12/2001 Aono ..... F02D 41/187 701/102
7,286,925 B2 * 10/2007 Lang ..... G01F 1/72 701/114
7,305,967 B1 * 12/2007 Hagari ..... F02M 35/10295 123/403
9,708,995 B2 * 7/2017 Yoshikawa ..... F02D 41/062
2003/0230277 A1 * 12/2003 Muto ..... F02D 41/18 123/308
2004/0129249 A1 * 7/2004 Kondo ..... F02D 35/023 123/346
2008/0314132 A1 * 12/2008 Nakano ..... G01M 15/09 73/114.32
2011/0004422 A1 * 1/2011 Akagi ..... G01F 1/6965 702/46
2011/0023852 A1 * 2/2011 Yamashita ..... F01M 13/00 123/574
2014/0121947 A1 * 5/2014 Komuro ..... F02N 11/0829 701/103
2017/0082075 A1 * 3/2017 Takezoe ..... F02D 41/0047
2018/0023498 A1 * 1/2018 Kuroda ..... F02D 41/2422 701/104
2018/0112573 A1 * 4/2018 Nakada ..... F01N 3/021

FOREIGN PATENT DOCUMENTS

JP 2003-314347 A 11/2003
JP 2013-221418 A 10/2013
JP 201322148 A * 10/2013
JP 2013221418 A * 10/2013
JP 2015-224611 A 12/2015

* cited by examiner

ENGINE CONTROLLER AND ENGINE CONTROL METHOD

BACKGROUND

1. Field

The following description relates to an engine controller and an engine control method. In the engine controller and the engine control method, fuel injection control is performed for an injector by calculating the intake air amount of the engine and determining a fuel injection amount based on the calculated value of the intake air amount.

2. Description of Related Art

Proper control of the air-fuel ratio (mass ratio of fuel to air) of air-fuel mixture burned in cylinders requires accurate determination of the intake air amount of the engine, i.e., the mass of intake air flowing into the cylinders. Typical modes for calculating an intake air amount include three modes, namely, a mass flow mode, a speed density mode, and a throttle speed mode. In the mass flow mode, an air flowmeter is arranged in a portion of the intake passage located upstream of the throttle valve, and the intake air amount of the engine is calculated from the intake air flow rate detected by the air flowmeter. In the speed density mode, an intake pipe pressure sensor is arranged in a portion of the intake passage located downstream of the throttle valve, and the intake pipe pressure is detected by the intake pipe pressure sensor. Further, the intake air amount is calculated from the intake air flow rate estimated based on the intake pipe pressure and the engine rotation speed. In the throttle speed mode, the intake air amount is calculated from the intake air flow rate estimated based on the throttle opening degree and the engine rotation speed.

Among the three calculation modes, the mass flow mode usually allows the intake air amount to be calculated most accurately while the engine is normally running. However, intake air is intermittently drawn in by each cylinder of the engine when the intake valve opens and closes. Thus, the intake air flows through the intake passage with pulsation. Such intake pulsation affects the detected value of the air flowmeter. Accordingly, in some cases, the speed density mode and the throttle speed mode allow the intake air amount to be calculated with higher accuracy in the running region of the engine of which the intake pulsation is large than the mass flow mode. Japanese Laid-Open Patent Publication No. 2013-221418 describes a typical example of an engine controller for calculating an intake air amount by switching the calculating modes in accordance with the magnitude of intake pulsation. This engine controller calculates the intake air amount with the mass flow mode when the intake pulsation is small and calculates the intake air amount with the speed density mode or the throttle speed mode.

In the speed density mode and the throttle speed mode, the intake air amount is calculated from the estimated intake air flow rate. Thus, when an error occurs in the estimation of the intake air flow rate, an error will also occur in the calculated value. In the above-described typical engine controller, in a case in which such an error occurs when the intake pulsation is large, the air-fuel ratio may diverge from a target value, thereby reducing the exhaust performance of the engine.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples of the present disclosure will now be described.

Example 1

The engine controller performs fuel injection control for an injector by calculating the intake air amount of an engine and determining a fuel injection amount based on the calculated value of the intake air amount. The controller is configured to perform a first intake air amount calculation process for calculating the intake air amount based on the detected value of the intake air flow rate of the airflow meter, a second intake air amount calculation process for calculating the intake air amount based on one of the detected value of the intake pipe pressure and the throttle open degree instead of the detected value of the intake air amount, and a determination process for determining whether the intake pulsation is large in the intake passage.

In the first intake air amount calculation process, the intake air amount is calculated with the mass flow mode based on the detected value of the intake air flow rate of the airflow meter. In the second intake air amount calculation process, the calculation of the intake air amount with the speed density mode based on the detected value of the intake pipe pressure or the calculation of the intake air amount with the throttle speed mode based on the throttle speed mode are performed. The calculated value of the intake air amount with the first intake air amount calculation process is referred to as the first intake air amount, and the calculated value of the intake air amount with the second intake air amount calculation process is referred to as the second intake air amount. The engine controller is further configured to perform a difference amount calculation process for calculating the difference amount of the second intake air amount from the first intake air amount when it is determined in the determination process that the intake pulsation is not large and perform a calculation mode switching process for setting the first intake air amount as the calculated value of the intake air amount when it is determined in the determination process that the intake pulsation is not large and setting, as the calculated value of the intake air amount, the corrected second intake air amount, which is the sum of the second intake air amount and the difference amount, when it is determined in the determination process that the intake pulsation is large.

In the engine controller, when it is determined in the determination process that the intake pulsation is not large (hereinafter referred to as small pulsation determination), it is assumed that the detection accuracy of the intake air flow rate of the airflow meter is not low and the calculation accuracy of the first intake air amount with the first intake air amount calculation process based on the detected value is high. Thus, in the engine controller, when the small pulsation determination is made, the first intake air amount calculated with the mass flow mode is calculated as the calculated value of the intake air amount. Further, if the first intake air amount at this time is a correct value, the difference of the second intake air amount from the first intake air amount is an error of the calculated value of the second intake air amount. In the engine controller, in the difference amount calculation process, the difference amount of the second intake air amount from the first intake air amount when the small pulsation determination is made is calculated.

When it is determined in the determination process that the intake pulsation is large (hereinafter referred to as large pulsation determination), the detection accuracy of the intake air amount of the airflow meter is low. Thus, the calculation accuracy of the first intake air amount is low. In the engine controller, the corrected second intake air amount, which is the sum of the second intake air amount and the difference amount calculated when the small pulsation determination is made, is calculated as the calculated value of the intake air amount. That is, at this time, a value obtained by compensating an error in the second intake air amount acknowledged when the small pulsation determination is made is calculated as the calculated value of the intake air amount. Thus, the engine controller improves the calculation accuracy of the intake air amount in a running region where the intake pulsation is large.

The difference amount between the first intake air amount and the second intake air amount changes depending on, for example, the running region of the engine, the individual difference of the engine, and changes over time. Thus, in the difference amount calculation process in the engine controller according to example 1, the engine controller according to example 2 is configured to perform learning of a difference amount learning value, which is a learning value of the difference amount, for each of difference amount learning regions divided in accordance with a running state of the engine. In such a case, the learning is performed to obtain a value suitable for each running state of the current engine. The result of the learning is reflected on the calculation of the intake air amount in a running region where the intake pulsation is large. This further improves the calculation accuracy of the intake air amount in a running region where the intake pulsation is large.

Example 3

In the engine controller according to example 2, the learning of the difference amount in the difference amount calculation process is configured to be performed by collectively updating the difference amount learning values in the difference amount learning regions when the learning of the difference amount is incomplete in all of the difference amount learning regions and by updating only the difference amount learning value of one of the difference amount learning regions in which the engine is currently running when the learning of the difference amount is complete in any one of the difference amount learning regions. Among the difference amounts, the difference resulting from the individual difference of the detection characteristics of the airflow meter and the open degree characteristics or the like of the throttle valve often appears with a tendency common to the entire running region of the engine. When the engine controller is configured as described above, the difference amount learning values in all the difference amount learning regions are collectively updated until the learning of the difference amount has been completed in any one of the difference amount learning regions. Thus, the difference that appears with the tendency common to the entire running region of the engine is learned collectively without dividing the difference amount learning region by the time the learning of the difference amount is completed in any one of the difference amount learning regions. Subsequently, the difference between the difference amounts in the difference amount learning regions is learned separately for each difference amount learning region. This shortens the period required to learn the difference amounts in the difference amount learning regions.

The difference of the intake air amount calculated values between the calculation modes include a portion dependent on the state of the body of each type of the engine (hereinafter referred to as body-dependent portion), which occurs due to individual differences and changes over time and a portion independent from the state (hereinafter referred to as body-independent portion), which occurs due to other factors. The body-independent portion can be checked in advance through, for example, measurement. In the engine controller according to example 2 or 3, the engine controller according to example 4 is configured to perform the learning of the difference amount in the difference amount calculation process by updating the difference amount learning value based on a difference obtained by subtracting, from the difference amount, a shift correction amount calculated in accordance with a rotation speed of the engine and load of the engine. Further, the engine controller calculated as the corrected second intake air amount using, as the value of the difference amount, as the sum of the difference amount learning value and the shift correction amount. That is, the amount of the body-independent portion is calculated from the relationship between the engine rotation speed and load that have been obtained in advance and the amount of the body-independent portion of the difference, thereby reflecting the learning of the difference amount and the calculation of the second intake air amount. In such a case, only the body-dependent portion needs to be reflected on the difference amount learning value. This shortens the time to learn the difference amount of each difference amount learning region.

The difference amount of the intake air amount calculated value between the calculation modes varies depending on temperature conditions such as intake air temperature and environmental conditions of the engine such as pressure condition of atmospheric pressure. Thus, when learning is performed with different environmental conditions, variation occurs in the learning result. In the engine controller according to example 2 or 3, in the environmental correction according to example 5, the learning of the difference amount in the difference amount calculation process is performed by updating the difference amount learning value based on a difference obtained by subtracting, from the difference amount, a shift correction amount calculated in accordance with a rotation speed of the engine and load of the engine. Further, the engine controller calculates the corrected second intake air amount by using, as a value of the difference amount, a value obtained by performing inverse correction of the environmental correction on the difference amount learning value. This limits reflection of the influence of the environmental condition on the difference amount learning value and thus improves the learning accuracy.

The configuration of the above-described engine controller may include an intake pipe model that calculates the change amount of the intake pipe pressure per unit of time from the detected value of the airflow meter and calculates the intake pipe pressure by updating the value in accordance with the change amount of the intake pipe pressure per unit of time. Further, the engine controller may use the intake pipe pressure calculated with the intake pipe model to calculate the first intake air amount with the first intake air amount calculation process. In such a case, when the large pulsation determination is made, that is, when the detection accuracy of the airflow meter is decreased, the calculation accuracy of the intake pipe pressure is decreased in the intake pipe model based on the detected value of the intake air flow rate of the airflow meter. In the intake pipe model, the absolute value of the intake pipe pressure is not directly calculated. Thus, a calculation error in the intake pipe pressure of the intake pipe model that occurs during the large pulsation determination will remain even if the intake pulsation then decreases and the detection accuracy of the airflow meter recovers. In the engine controller according to any one of examples 1 to 5, the engine controller according to example 6 is configured to replace a calculated value of the intake pipe pressure of the intake pipe model with the detected value of the intake pipe pressure or an estimated value of the intake pipe pressure that is based on the throttle opening degree when the determination of the determination process is switched from the determination that the intake pulsation is large to the determination that the intake pulsation is not large. The decrease in the detection accuracy of the airflow meter during the large pulsation determination does not affect the detected value of the intake pipe pressure and the estimated value of the intake pipe pressure that is based on the throttle open degree. Thus, the calculation value of the intake pipe pressure of the intake pipe model in which an error occurs during the large pulsation determination is replaced with a value including fewer errors at the same time when the large pulsation determination is switched to the small pulsation determination. This limits the decrease in the calculation accuracy of the modification intake air amount MCADJ after switching from the large pulsation determination to the small pulsation determination.

In the difference amount calculation process of the engine controller according to example 1, the difference amount learning value, which is a learning value of the difference amount, is calculated by updating the value in accordance with the deviation amount of the second intake air amount from the first intake air amount. The difference amount learning value is reflected on the calculated value of the intake air amount in a pulsation region serving as an engine running region where intake pulsation is generated. In some cases, the pulsation region and the running region located away from the pulsation region may have different difference amounts between the first intake air amount and the second intake air amount. Accordingly, in order to ensure the learning accuracy, it is desired that the running region where the difference amount learning value is learned is limited to the running region located close to the pulsation region. However, in such a case, learning opportunities may be limited, and it may take a long time to complete the learning of the difference amount learning value.

In the difference amount calculation process of the engine controller according to example 7, the difference amount learning value according to the deviation amount in a first learning region is learned before completion of the learning of the difference amount learning value, and the difference amount learning value according to the deviation amount in a second learning region is learned after completion of the learning of the difference amount learning value. The first learning region includes a pulsation region, which is an engine running region where the intake pulsation occurs, and the second learning region includes the pulsation region and is narrower than the first learning region. This shortens the time to complete the learning while ensuring learning opportunities before completion of the learning and allows for the learning with high accuracy after completion of the learning. This allows the learning of the difference amount learning value to be performed in a favorable manner.

In some cases, the difference amounts of the first intake air amount and the second intake air amount resulting from the difference between calculation modes may be amounts that differ depending on the engine rotation speed. In such a case, as example 8, in the engine controller according to example 7, the difference amount learning value, the first learning region, and the second learning region simply needs to be set separately for each of rotation speed regions divided in accordance with the engine rotation speed, and whether the learning of the difference amount learning value has been completed simply needs to be determined separately in each of the rotation speed regions.

It can be determined whether the learning of the difference amount learning value has been completed when the value of the deviation amount in the pulsation region is updated to become sufficiently small. As described above, the difference amounts of the first intake air amount and the second intake air amount resulting from the difference between the calculation modes may be different amounts in the running region located close to the pulsation region and the running region located away from the pulsation region. Thus, when the determination of whether the learning of the difference amount learning value has been completed is performed in the entire first learning region, in a case in which the determination is made in the running region located away from the pulsation region, it may be determined that the learning has been completed in a state in which the deviation amount is not sufficiently small in the running region located close to the pulsation region. In Example 9, in the engine controller according to example 7 or 8, completion of the learning of the difference amount learning value is determined based on the deviation amount in the second learning region. This allows for proper determination of completion of the learning of the difference amount learning value before completion of learning while performing the determination in the first learning region.

The determination of whether learning has been completed can be made in the following manner. That is, in example 10, the engine controller according to example 9 determines whether an absolute value of the deviation amount is less than or equal to a preset convergence determination value in each of preset determination cycles when the engine is running in the second learning region. Further, the engine controller determines, when a number of times of determining that the absolute value of the deviation amount is less than or equal to the convergence determination value becomes a preset learning complete determination value or higher, that the learning of the difference amount learning value has been completed.

The ranges of the first learning region and the second learning region are set based on the intake pipe pressure, for example, as follows. That is, in example 11, the engine controller according to any one of examples 7 to 10 sets the first learning region as a region in which the intake pipe pressure is greater than or equal to a preset first lower limit value and sets the second learning region as a region in which the intake pipe pressure is greater than or equal to a second lower limit value, the second lower limit value being higher than the first lower limit value.

In example 12, in the engine controller according to example 1, an indirect variable intake air mechanism is arranged in the engine. When the indirect variable intake air mechanism is configured to be controlled independently from the throttle opening degree and vary the intake air amount of the engine, the engine controller is further configured to perform a shift correction amount calculation process for calculating a shift correction amount based on a control state of the indirect variable intake air mechanism, the intake pipe pressure, and an engine rotation speed. Further, the engine controller, in the difference amount calculation process, learns a difference amount learning value by updating the difference amount learning value so as to approximate a value obtained by subtracting the shift correction amount from a difference of the second intake air amount from the first intake air amount and calculates a sum of the difference amount learning value and the shift correction amount as a value of the difference amount.

The difference amounts of the first intake air amount and the second intake air amount resulting from the difference between calculation modes vary depending on the running states of the engine such as engine rotation speed and intake pipe pressure. When the indirect intake air varying mechanism that is controlled independently from the throttle open degree to vary the intake air amount of the engine, the control state of the indirect intake air varying mechanism serves as a factor for varying the difference amount in addition to the engine rotation speed and the intake pipe pressure. In the engine controller, the changes in the difference amount resulting from the engine rotation speed, the intake pipe pressure, and the control state of the indirect intake air varying mechanism are calculated as the value of the shift correction amount. Thus, from the difference between the first intake air amount and the second intake air amount, the value in which the changes in the difference amount resulting from the engine rotation speed, the intake pipe pressure, and the control state of the indirect intake air varying mechanism are excluded is learned. Thus, the intake air amount can be properly calculated during the large pulsation determination even if the running state and the environmental condition of the engine differ between when the difference amount learning value is learned and when the difference amount learning value is reflected on the intake air amount calculated value. This enlarges the range of the running state and the environmental condition of the engine where the learning of the difference amount learning value is performed. Thus, the opportunities to perform learning of the difference amount learning value can be increased, thereby shortening the time to complete learning.

In the engine controller according to example 12, the indirect intake air varying mechanism includes the indirect variable intake air mechanism is an exhaust gas recirculation mechanism that recirculates some of exhaust gas into intake air as example 13 and the indirect variable intake air mechanism is a variable valve mechanism that varies a valve timing of an intake valve as example 14.

The difference of the calculated values of the intake air amount between the calculation modes varies depending on temperature conditions such as intake air temperature and environmental conditions of the engine such as pressure condition of atmospheric pressure. Thus, when learning is performed with different environmental conditions, variation occurs in the learning result. As example 15, in the engine controller according to any one of examples 12 to 14, the engine controller is configured to calculate, in the shift correction amount calculation process, the shift correction amount based on a state quantity of an environmental condition of the engine in addition to the control state of the indirect variable intake air mechanism, the intake pipe pressure, and the engine rotation speed. This limits reflection of the influence of the environmental condition on the difference amount learning value and thus improves the learning accuracy. As example 16, in the engine controller according to example 15, the state quantity of the environmental condition includes, for example, an atmospheric pressure.

Example 17

An engine control method for executing the processes described in examples 1 to 16.

Example 18

A non-transitory computer-readable storage medium storing a program causing a processor to execute the control processes described in examples 1 to 16.

Other features and aspects will be apparent from the following detailed description, the drawings, and the claims.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

An engine controller according to a first embodiment will now be described with reference to FIGS. 1 to 6.

Figure 1:
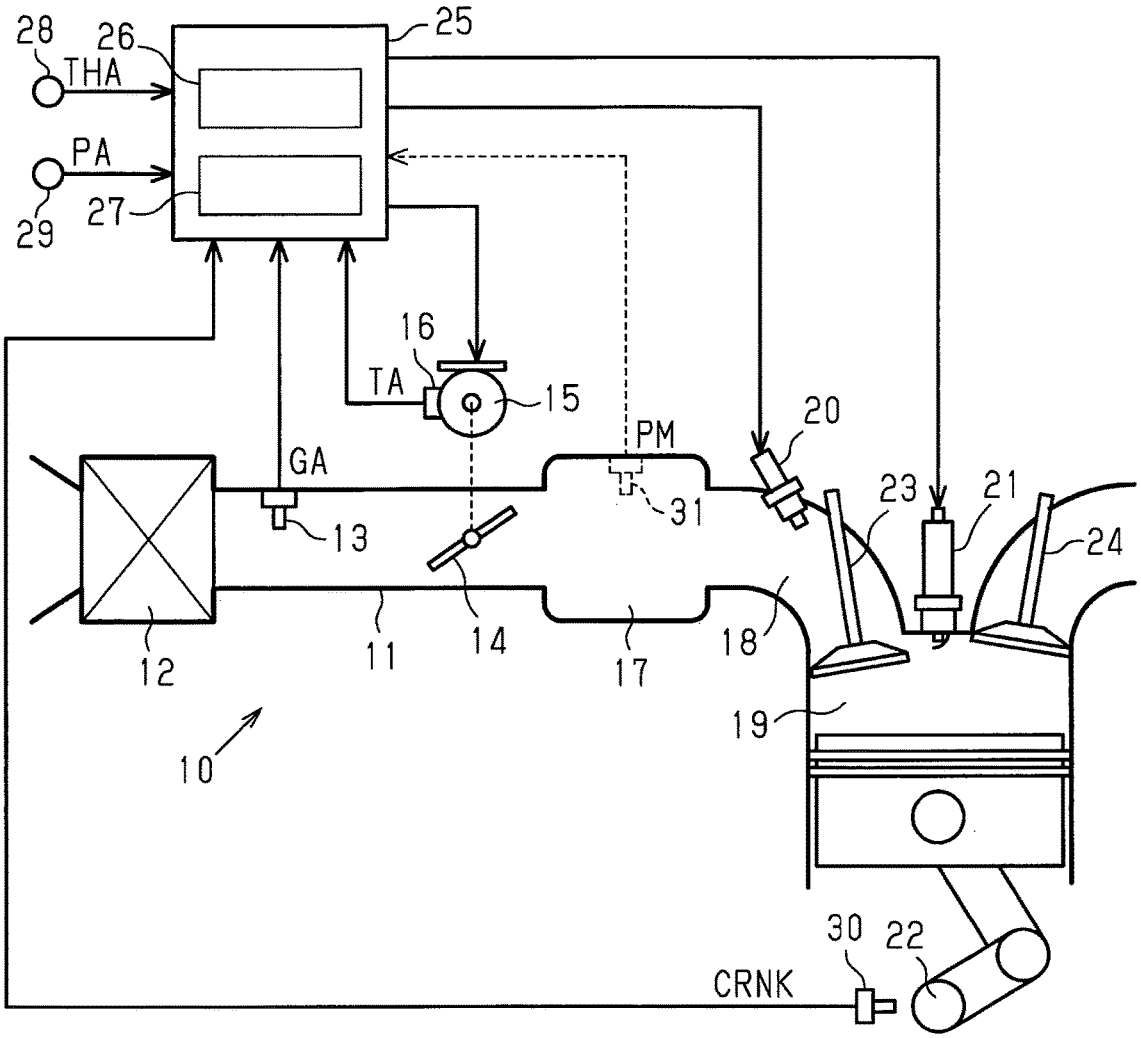
FIG. 1 is a schematic diagram illustrating the structure of an engine controller according to a first embodiment of the present disclosure.

FIG. 1 shows an engine 10 for which the engine controller of the present embodiment is employed. The engine 10 includes an intake passage 11. An air cleaner 12 that filters dust or the like in intake air is arranged on the most upstream side of the intake passage 11. An air flowmeter 13 that detects an intake air flow rate is arranged in the portion of the intake passage 11 located downstream of the air cleaner 12. Further, a throttle valve 14 for adjusting the intake air flow rate of the intake passage 11 is arranged in the portion of the intake passage 11 located downstream of the air flowmeter 13. In the vicinity of the throttle valve 14, a throttle motor 15 and a throttle sensor 16 are arranged. The throttle motor 15 opens and closes the throttle valve 14, and the throttle sensor 16 detects the opening degree (throttle opening degree TA) of the throttle valve 14.

An intake manifold 17 is arranged on the portion of the intake passage 11 located downstream of the throttle valve 14. The intake manifold 17 is a branch tube that distributes intake air into the cylinders of the engine 10. Each branch tube of the intake manifold 17 is connected to a combustion chamber 19 of the corresponding cylinder through an intake port 18 of the corresponding cylinder. The intake port 18 of each cylinder includes an injector 20 that injects fuel into intake air flowing through the intake port 18 into the combustion chamber 19. Further, the combustion chamber 19 of each cylinder includes an ignition device 21 that performs ignition by discharging the mixture of fuel and intake air that has flowed into the combustion chamber 19. Each cylinder includes an intake valve 23 and an exhaust valve 24 that open and close in cooperation with rotation of a crankshaft 22, which is the output shaft of the engine 10. When the intake valve 23 opens, intake air flows from the intake port 18 to the combustion chamber 19. When the exhaust valve 24 opens, exhaust air is discharged out of the combustion chamber 19.

The engine 10 is controlled by an electronic control unit 25 serving as an engine controller. The electronic control unit 25 includes a calculation processing circuit 26 that performs various types of calculation processes for engine control and a memory 27 that stores programs and data for the control. The electronic control unit 25 receives the detection signals of various types of sensors such as an intake air temperature sensor 28 that detects an intake air temperature THA, an atmospheric pressure sensor 29 that detects an atmospheric pressure PA, and a crank angle sensor 30 that detects the rotation angle (crank angle CRNK) of the crankshaft 22, in addition to the air flowmeter 13 and the throttle sensor 16. Based on the detection signals of these sensors, the electronic control unit 25 performs various types of control for the engine 10 by controlling the actuators such as the throttle motor 15, the injector 20, and the ignition device 21. The electronic control unit 25 calculates an engine rotation speed NE based on the detection result of the crank angle sensor 30 by the crank angle sensor 30.

Figure 2:
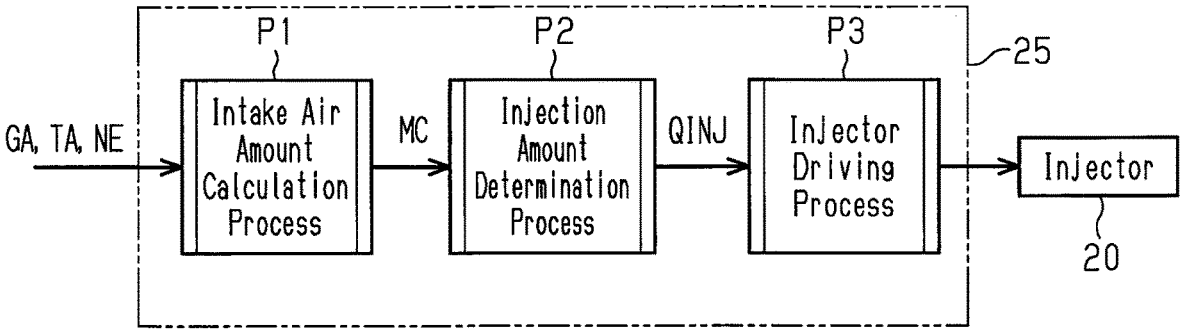
FIG. 2 is a block diagram illustrating a procedure for processes for controlling a fuel injection amount executed by the engine controller of FIG. 1.

FIG. 2 shows a procedure of processes for controlling the fuel injection amount of the injector 20 performed by the electronic control unit 25. When controlling the fuel injection amount, the electronic control unit 25 first executes an intake air amount calculation process P1 to calculate the intake air amount of the engine 10 based on the throttle opening degree TA, the engine rotation speed NE, and an AFM detection intake air amount GA, which is the detected value of the intake air flow rate of the air flowmeter 13. The intake air amount calculated in the intake air amount calculation process P1 (hereinafter referred to as intake air amount calculated value MC) represents the estimated value of the mass of air burned in the combustion chamber 19. Subsequently, the electronic control unit 25 executes an injection amount determination process P2 to determine a fuel injection amount QINJ such that the air-flow ratio of the air-fuel mixture burned in the combustion chamber 19 becomes a target value based on the intake air amount calculated value MC, which has been calculated in the intake air amount calculation process P1. Then, the electronic control unit 25 executes an injector driving process P3 to drive the injector 20 of each cylinder such that fuel injection is performed by an amount corresponding to the fuel injection amount QINJ.

Figure 3:
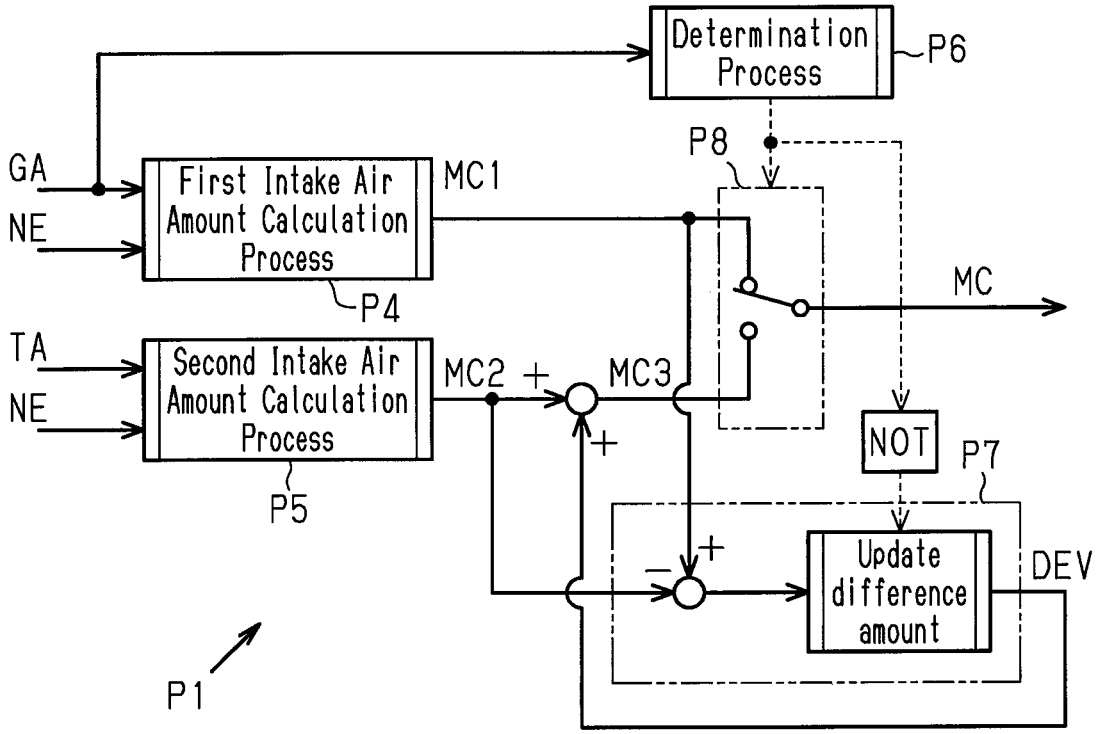
FIG. 3 is a block diagram illustrating the procedure of an intake air amount calculation process executed by the engine controller of FIG. 1.

FIG. 3 shows the procedure of the intake air amount calculation process P1 executed by the electronic control unit 25. The intake air amount calculation process P1 is executed through a first intake air amount calculation process P4, a second intake air amount calculation process P5, a determination process P6, a difference amount calculation process P7, and a calculation mode switching process P8.

In the first intake air amount calculation process P4, the intake air amount is calculated based on the engine rotation speed NE and the AFM detection intake air amount GA, which is the detected value of the intake air flow rate of the air flowmeter 13. More specifically, in the first intake air amount calculation process P4, the quotient of the AFM detection intake air amount GA divided by the engine rotation speed NE is multiplied by a preset coefficient K (i.e., KxGA/NE). This value is calculated as a value of the intake air amount of the normal running. Further, the intake air amount is calculated as a value that gradually changes while following the intake air amount of the normal running. That is, in the first intake air amount calculation process P4, the intake air amount is calculated using the detected value (GA) of the intake air flow rate of the air flowmeter 13, namely, using the mass flow mode. In the following description, the calculated value of the intake air amount obtained through the first intake air amount calculation process P4 is referred to as a first intake air amount MC1.

In the second intake air amount calculation process P5, the intake air amount is calculated based on the throttle opening degree TA and the engine rotation speed NE. More specifically, in the second intake air amount calculation process P5, the intake air flow rate is estimated based on the throttle opening degree TA and the engine rotation speed NE. In addition, the quotient of the estimated value of the intake air flow rate (estimated intake air flow rate GA*) divided by the engine rotation speed NE is multiplied by the coefficient K (i.e., K×GA*/NE). This value is obtained as a value of the intake air amount of the normal running. Further, the intake air amount is calculated as a value that gradually changes while following the intake air amount of the normal running. That is, in the second intake air amount calculation process P5, instead of the detected value (GA) of the intake air flow rate of the air flowmeter 13, the estimated value of the intake air flow rate based on the throttle opening degree TA and the engine rotation speed NE is used to calculate the intake air amount, namely, perform calculation with the throttle speed mode. In the following description, the calculated value of the intake air amount obtained through the second intake air amount calculation process P5 is referred to as a second intake air amount MC2.

In the determination process P6, it is determined whether the intake pulsation in the intake passage 11 is large. The determination process P6 will be described in detail later.

In the difference amount calculation process P7, when it is determined that the intake pulsation is not large in the determination process P6 (hereinafter referred to as small pulsation determination), a difference amount DEV of the second intake air amount MC2 from the first intake air amount MC1 is calculated. More specifically, in the difference amount calculation process P7, when the small pulsation determination is made, the difference obtained by subtracting the second intake air amount MC2 from the first intake air amount MC1 is obtained. Then, the value of the difference amount DEV is updated such that the difference becomes the value of the difference amount DEV subsequent to being updated. When it is determined that the intake pulsation is large (hereinafter referred to as large pulsation determination) in the determination process P6, the value of the difference amount DEV is kept instead of implementing the difference amount calculation process P7.

In the calculation mode switching process P8, when the small pulsation determination is made, the first intake air amount MC1 is set as the value of the intake air amount calculated value MC. Further, in the calculation mode switching process P8, when the large pulsation determination is made, a corrected second intake air amount MC3, which is the sum of the second intake air amount MC2 and the difference amount DEV (MC3=MC2+DEV), is set as the value of the intake air amount calculated value MC.

Figure 4:
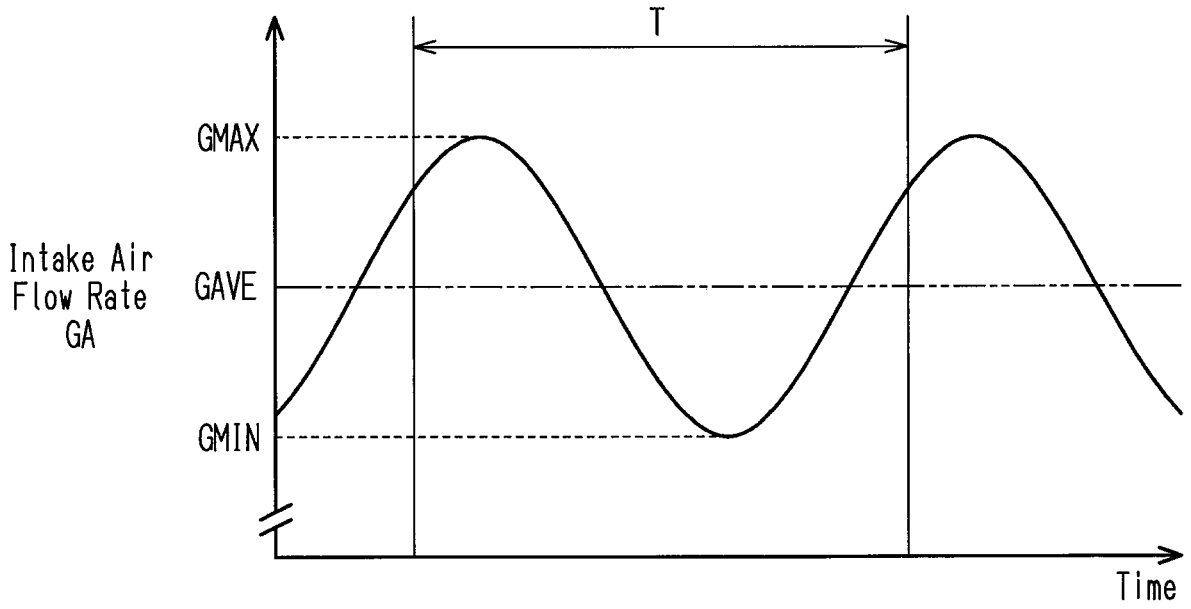
FIG. 4 is a graph illustrating the mode of calculating a pulsation ratio used in a pulsation determination process by the engine controller of FIG. 1.

The determination process P6 will now be described in detail. In the determination process P6, as shown in FIG. 4, a maximum value GMAX, a minimum value GMIN, and an average value GAVE of the AFM detection intake air amount GA during a preset period T are used. The period T is set to be longer than the cycle of intake pulsation.

Figure 5:
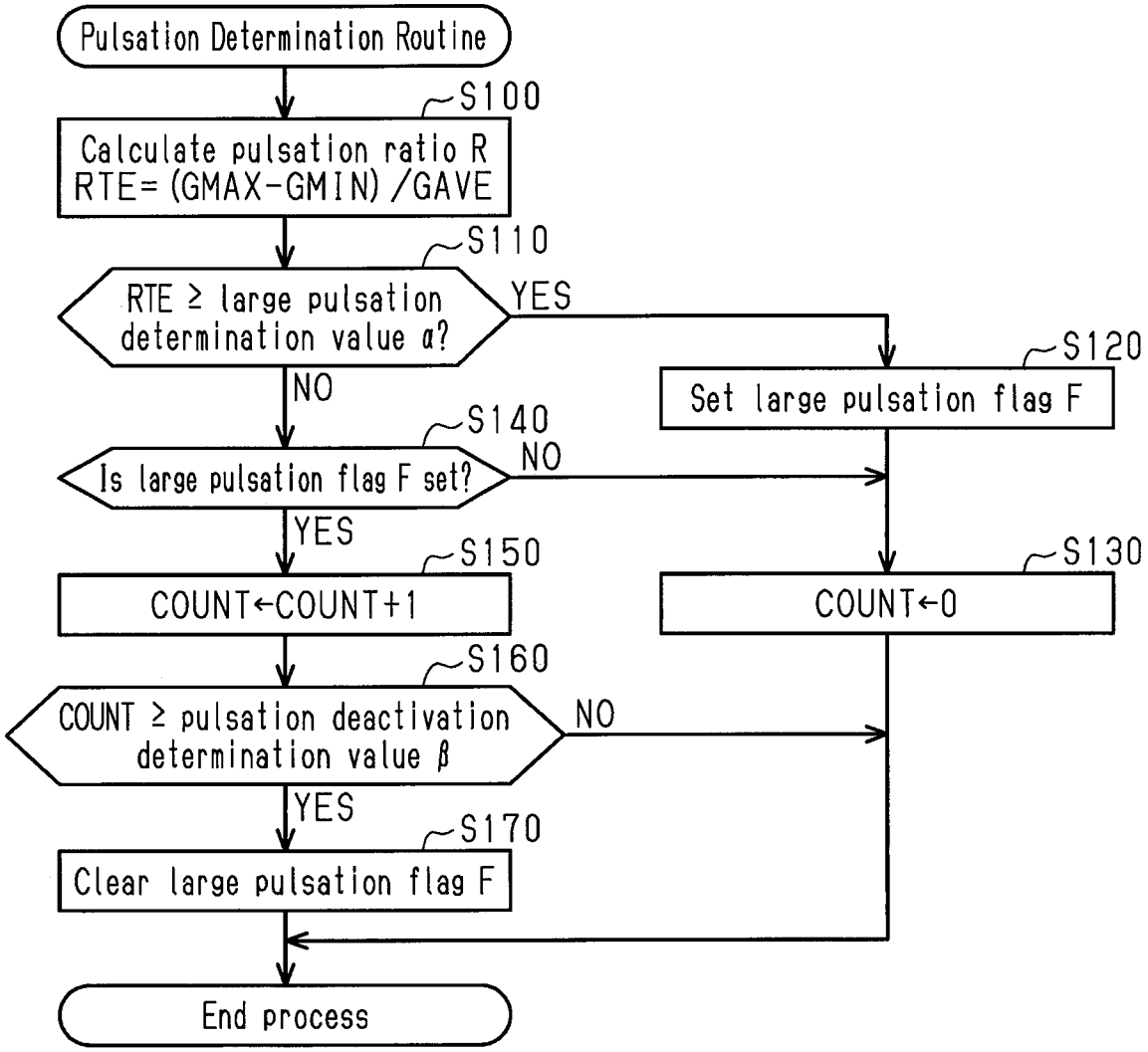
FIG. 5 is a flowchart illustrating a pulsation determination routine executed in the pulsation determination process by the engine controller of FIG. 1.

FIG. 5 shows the flowchart of a pulsation determination routine executed in the determination process P6. While the engine 10 is running, the processes of this routine are repeatedly executed by the electronic control unit 25 in the calculation cycles of the intake air amount.

When the processes of this routine are started, a pulsation ratio RTE is first calculated in step S100. The value of the pulsation ratio RTE is calculated as the quotient of the difference obtained by subtracting the minimum value GMIN from the maximum value GMAX of the AFM detection intake air amount GA, which has been described above, divided by the average value GAVE (i.e., (GMAX−GMIN)/GAVE). Subsequently, it is determined in step S110 whether the value of the pulsation ratio RTE is greater than or equal to a preset large pulsation determination value α.

When the value of the pulsation ratio RTE is greater than or equal to the large pulsation determination value α (S110: YES), the process is advanced to step S120. In step S120, a large pulsation flag F is set. Further, in this case, the value of a counter COUNT is reset to 0 in step S130. Then, the process of the current routine is ended. The large pulsation flag F indicates the determination result of the determination process P6. The large pulsation flag F is set when the large pulsation determination is made, and the large pulsation flag F is cleared when the small pulsation determination is made. In the difference amount calculation process P7 and the calculation mode switching process P8, the determination result of the determination process P6 is checked depending on whether the large pulsation flag F has been set.

When the value of the pulsation ratio RTE is less than the large pulsation determination value α (S110: NO), the process is advanced to step S140. In step S140, it is determined whether the large pulsation flag F has been set. When the large pulsation flag F is not set (S140: NO), the process is advanced to step S130. In step S130, after the value of the counter COUNT is reset to 0, the current routine is ended. When the large pulsation flag F is set (S140: YES), the process is advanced to step S150.

When the process is advanced to step S150, the value of the counter COUNT is incremented in step S150. Subsequently, it is determined in step S160 whether the incremented value of the counter COUNT is greater than or equal to a preset pulsation deactivation determined value β. When the value of the counter COUNT is less than the pulsation deactivation determined value β (S160: NO), the process of the current routine is ended. When the value of the counter COUNT is greater than or equal to the pulsation deactivation determined value β (S160: YES), the large pulsation flag F is cleared in step S170. Then, the process of the current routine is ended.

In the above-described pulsation determination routine, when the value of the pulsation ratio RTE is increased from a value less than the large pulsation determination value α to a value greater than or equal to the large pulsation determination value α, the large pulsation flag F is switched from a cleared state to a set state. Further, when the pulsation ratio RTE is less than the large pulsation determination value α and the value of the counter COUNT is greater than or equal to the large pulsation determination value α, the large pulsation flag F is switched from the set state to the cleared state. When the pulsation ratio RTE is less than the large pulsation determination value α and the large pulsation flag F is set, the value of the counter COUNT is incremented. In other cases, the value of the counter COUNT is reset. That is, the value of the counter COUNT starts to be incremented when the pulsation ratio RTE drops from a value greater than or equal to the large pulsation determination value α to a value less than the large pulsation determination value α. Then, the value of the counter COUNT continues to be incremented until the pulsation ratio RTE becomes greater than or equal to the large pulsation determination value α or until the large pulsation flag F is cleared. The value of the counter COUNT is incremented each time the pulsation determination routine is executed. In addition, the pulsation determination routine is executed in each calculation cycle of the intake air amount. Thus, the large pulsation flag F is switched from the set state to the cleared state when the pulsation ratio RTE drops from a value greater than or equal to the large pulsation determination value α to a value less than the large pulsation determination value α and then the pulsation ratio RTE continues to be less than the large pulsation determination value α for a certain period of time.

The advantages of the engine controller according to the present embodiment will now be described.

Figure 6:
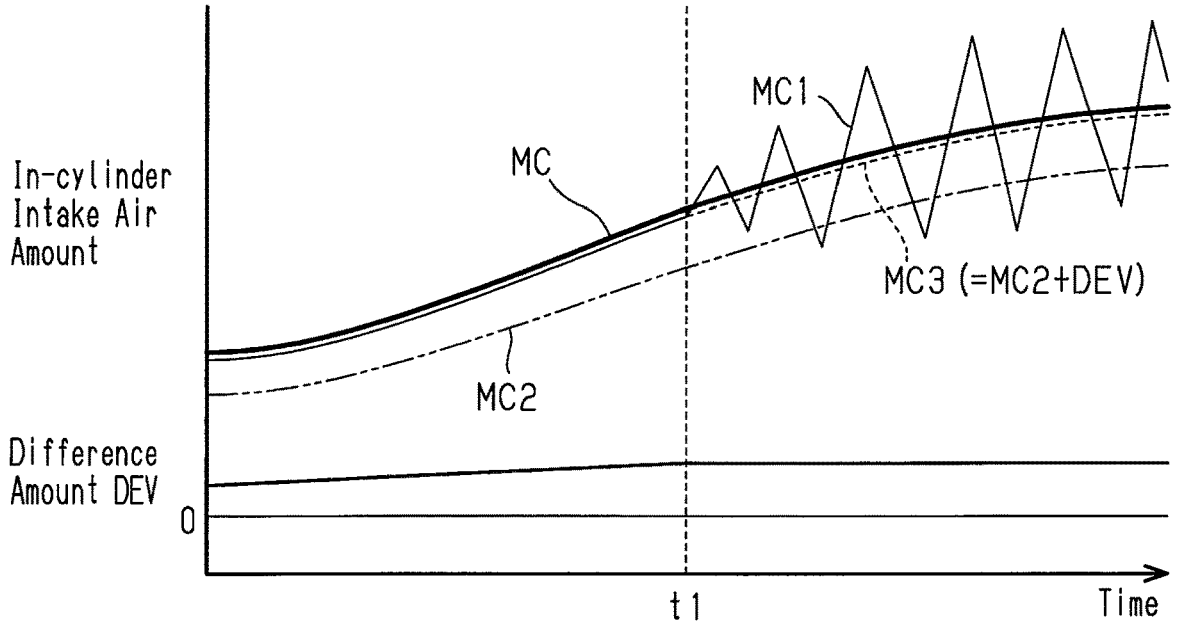
FIG. 6 is a time chart illustrating an example of the mode of implementing the intake air amount calculation process in the intake engine controller of FIG. 1.

FIG. 6 shows an example of the mode of implementing the intake air amount calculation process P1 in the engine controller of the present embodiment.

In the intake passage 11 of the engine 10, when the intake valve 23 intermittently opens, the pulsation of intake air occurs. For example, when the engine 10 is running with high load, such intake pulsation increases. This affects the detection result of the air flowmeter 13. Thus, when the intake pulsation is large, the detection accuracy of the air flowmeter 13 is low.

The calculation of the intake air amount with the mass flow mode is performed based on the detected value of the intake air flow rate of the air flowmeter 13 (AFM detection intake air amount GA). Thus, when the detection accuracy of the air flowmeter 13 decreases in a state in which the intake pulsation is large, the calculation accuracy of the intake air amount with the mass flow mode decreases.

In the present embodiment, it is determined in the determination process P6 whether the intake pulsation is large. When the small pulsation determination is made, the intake air amount is calculated with the mass flow mode. When the large pulsation determination is made, the intake air amount is calculated with the throttle speed mode.

In FIG. 6, the small pulsation determination is made in the determination process P6 and the large pulsation flag F is cleared until the point in time t1. At the point in time t1, the determination result of the determination process P6 is switched from the small pulsation determination to the large pulsation determination. Subsequent to the point in time t1, the large pulsation flag F is set. During the small pulsation determination, the detection accuracy of the air flowmeter 13 does not decrease. This possibly indicates that the calculation accuracy of the first intake air amount MC1 is high in the first intake air amount calculation process P4. In the present embodiment, the first intake air amount MC1 is calculated as the value of the intake air amount calculated value MC during the small pulsation determination.

If the first intake air amount MC1 is a correct value during the small pulsation determination, the error corresponding to the difference amount DEV of the second intake air amount MC2 from the first intake air amount MC1 occurs in the calculated value of the second intake air amount MC2. In the present embodiment, the difference amount calculation process P7 is executed to calculate the difference amount DEV during the small pulsation determination.

When the determination result is switched from the small pulsation determination to the large pulsation determination, the detection accuracy of the air flowmeter 13 decreases, thereby decreasing the detection accuracy of the first intake air amount MC1 through the first intake air amount calculation process P4. In the present embodiment, the corrected second intake air amount MC3, which is the sum of the second intake air amount MC2 and the difference amount DEV calculated during the small pulsation determination, is calculated as the value of the intake air amount calculated value MC. That is, the error of the second intake air amount MC2 is checked from the calculation result of the difference amount DEV during the small pulsation determination, and the value that makes up for the error of the second intake air amount MC2 is calculated as the value of the intake air amount calculated value MC during the large pulsation determination. Thus, even when the intake pulsation is large, the intake air amount calculated value MC can be calculated accurately, Further, when the difference of the second intake air amount MC2 from the first intake air amount MC1 is properly set as the value of the difference amount DEV, the first intake air amount MC1 at the point in time t1 is equal to the corrected second intake air amount MC3, which is the sum of the second intake air amount MC2 and the difference amount DEV. Thus, in the present embodiment, the occurrence of a step in the value of the intake air amount calculated value MC is limited prior to and subsequent to switching the calculation mode.

Second Embodiment

An engine controller according to a second embodiment will now be described also with reference to FIG. 7. In the present embodiment and each of the embodiments described later, like or same reference numerals are given to those components that are the same as the corresponding components of the above-described embodiment. Such components will not be described in detail.

In the structure of the engine 10 for which the engine controller of the present embodiment is employed, an intake pipe pressure sensor 31 shown by the broken line in FIG. 1 is added to the structure of the engine 10 of the first embodiment. The intake pipe pressure sensor 31 is arranged in the portion of the intake passage 11 located downstream of the throttle valve 14 (i.e., arranged in the intake manifold 17). The intake pipe pressure sensor 31 detects the pressure of intake air in this portion (hereinafter referred to as intake pipe pressure PM). The detection signals of the intake pipe pressure sensor 31 are input to the electronic control unit 25.

Figure 7:
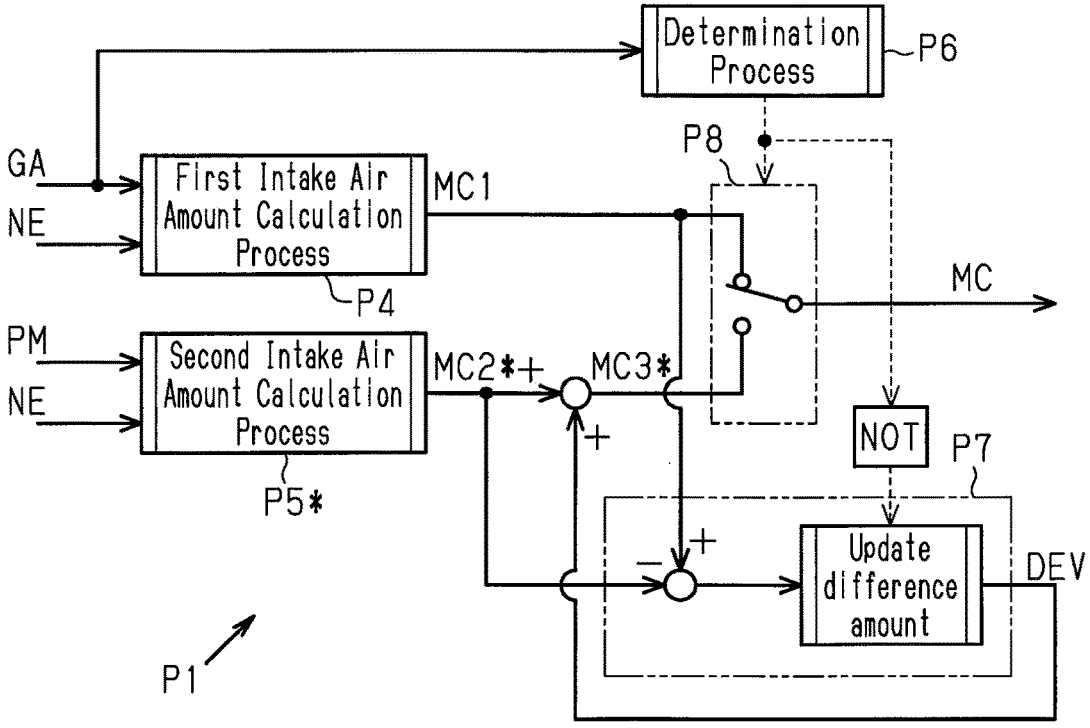
FIG. 7 is a block diagram illustrating the procedure of the intake air amount calculation process executed by an engine controller according to a second embodiment of the present disclosure.

FIG. 7 shows the procedure of the intake air amount calculation process P1 executed by the electronic control unit 25 in the engine controller of the present embodiment. The intake air amount calculation process P1 is executed through the first intake air amount calculation process P4, a second intake air amount calculation process P5*, the determination process P6, the difference amount calculation process P7, and the calculation mode switching process P8. The contents of the first intake air amount calculation process P4, the determination process P6, the difference amount calculation process P7, and the calculation mode switching process P8 are the same as those of the first embodiment.

In the second intake air amount calculation process P5* of the present embodiment, the intake air amount is calculated based on the intake pipe pressure PM and the engine rotation speed NE. More specifically, in the second intake air amount calculation process P5*, the intake air flow rate is estimated based on the intake pipe pressure PM and the engine rotation speed NE. In addition, the quotient of the estimated value of the intake air flow rate (estimated intake air flow rate GA*) divided by the engine rotation speed NE is multiplied by the coefficient K (i.e., K×GA*/NE). This value is obtained as a value of the intake air amount of the normal running. Further, the intake air amount is calculated as a value that gradually changes while following the intake air amount of the normal running. That is, in the second intake air amount calculation process P5*, instead of the detected value (GA) of the intake air flow rate of the air flowmeter 13, the estimated value of the intake air flow rate based on the intake pipe pressure PM and the engine rotation speed NE is used to calculate the intake air amount, namely, perform calculation with the speed density mode. In the following description, the calculated value of the intake air amount obtained through the second intake air amount calculation process P5* is referred to as a second intake air amount MC2*.

In the present embodiment, when the small pulsation determination is made, the first intake air amount MC1 calculated with the mass flow mode is calculated as the value of the intake air amount calculated value MC, and the difference amount DEV of the second intake air amount MC2* from the first intake air amount MC1 is calculated. In this calculation, the value of the difference amount DEV corresponds to the calculation error of the second intake air amount MC2*. When the large pulsation determination is made, a corrected second intake air amount MC3*, which is the sum of the second intake air amount MC2* and the difference amount DEV calculated during the small pulsation determination, is calculated as the value of the intake air amount calculated value MC. Thus, in the present embodiment, in the same manner as the first embodiment, when the intake pulsation is large, the intake air amount calculated value MC can be calculated accurately. In addition, the occurrence of a step in the value of the intake air amount calculated value MC is limited prior to and subsequent to switching the calculation mode.

Third Embodiment

An engine controller according to a third embodiment will now be described also with reference to FIGS. 8 to 10.

In the engine controller of the present embodiment, an air model, which is a physical model of the intake system of the engine 10, is used to estimate the intake air amount. The air model is configured by sub-models including a throttle model M1, an intake pipe model M2, an intake valve model M3, and an air cleaner model M4.

The throttle model M1 is a physical model for the behavior of intake air in the throttle valve 14. More specifically, the throttle model M1 includes, as variables, a throttle upstream pressure PAC, the intake pipe pressure PM, an upstream temperature THAC, and the throttle opening degree TA. From the relationship of a constriction expression (1), the throttle model M1 calculates and outputs the flow rate of intake air passing through the throttle valve 14 (throttle passing intake air amount MT). The throttle upstream pressure PAC represents the pressure of air prior to passing through the throttle valve 14, and the upstream temperature THAC represents the temperature of intake air prior to passing through the throttle valve 14. In the engine 10 of a natural aspiration type, the temperature of intake air does not vary to a large extent in the portion of the intake passage 11 located upstream of the throttle valve 14. Thus, in the present embodiment, the intake air temperature THA detected by the intake air temperature sensor 28 is used as the value of the upstream temperature THAC.

$$MT = \mu \times At(TA) \times \frac{PAC}{\sqrt{R \times TA}} \times \Phi\left(\frac{PM}{PAC}\right) \tag{1}$$

In expression (1), represents a flow rate coefficient, R represents gas constant, At(TA) represents the function for obtaining the open area of the throttle valve 14 from the throttle opening degree TA. Further, in expression (1), φ(PM/PAC) is the function shown in expression (2). In expression (2), K represents the heat capacity ratio of intake air.

$$\Phi\left(\frac{PM}{PAC}\right) = \begin{cases} \sqrt{\frac{\kappa}{2 \times (\kappa + 1)}} & \text{where } \frac{PM}{PAC} \leq \frac{1}{\kappa + 1} \\ \sqrt{\left\{\frac{\kappa - 1}{2 \times \kappa} \times \left(1 - \frac{PM}{PAC}\right) + \frac{PM}{PAC}\right\} \times \left(1 - \frac{PM}{PAC}\right)} & \text{where } \frac{PM}{PAC} > \frac{1}{\kappa + 1} \end{cases} \tag{2}$$

The intake pipe model M2 is a physical model for the behavior of intake air in the intake manifold 17. More specifically, the intake pipe model M2 includes, as variables, the throttle passing intake air amount MT, the upstream temperature THAC, and an intake manifold outflow intake air amount MCM. From these variables, the intake pipe model M2 calculates and outputs the intake pipe pressure PM and an intake manifold temperature THM. The intake manifold temperature THM represents the temperature of intake air in the intake manifold 17. The intake manifold outflow intake air amount MCM represents the flow rate of intake air flowing out of the intake manifold 17. More specifically, the intake pipe model M2 first obtains the change amounts of the intake manifold temperature THM and the intake pipe pressure PM per unit of time from the relationship of expression (3) and expression (4). Then, the intake pipe model M2 obtains the intake manifold temperature THM and the intake pipe pressure PM by updating the values of the intake manifold temperature THM and the intake pipe pressure PM by amounts corresponding to their change amounts. In expression (3) and expression (4), VM represents the volume of the intake manifold 17.

$$\frac{d}{dt}\left(\frac{PM}{THM}\right) = \frac{R}{VM} \times (MT - MCM) \tag{3}$$

$$\frac{d}{dt}PM = \kappa \times \frac{R}{VM} \times (MR \times THAC - MCM \times THM) \tag{4}$$

The intake valve model M3 is a physical model for the behavior of intake air flowing from the intake manifold 17 to the combustion chamber 19 of each cylinder. More specifically, the intake valve model M3 includes the intake pipe pressure PM and the intake manifold temperature THM as input variables. From the relationship of expression (5), the intake valve model M3 calculates and outputs the intake manifold outflow intake air amount MCM. Intake air intermittently flows from the intake manifold 17 to the combustion chamber 19 when the intake valve 23 opens and closes. In this model, the intermittent flow is approximated (averaged) to a continuous, even flow. The flow rate of this flow is calculated as the intake manifold outflow intake air amount MCM. In expression (5), γ1, γ2, δ, and ε are coefficients of which the values are determined in accordance with the engine rotation speed NE.

$$MC = \begin{cases} \frac{THAC}{THM} \times \{\gamma 1 \times (PM - \delta) + \varepsilon) & \text{where } PM \geq \delta \\ \frac{THAC}{THM} \times \{\gamma 2 \times (PM - \delta) + \varepsilon) & \text{where } PM < \delta \end{cases} \tag{5}$$

The air cleaner model M4 is a physical model for the behavior of intake air in the air cleaner 12. More specifically, the air cleaner model M4 includes, as variables, the atmospheric pressure PA, the throttle passing intake air amount MT, and the intake air temperature THA. From the relationship in expression (6), the air cleaner model M4 calculates and outputs the throttle upstream pressure PAC. In expression (6), k is a constant, and p represents an atmospheric density. The atmospheric density p is obtained as the function of the intake air temperature THA.

$$PAC = PA - k \times \frac{MT^2}{\rho} \tag{6}$$

Figure 8:
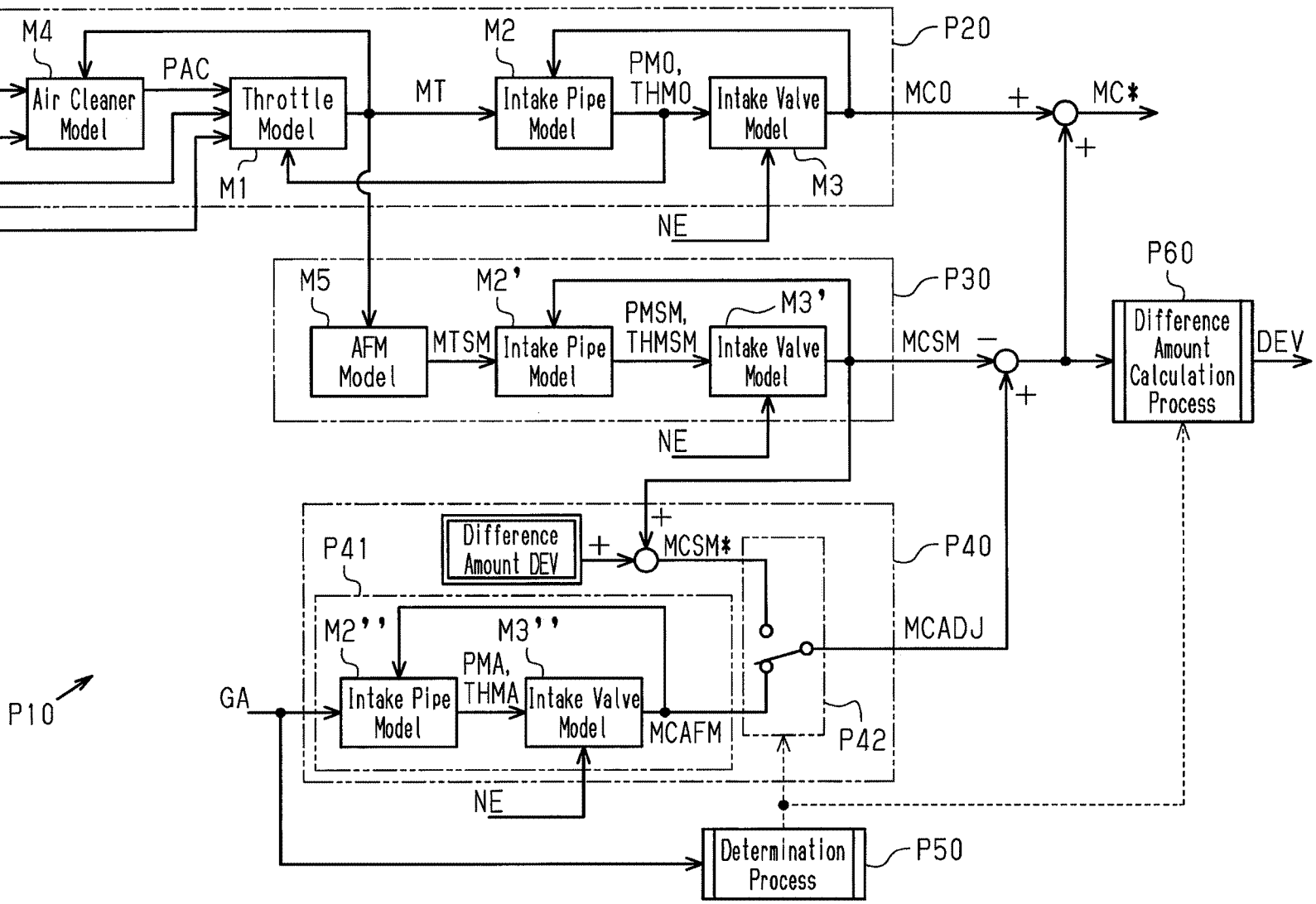
FIG. 8 is a block diagram illustrating the procedure of the intake air amount estimation process executed by an engine controller according to a third embodiment of the present disclosure.

FIG. 8 shows the procedure of an intake air amount estimation process P10 executed by the electronic control unit 25 for estimating the intake air amount in the engine controller of the present embodiment. The electronic control unit 25 determines the fuel injection amount QINJ of the injector 20 of each cylinder such that the air-flow ratio of air-fuel mixture burned in the combustion chamber 19 becomes a target value based on the estimation result of the intake air amount produced through the intake air amount estimation process P10.

Each sub-model configuring the air model may have an error resulting from, for example, approximation, individual differences in the engine 10, and changes in the engine 10 over time. In the intake air amount estimation process P10, the value obtained by modifying this error for the estimation result of an intake air amount using the air model based on the AFM detection intake air amount GA is calculated as an estimated intake air amount MC*, which is an estimated value of the intake air amount. In the intake air amount estimation process P10, when the estimated intake air amount MC* is calculated, a TA system intake air amount calculation process P20, a TASM system intake air amount calculation process P30, and a modification intake air amount estimation process P40 are performed.

In the TA system intake air amount calculation process P20, the intake air amount is calculated using the above-described air model in preset control cycles. In the TA system intake air amount calculation process P20, the throttle upstream pressure PAC is obtained by inputting, to the air cleaner model M4, the atmospheric pressure PA, the intake air temperature THA, and the output of the throttle passing intake air amount MT of the throttle model M1 in the last control cycle. Further, the throttle passing intake air amount MT is obtained by inputting, to the throttle model M1, the intake air temperature THA, the throttle opening degree TA, and the output of the throttle upstream pressure PAC of the air cleaner model M4 in the current control cycle. In addition, an intake pipe pressure PMO and an intake manifold temperature THMO are obtained by inputting, to the intake pipe model M2, the output of the throttle passing intake air amount MT of the throttle model M1 in the current control cycle and the output of the intake manifold outflow intake air amount (TA system intake air amount MC0) of the intake valve model M3 in the last control cycle. Then, in the TA system intake air amount calculation process P20, the intake manifold outflow intake air amount that is output by the intake valve model M3 is output as the value of the TA system intake air amount MC0 by inputting, to the intake valve model M3, the engine rotation speed NE and the output of the intake pipe pressure PMO and the intake manifold temperature THM of the intake pipe model M2 in the current calculation cycle.

A response delay occurs in a change in the output of the air flowmeter 13 caused by a change in the throttle passing intake air amount MT. In the TASM system intake air amount calculation process P30, the value delayed by an amount corresponding to the response delay of the air flowmeter 13 from the TA system intake air amount MC0 is calculated as the AFM synchronous intake air amount MCSM in each control cycle.

In the TASM system intake air amount calculation process P30, the AFM synchronous intake air amount MCSM is calculated using an AFM model M5, an intake pipe model M2', and an intake valve model M3'. The intake pipe model M2' and the intake valve model M3' respectively have the same contents as the intake pipe model M2 and the intake valve model M3. In the AFM model M5, the value delayed by an amount corresponding to the response delay of the air flowmeter 13 from the throttle passing intake air amount MT is calculated and output as the value of an AFM synchronous throttle passing intake air amount MTSM.

In the TASM system intake air amount calculation process P30, the AFM synchronous intake air amount MCSM is calculated as follows. First, the AFM synchronous throttle passing intake air amount MTSM is calculated by inputting, to the AFM model M5, the output of the throttle passing intake air amount MT in the current control cycle performed by the throttle model M1 of the TA system intake air amount calculation process P20. Subsequently, an AFM synchronous intake pipe pressure PMSM and an AFM synchronous intake manifold temperature THMSM are calculated by inputting, to the intake pipe model M2', the AFM synchronous throttle passing intake air amount MTSM and the output of the intake manifold outflow intake air amount (AFM synchronous intake air amount MCSM) of the intake manifold outflow intake air amount of the intake valve model M3' in the last control cycle. Then, the TASM system intake air amount calculation process P30 outputs, as the value of the AFM synchronous intake air amount MCSM, the intake manifold outflow intake air amount that is output from the intake valve model M3' by inputting, to the intake valve model M3', the AFM synchronous intake pipe pressure PMSM, the AFM synchronous intake manifold temperature THMSM, and the engine rotation speed NE.

In the TA system intake air amount calculation process P20 and the TASM system intake air amount calculation process P30, the intake air amount (TA system intake air amount MC0 and AFM synchronous intake air amount MCSM) is calculated based on the throttle opening degree TA instead of the AFM detection intake air amount GA. That is, in the TA system intake air amount calculation process P20 and the TASM system intake air amount calculation process P30, the intake air amount is calculated with the throttle speed mode.

In the modification intake air amount estimation process P40, a modification intake air amount MCADJ used to modify errors in the air model and the sub-models (hereinafter referred to as model errors) are calculated in each control cycle. In the modification intake air amount estimation process P40, when the modification intake air amount MCADJ is calculated, an AFM system intake air amount calculation process P41 and a calculation mode switching process P42 are executed. Further, in the modification intake air amount estimation process P40, when the modification intake air amount MCADJ is calculated, the determination result of a determination process P50 and the calculation result of the difference amount DEV obtained through a difference amount calculation process P60 are used. The determination process P50 has the same content as the determination process P6.

In the AFM system intake air amount calculation process P41, an intake pipe model M2" and an intake valve model M3" are used to calculate an AFM system intake air amount MCAFM based on the AFM detection intake air amount GA. The intake pipe model M2" and the intake valve model M3" respectively have the same contents as the intake pipe model M2 and the intake valve model M3.

In the AFM system intake air amount calculation process P41, the AFM system intake air amount MCAFM is calculated as follows. First, an intake pipe pressure PMA and an intake manifold temperature THMA are calculated by inputting, to the intake pipe model M2", the AFM detection intake air amount GA and the output of the intake manifold outflow intake air amount of the intake valve model M3" (AFM system intake air amount MCAFM) in the last control cycle. That is, the intake pipe pressure PMA and the intake manifold temperature THMA are calculated by regarding the AFM detection intake air amount GA as being equal to the throttle passing intake air amount MT. Then, the engine rotation speed NE and the output of the intake pipe pressure PMA and the intake manifold temperature THMA of the intake pipe model M2" in the current control cycle are input to the intake valve model M3", and the intake manifold outflow intake air amount that is output by the intake valve model M3" is output as the value of the AFM system intake air amount MCAFM in accordance with the input. In the AFM system intake air amount calculation process P41, the intake air amount (AFM system intake air amount MCAFM) is calculated based on the detected value (GA) of the intake air flow rate of the air flowmeter 13. That is, in the AFM system intake air amount calculation process P41, the intake air amount is calculated with the mass flow mode.

Additionally, in the modification intake air amount estimation process P40, the sum of the AFM synchronous intake air amount MCSM calculated in the TASM system intake air amount calculation process P30 and the difference amount DEV calculated in the difference amount calculation process P60 is calculated as a corrected AFM synchronous intake air amount MCSM*. As described below, the difference amount DEV represents the difference amount of the AFM synchronous intake air amount MCSM from the AFM system intake air amount MCAFM when the small pulsation determination is made.

In the calculation mode switching process P42, when the small pulsation determination is made, the AFM system intake air amount MCAFM is set as the value of the modification intake air amount MCADJ. In the calculation mode switching process P42, when the large pulsation determination is made, the corrected AFM synchronous intake air amount MCSM* is set as the value of the modification intake air amount MCADJ.

As described above, in the modification intake air amount estimation process P40, when the small pulsation determination is made, the AFM system intake air amount MCAFM is calculated as the value of the modification intake air amount MCADJ. Further, in the modification intake air amount estimation process P40, when the large pulsation determination is made, the corrected AFM synchronous intake air amount MCSM*, which is the sum of the AFM synchronous intake air amount MCSM and the difference amount DEV, is calculated as the value of the modification intake air amount MCADJ. As described above, the AFM system intake air amount MCAFM is calculated with the mass flow mode, and the AFM synchronous intake air amount MCSM is calculated with the throttle speed mode. Thus, in the modification intake air amount estimation process P40, the calculation mode of the modification intake air amount MCADJ is switched in accordance with the magnitude of the intake pulsation such that the mass flow mode is selected when the small pulsation determination is made and the throttle speed mode is selected when the large pulsation determination is made.

In the intake air amount estimation process P10, the estimated intake air amount MC* is calculated from the TA system intake air amount MC0, the AFM synchronous intake air amount MCSM, and the modification intake air amount MCADJ, which have been described above. That is, in the intake air amount estimation process, the value obtained by subtracting the AFM synchronous intake air amount MCSM from the modification intake air amount MCADJ (i.e., MCADJ−MCSM) is first calculated as the value of the model modified amount ΔMC. Then, the sum of the TA system intake air amount MC0 and the model modified amount ΔMC (i.e., MC0+ΔMC) is calculated as the value of the estimated intake air amount MC*.

In the difference amount calculation process, the difference amount DEV of the AFM synchronous intake air amount MCSM from the AFM synchronous intake air amount MCSM during the small pulsation determination is calculated. More specifically, in the difference amount calculation process P60, when the small pulsation determination is made, the value of the difference amount DEV is updated such that the value gradually approaches the value of the model modified amount ΔMC (ΔMC=MCADJ−MCSM). When the large pulsation determination is made, the value of the difference amount DEV is kept without updating the value of the difference amount DEV in the difference amount calculation process P60.

In the AFM system intake air amount calculation process P41, the AFM system intake air amount MCAFM is calculated by inputting, to the intake pipe model M2", the AFM detection intake air amount GA, which is the detected value of the intake air amount of the air flowmeter 13. In the TASM system intake air amount calculation process P30, the AFM synchronous intake air amount MCSM is calculated by inputting, to the intake pipe model M2', the AFM synchronous throttle passing intake air amount MTSM. The AFM synchronous throttle passing intake air amount MTSM is calculated through the throttle model M1, the intake pipe model M2, the intake valve model M3, the air cleaner model M4, and the AFM model M5. The error of each model is superimposed on the value of the AFM synchronous throttle passing intake air amount MTSM. Thus, the AFM system intake air amount MCAFM in a state in which the detection accuracy of the air flowmeter 13 is not decreased when the small pulsation determination is made has a value with a higher calculation accuracy than the AFM synchronous intake air amount MCSM. Assuming that the AFM system intake air amount MCAFM is a correct value when the small pulsation determination is made, the difference amount DEV of the AFM synchronous intake air amount MCSM from the AFM system intake air amount MCAFM is a value corresponding to the calculation error of the AFM synchronous intake air amount MCSM.

In the present embodiment, when the small pulsation determination is made, the AFM synchronous intake air amount MCSM is calculated as the value of the modification intake air amount MCADJ, and the difference amount DEV of the AFM synchronous intake air amount MCSM from the AFM system intake air amount MCAFM is calculated. When the large pulsation determination is made, the corrected AFM synchronous intake air amount MCSM*, which is the sum of the difference amount DEV calculated during the small pulsation determination and the AFM synchronous intake air amount MCSM, is calculated as the value of the modification intake air amount MCADJ. In this calculation, the corrected AFM synchronous intake air amount MCSM* is the value obtained by compensating the AFM synchronous intake air amount MCSM by an amount corresponding to the error checked when the small pulsation determination is made. This allows for accurate calculation of the modification intake air amount MCADJ when the intake pulsation is large. In addition, the occurrence of a step in the value of the modification intake air amount MCADJ is limited prior to and subsequent to switching the calculation mode.

The fuel injection amount QINJ is determined directly based on the estimated intake air amount MC*. When the estimated intake air amount MC* is calculated, the modification intake air amount MCADJ is used. The modification intake air amount MCADJ also serves as the calculated value of the intake air amount used to determine the fuel injection amount QINJ. In the present embodiment, the AFM system intake air amount calculation process P41 corresponds to a first intake air amount calculation process for calculating the intake air amount based on the detected value (GA) of the intake air flow rate of the air flowmeter 13. Further, in the present embodiment, the TASM system intake air amount calculation process P30 corresponds to a second intake air amount calculation process for calculating the intake air amount based on the throttle opening degree TA instead of the detected value (GA) of the intake air flow rate. Additionally, in the present embodiment, the AFM system intake air amount MCAFM corresponds to a first intake air amount, the AFM synchronous intake air amount MCSM corresponds to a second intake air amount, and the corrected AFM synchronous intake air amount MCSM* corresponds to a corrected second intake air amount, respectively.

Modification of Third Embodiment

In the engine controller of the third embodiment, when the small pulsation determination is made, the AFM system intake air amount MCAFM is set as the value of the modification intake air amount MCADJ, and the difference amount DEV of the AFM synchronous intake air amount MCSM from the AFM system intake air amount MCAFM is calculated. When the large pulsation determination is made, the sum of the difference amount DEV and the AFM synchronous intake air amount MCSM is calculated as the value of the modification intake air amount MCADJ. In such a case, as long as a proper value is calculated as the value of the difference amount DEV, when switching from the small pulsation determination to the large pulsation determination, almost no step occurs in the value of the modification intake air amount MCADJ prior to and subsequent to the switching.

In the AFM system intake air amount calculation process P41, the intake pipe model M2" is used to calculate the intake pipe pressure PMA, and the calculated intake pipe pressure PMA is used to calculate the AFM system intake air amount MCAFM. In the intake pipe model M2", the intake pipe pressure PMA is calculated by obtaining the change amount of the intake pipe pressure per unit of time based on, for example, the AFM detection intake air amount GA and then updating the value by an amount corresponding to the obtained change amount. This produces an error in the value of the AFM system intake air amount MCAFM during the large pulsation determination. Further, the error remains after the large pulsation determination is switched to the small pulsation determination. This may decrease the calculation accuracy of the modification intake air amount MCADJ after switching from the large pulsation determination to the small pulsation determination.

Figure 9:
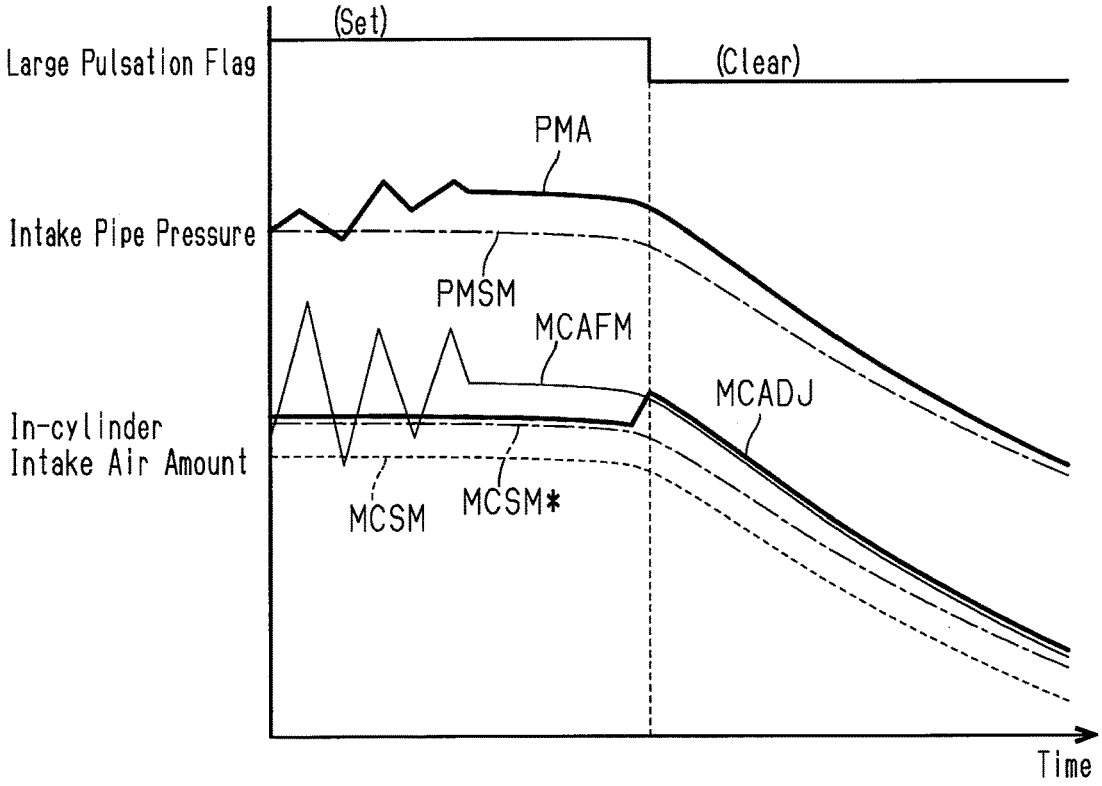
FIG. 9 is a time chart illustrating the calculation status of each intake air amount when switching from a large pulsation determination to a small pulsation determination in the engine controller of FIG. 8.

FIG. 9 shows examples of how changes occur in the values of the large pulsation flag, the AFM synchronous intake pipe pressure PMSM, the intake pipe pressure PMA, the AFM synchronous intake air amount MCSM, the AFM system intake air amount MCAFM, and the modification intake air amount MCADJ in the engine controller of the third embodiment when the determination result of the determination process P50 is switched from the large pulsation determination to the small pulsation determination.

In the AFM system intake air amount calculation process P41, the calculation of the AFM system intake air amount MCAFM is continued even when the large pulsation determination is made. In the intake pipe model M2", the change amount of the intake pipe pressure per unit of time is calculated based on the AFM detection intake air amount GA, which is the detected value of the air flowmeter 13 of which the detection accuracy with intake pulsation decreases. Thus, the calculated change amount per unit of time may become incorrect, thereby resulting in an error in the intake pipe pressure PMA calculated in the intake pipe model M2".

After the intake pulsation decreases and the detection accuracy of the air flowmeter 13 recovers, the change amount of the intake pipe pressure can be calculated properly. However, there remains the error that has occurred in the intake pipe pressure PMA. In addition, an error occurs in the value of the AFM system intake air amount MCAFM calculated based on the intake pipe pressure PMA in which the error has occurred. When the determination result is switched from the large pulsation determination to the small pulsation determination, the value of the AFM system intake air amount MCAFM in which the error has occurred is set as the value of the modification intake air amount MCADJ. Thus, the calculation accuracy of the modification intake air amount MCADJ may decrease after switching from the large pulsation determination to the small pulsation determination. The decrease in the calculation accuracy of the modification intake air amount MCADJ can be avoided by changing the processing content of the AFM system intake air amount calculation process P41 as follows.

As described above, in the TASM system intake air amount calculation process P30, the AFM synchronous intake air amount MCSM is calculated using the AFM synchronous intake pipe pressure PMSM calculated with the intake pipe model M2'. The AFM synchronous intake pipe pressure PMSM is calculated without using the AFM detection intake air amount GA. Thus, even when the detection accuracy of the air flowmeter 13 decreases during the large pulsation determination, the calculation of the AFM synchronous intake pipe pressure PMSM is relatively correct. Accordingly, when the determination result is switched from the large pulsation determination to the small pulsation determination, the value of the intake pipe pressure PMA of the intake pipe model M2" used in the AFM system intake air amount calculation process P41 is replaced with the value of the AFM synchronous intake pipe pressure PMSM.

Figure 10:
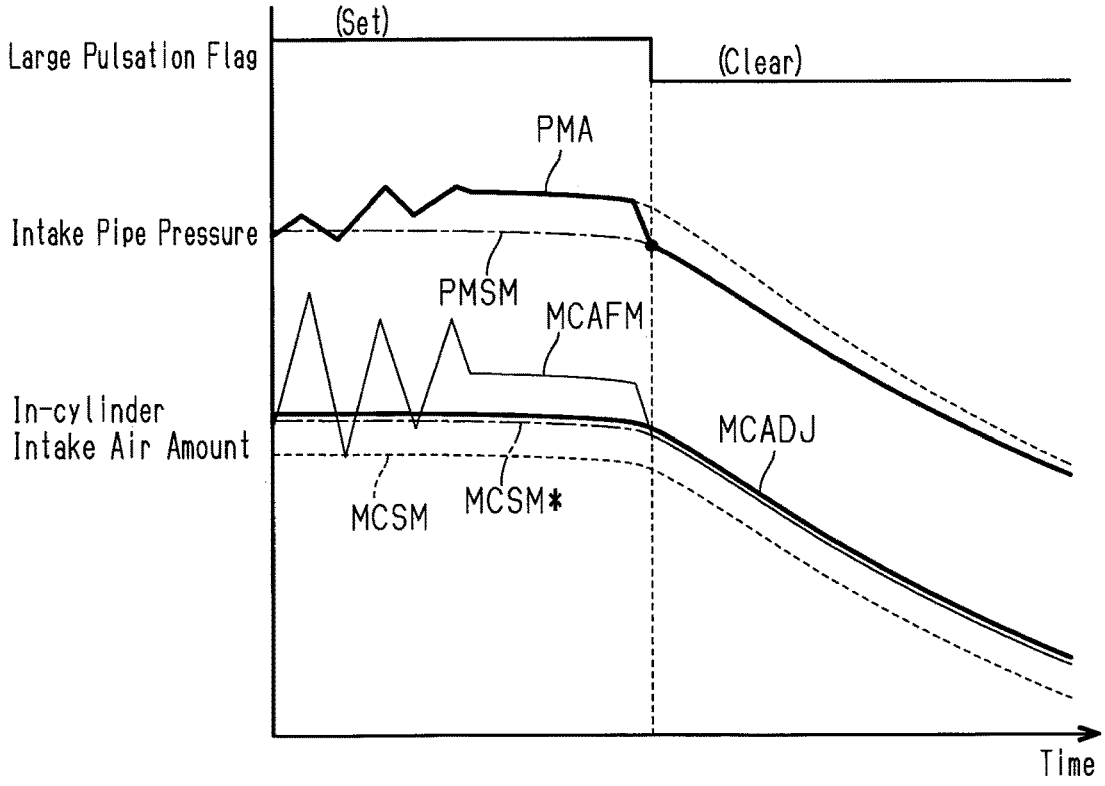
FIG. 10 is a time chart illustrating the calculation status of each intake air amount when switching from the large pulsation determination to the small pulsation determination in a modification of the engine controller of FIG. 8.

As shown in FIG. 10, in such a case, even if an error occurs in the value of the intake pipe pressure PMA when the large pulsation determination is made, the value of the intake pipe pressure PMA is replaced with a proper value at the same time as the small pulsation determination is made. Further, the error in the AFM system intake air amount MCAFM occurring during the large pulsation determination is corrected at the same time as the value of the intake pipe pressure PMA is replaced. Thus, even after switching from the large pulsation determination to the small pulsation determination, the modification intake air amount MCADJ can be calculated accurately. In a case in which the intake pipe pressure sensor 31 is arranged in the intake passage 11 of the engine 10, the value of the intake pipe pressure PMA may be replaced with the intake pipe pressure PM detected by the intake pipe pressure sensor 31 when the large pulsation determination is switched to the small pulsation determination.

Fourth Embodiment

The engine controller of the third embodiment calculates the difference amount DEV of the AFM synchronous intake air amount MCSM from the AFM system intake air amount MCAFM in the difference amount calculation process P60 when the small pulsation determination is made. The difference amount DEV of the AFM synchronous intake air amount MCSM from the AFM system intake air amount MCAFM changes due to individual differences such as the detection characteristics of the air flowmeter 13 and the opening degree characteristics of the throttle valve 14 and due to changes over time. The value of the difference amount DEV changes also depending on the running state of the engine 10. Thus, even if the difference amount DEV is a proper value at the point in time when the determination result is switched from the small pulsation determination to the large pulsation determination, when the running region of the engine 10 changes during continuation of the large pulsation determination, the difference amount DEV may be an improper value in the running region subsequent to the change. In the fourth embodiment, the difference amount DEV is learned for each of difference amount learning regions that are divided from one another in accordance with the running state of the engine 10. The engine controller according to the fourth embodiment will now be described with reference to FIGS. 11 to 13.

Figure 11:
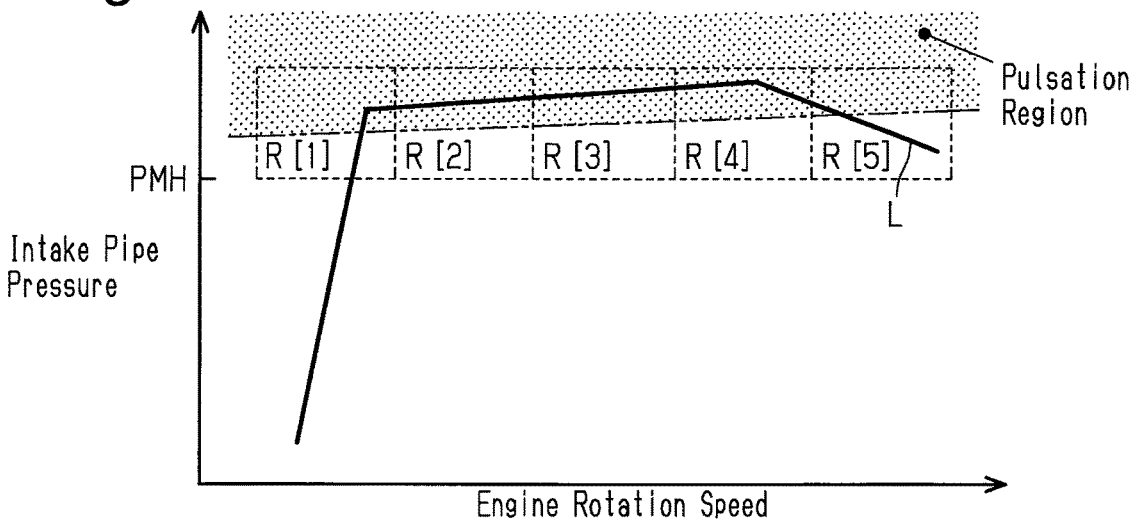
FIG. 11 is a graph illustrating the setting mode of a difference amount learning region in an engine controller according to a fourth embodiment of the present disclosure.

FIG. 11 shows the setting of the difference amount learning regions in the present embodiment. In FIG. 11, line L represents the maximum value of the intake pipe pressure per engine rotation speed in the running region of the engine 10. Further, the pulsation region shown with hatching in FIG. 11 represents the running region of the engine 10 where a large intake pulsation occurs enough to decrease the detection accuracy of the air flowmeter 13. As shown in FIG. 11, the pulsation region is limited to the running region where the intake pipe pressure is high. Thus, in the present embodiment, the running region where the intake pipe pressure is greater than or equal to a preset value PMH is divided in accordance with the engine rotation speed NE to set multiple (five in the example of FIG. 11) difference amount learning regions.

In the following description, the five difference amount learning regions are referred to as, sequentially from ones with a small engine rotation speed NE, a difference amount learning region R[1], a difference amount learning region R[2], a difference amount learning region R[3], a difference amount learning region R[4], and a difference amount learning region R[5]. Further, the learning value of the difference amount DEV in a difference amount learning region R[i] where i is any one of 1, 2, 3, 4, and 5 is referred to as a difference amount learning value DEV[i].

Figure 12:
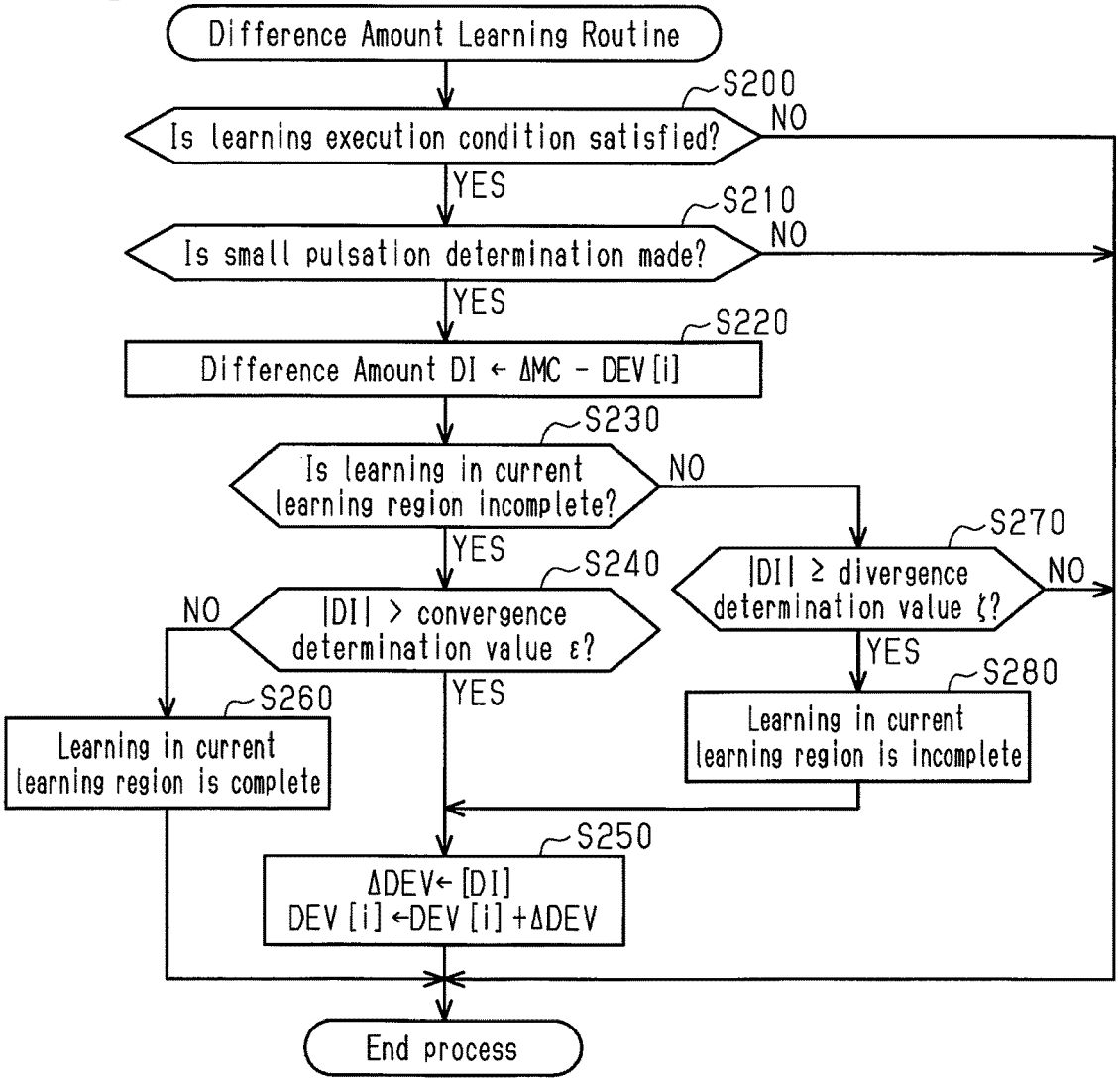
FIG. 12 is a flowchart illustrating a difference amount learning routine executed by the engine controller of FIG. 11.

FIG. 12 shows the flowchart of a difference amount learning routine executed by the electronic control unit 25 in order to learn the difference amount. The electronic control unit 25 executes the processes of this routine in preset control cycles while the engine 10 is running.

When the processes of this routine are started, it is first determined in step S200 whether a learning execution condition has been satisfied. When the learning execution condition has not been satisfied (S200: NO), the current routine is ended. The learning execution condition is met by satisfying all of the following conditions: (a) the engine 10 is running in any one of the difference amount learning regions R[1] to R[5]; (b) the engine 10 is not in a transient state in which the running condition of the engine 10 changes; (c) warm-up of the engine 10 has been completed; and (d) the systems of sensors and actuators have no abnormalities.

When the learning execution condition has been satisfied (S200: YES), the process is advanced to step S210. In step S210, it is determined whether the small pulsation determination is being made. When the small pulsation determination is being made (S210: YES), the process is advanced to step S220. When the small pulsation determination is not being made (S210: NO), that is, when the large pulsation determination is being made, the processes of the current routine are ended.

When the process is advanced to step S220, in step S220, the difference obtained by subtracting the difference amount learning value DEV[i] in the difference amount learning region in which the engine 10 is currently running (hereinafter referred to as current learning region) from the model modified amount ΔMC (i.e., ΔMC−DEV[i]) is calculated as the value of a deviation amount D1. The value of the model modified amount ΔMC during the small pulsation determination is the difference obtained by subtracting the AFM synchronous intake air amount MCSM from the AFM system intake air amount MCAFM (i.e., MCAFM−MCSM).

Subsequently, it is determined in step S230 whether the learning of the difference amount learning value DEV[i] in the current learning region is incomplete. When the learning of the difference amount learning value DEV[i] in the current learning region is incomplete (S230: YES), the process is advanced to step S240. When the learning is complete (S230: NO), the process is advanced to step S270.

When the learning in the current learning region is incomplete and the process is advanced to step S240, it is determined in step S240 whether the absolute value of the deviation amount D1 is greater than a preset convergence determination value ε. When the absolute value of the deviation amount D1 is greater than the convergence determination value ε (S240: YES), the process is advanced to step S250. When the absolute value of the deviation amount D1 is less than or equal to the convergence determination value ε (S240: NO), the process is advanced to step S260. In step S260, completion of the learning of the current learning region is recorded, thereby ending the current routine.

Figure 13:
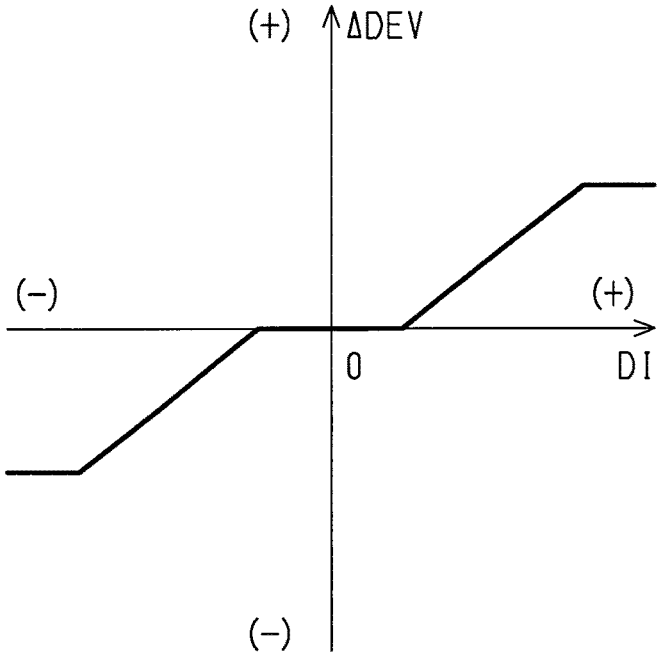
FIG. 13 is a graph illustrating the relationship between an update amount and a deviation amount of a difference amount learning value calculated in the difference amount learning routine of FIG. 12.

When the process is advanced to step S250, the value of the difference amount learning value DEV[i] in the current learning region is updated in accordance with the deviation amount D1. After this update, the current routine is ended. The value of the difference amount learning value DEV[i] is updated as follows. That is, the value of an update amount ΔDEV is first obtained from the deviation amount D1. As shown in FIG. 13, the positive and negative values of the update amount ΔDEV is equal to those of the deviation amount D1, and the deviation amount D1 has a smaller absolute value than the update amount ΔDEV. In addition, the value of the update amount ΔDEV is set such that the value of the update amount ΔDEV has a larger value when the deviation amount D1 has a large absolute value than when the deviation amount D1 has a small absolute value. The value of the difference amount learning value DEV[i] in the current learning region is updated such that the sum of the update amount ΔDEV and the value of the difference amount learning value DEV[i] in the current learning region prior to being updated becomes the value of the difference amount learning value DEV[i] in the current learning region subsequent to being updated.

When the learning of the current learning region is complete (S230: NO), the process is advanced to step S270. In step S270, it is determined whether the absolute value of the deviation amount D1 is greater than or equal to a preset discrepancy determination value ζ. The discrepancy determination value ζ is set to be larger than the convergence determination value ε. When the absolute value of the deviation amount D1 is less than the discrepancy determination value ζ (S270: NO), the processes of the current routine are ended. When the absolute value of the deviation amount D1 is greater than or equal to the discrepancy determination value ζ (S270: YES), the process is advanced to step S280. In step S280, the learning status of the current learning region is returned from the complete status to the incomplete status. Then, the value of the difference amount learning value DEV[i] is updated in step S250.

In the difference amount calculation process P7 of the first embodiment and the second embodiment, the learning of the difference amount may be performed in the same manner. In this case, in step S220 of the difference amount learning routine, the value obtained by subtracting the difference between the first intake air amount MC1 and the second intake air amount MC2 and MC2* from the difference amount learning value DEV[i] in the current learning region is calculated as the value of the deviation amount D1.

Fifth Embodiment

In the fourth embodiment, each difference amount learning region is set to the running region where the intake pipe pressure is large and the pulsation region is included (high-load running region). However, when the engine 10 does not run so often in the high-load running region, completion of the learning of the difference amount requires a long period of time. Thus, in the engine controller according to the fifth embodiment, the content of the difference amount learning routine is changed so that the learning of the difference amount can be completed more quickly even when the engine 10 does not run so often in the high-load running region. The engine controller according to the fifth embodiment will now be described also with reference to FIGS. 14 and 15.

Figure 14:
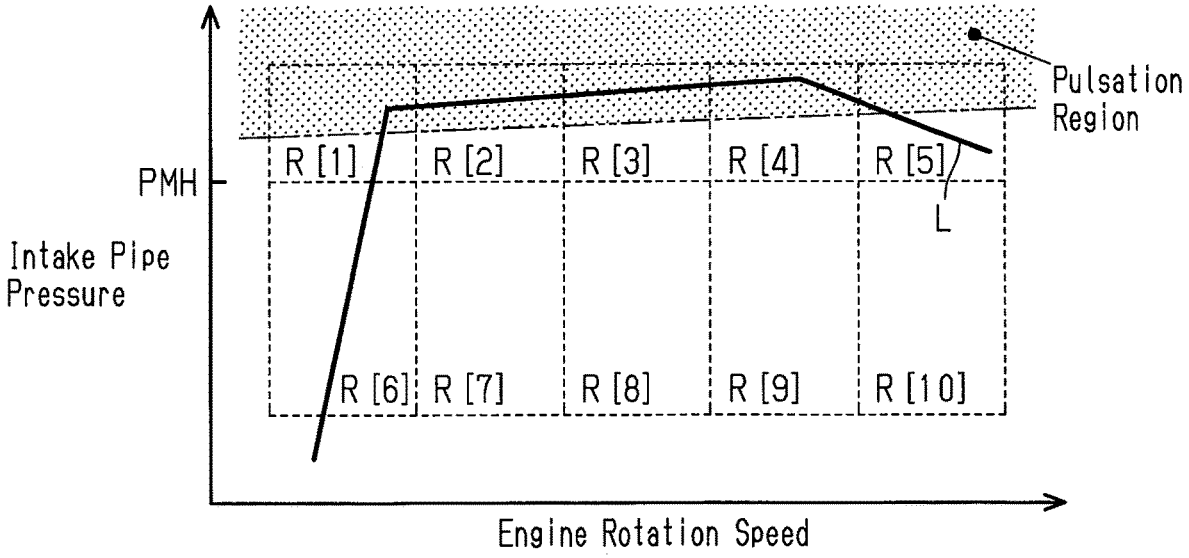
FIG. 14 is a graph illustrating the setting mode of a difference amount learning region in an engine controller according to a fifth embodiment of the present disclosure.

FIG. 14 shows the mode of dividing the difference amount learning region in the present embodiment. In FIG. 14, line L represents the maximum value of the intake pipe pressure per engine rotation speed. As shown in FIG. 14, in the present embodiment, difference amount learning regions R[6] to R[10] are set to the running region where the intake pipe pressure is less than the preset value PMH in addition to the five difference amount learning regions R[1] to R[5], which are set to the high-load running region in the third embodiment.

Figure 15:
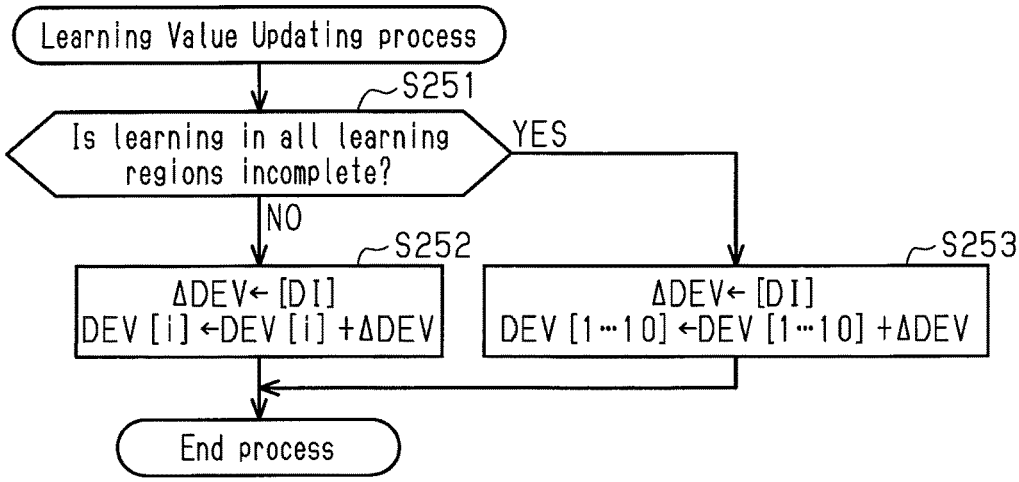
FIG. 15 is a flowchart illustrating a learning value updating routine executed by the engine controller of FIG. 14.

FIG. 15 shows the flowchart of a learning value updating routine executed by the electronic control unit 25 in the engine controller of the present embodiment. In the present embodiment, the processes of this routine are executed instead of the process of step S250.

When the processes of this routine are started, it is first determined in step S251 whether the learning of the difference amount learning value DEV[i] is incomplete in all of the ten difference amount learning regions R[1] to R[10]. When the learning is complete in even one of the difference amount learning regions (S251: NO), the process is advanced to step S252. In step S252, the difference amount learning value DEV[i] in the current learning region is updated, thereby ending the processes of the current routine. Updating the value of the difference amount learning value DEV[i] in step S252 of this routine is performed in the same manner as step S250 of the third embodiment.

When the learning is incomplete in all of the difference amount learning regions (S251: YES), the process is advanced to step S253. In step S253, the difference amount learning values DEV[1] to DEV[10] in all of the difference amount learning regions R[1] to R[10] are collectively updated, thereby ending the current routine. That is, in step S253, after the update amount ΔDEV is obtained from the deviation amount D1, the difference amount learning values DEV[1] to DEV[10] in all of the difference amount learning regions R[1] to R[10] are collectively updated such that the sum of the obtained update amount ΔDEV and the value prior to being updated becomes the value subsequent to being updated.

Among the difference amounts DEV, the difference resulting from the individual difference of the detection characteristics of the air flowmeter 13 and the opening degree characteristics of the throttle valve 14 often appears with a tendency common to the entire running region of the engine 10. In the engine controller of the present embodiment, the difference amount learning values DEV[1] to DEV[10] in all of the difference amount learning regions R[1] to R[10] are collectively updated until the learning of the difference amount DEV in any one of the difference amount learning regions R[1] to R[10] is completed. Thus, the difference that appears with the tendency common to the entire running region of the engine 10 is learned collectively without dividing the difference amount learning region R[i] by the time the learning of the difference amount DEV is completed in any one of the difference amount learning regions R[1] to R[10]. Subsequently, the difference between the difference amounts DEV in the difference amount learning regions R[i] is learned separately for each difference amount learning region R[i]. This shortens the period required to learn the difference amounts DEV in the difference amount learning regions R[1] to R[10].

Sixth Embodiment

The difference amounts of the intake air amount calculated values between the calculation modes vary depending on the states of the body of each type of the engine 10 that result from the individual difference and changes over time. Part of the above-described difference occurs necessarily because the calculation modes are different. Such part appears universally regardless of the state of the body of each type of the engine 10. In this manner, the difference of the intake air amount calculated values between the calculation modes include a portion dependent on the state of the body of each type of the engine 10 (hereinafter referred to as body-dependent portion) and a portion independent from the state (hereinafter referred to as body-independent portion). The body-independent portion can be checked in advance through, for example, measurement. That is, in multiple engines 10, the difference between the calculated values of the intake air amounts of the calculation modes is measured for each running region, and the amount of the body-independent portion in each running region is obtained by averaging the measured values in the running regions of the engines.

In the sixth embodiment, mapping of the amount of the body-independent portion of the difference in each running region (hereinafter referred to as shift correction map) is stored in the memory 27 of the electronic control unit 25 in advance. The shift correction map stores the relationship between the engine rotation speed NE and the engine load with the amount of the body-independent portion of the difference. The intake pipe pressure, the throttle opening degree TA, a load ratio, and the like can be used as an index value of the engine load. The load ratio refers to a value that represents the ratio of the intake air amount to a maximum intake air amount. The maximum intake air amount refers to the intake air amount when the engine 10 is normally running in a state in which the throttle opening degree TA is the maximum with the current engine rotation speed NE. In the present embodiment, an example in which the intake pipe pressure is used as the index value of the engine load to configure the shift correction map will be described. The engine controller according to the sixth embodiment will now be described with reference to FIGS. 16 to 19.

Figure 16:
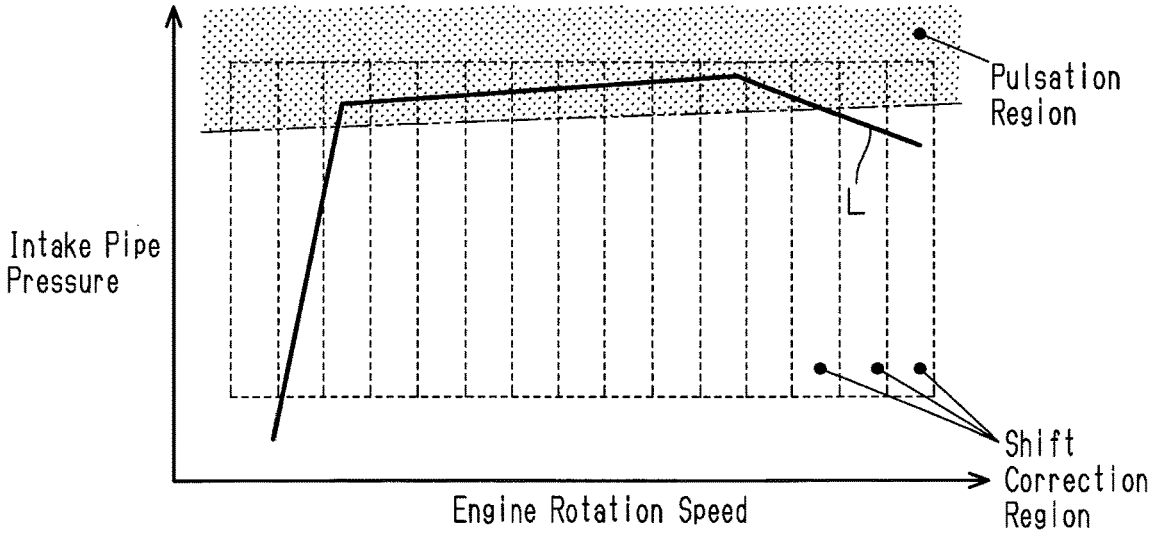
FIG. 16 is a graph illustrating the setting mode of shift correction regions in an engine controller according to a sixth embodiment of the present disclosure.
Figure 17:
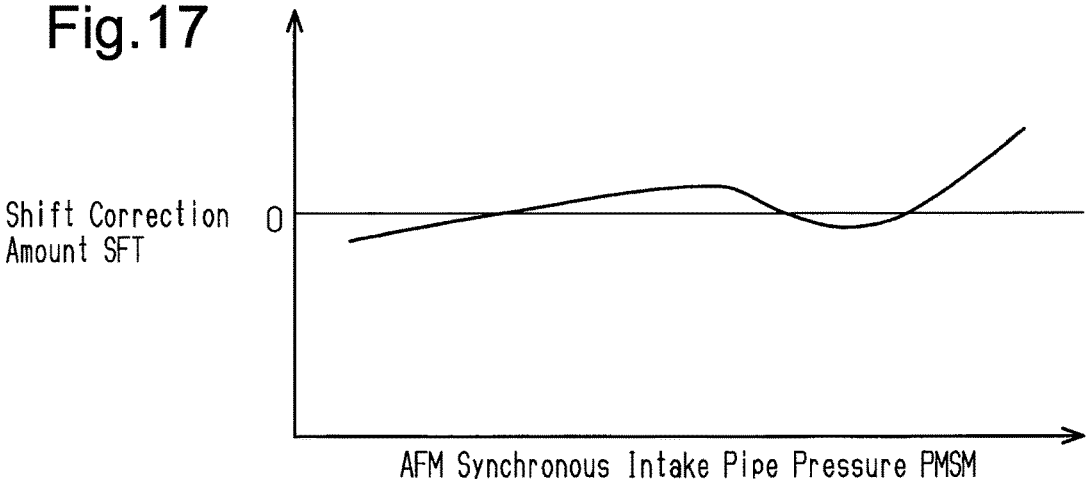
FIG. 17 is a graph illustrating the relationship between an intake pipe pressure and a shift correction amount in one of the shift correction regions.

As shown in FIG. 16, the shift correction maps are prepared separately for multiple (fifteen in the example of FIG. 16) shift correction regions that are divided in accordance with the engine rotation speed NE. As shown in FIG. 17, the shift correction map of each shift correction region stores, as the relationship between a shift correction amount SFT and the AFM synchronous intake pipe pressure PMSM, the relationship between the intake pipe pressure and the amount of the body-independent portion in the shift correction region obtained in advance through measurement or the like. In the present embodiment, the shift correction amount SFT is applied to the calculation of the update amount ΔDEV of the difference amount learning value DEV[i] and the calculation of the corrected AFM synchronous intake air amount MCSM*.

Figure 18:
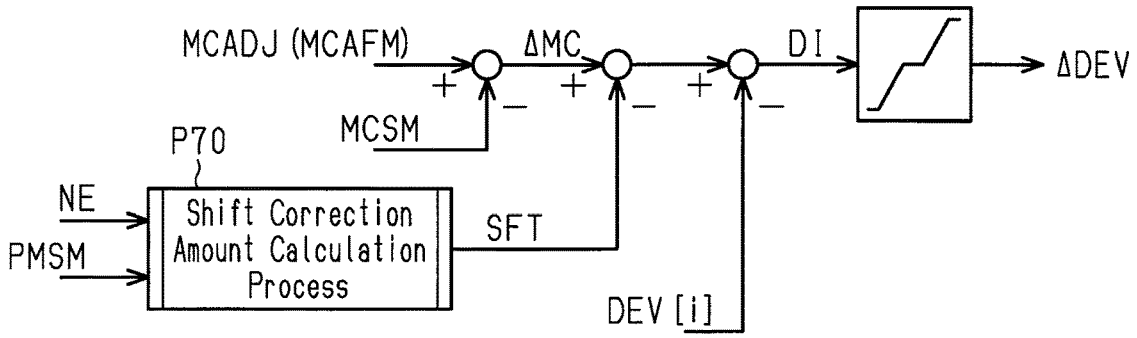
FIG. 18 is a block diagram illustrating a procedure of processes for calculating the update amount of the difference amount learning value in the engine controller of FIG. 16.

FIG. 18 shows a procedure of processes for calculating the update amount ΔDEV of the difference amount learning value DEV[i] in the present embodiment. The processes of FIG. 18 correspond to the processes of step S220 and step S250 of the difference amount learning routine (FIG. 12) in the engine controller according to the fourth embodiment.

First, when the update amount ΔDEV is calculated, the difference obtained by subtracting the AFM synchronous intake air amount MCSM from the modification intake air amount MCADJ is obtained as the value of the model modified amount ΔMC. The update amount ΔDEV is calculated when the small pulsation determination is made (refer to FIG. 12). In the modification intake air amount estimation process P40, the AFM system intake air amount MCAFM is set as the value of the modification intake air amount MCADJ.

In the fourth embodiment, the difference obtained by subtracting the difference amount learning value DEV[i] prior to being updated from the model modified amount ΔMC is obtained as the deviation amount D1, and the value of the update amount ΔDEV is calculated based on the obtained deviation amount D1. In the present embodiment, the difference obtained by subtracting the shift correction amount SFT from the model modified amount ΔMC and then subtracting the difference amount learning value DEV [i] prior to being updated (i.e., ΔMC−SFT−DEV[i]) is obtained as the value of the deviation amount D1. The shift correction amount SFT is calculated with a shift correction amount calculation process P70. In the shift correction amount calculation process P70, the shift correction map is used to calculate the value of the shift correction amount SFT based on the engine rotation speed NE and the AFM synchronous intake pipe pressure PMSM. In the same manner as the fourth embodiment, the value of the update amount ΔDEV is calculated from the deviation amount D1 so as to satisfy the relationship illustrated in FIG. 13.

Figure 19:
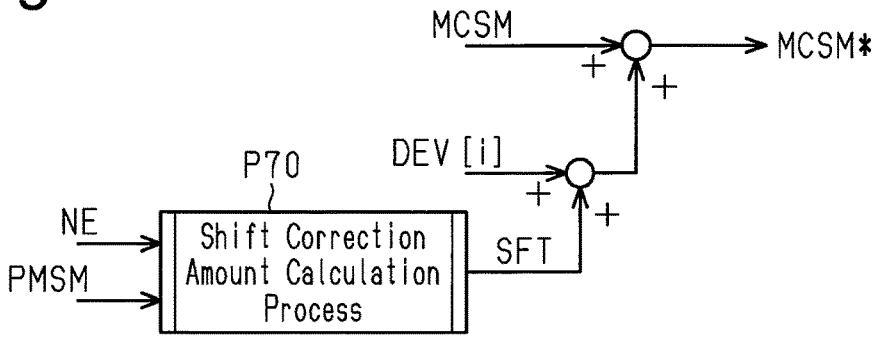
FIG. 19 is a block diagram illustrating a procedure of processes for calculating a corrected AFM synchronous intake air amount in the engine controller of FIG. 16.

FIG. 19 shows a procedure of processes for calculating the corrected AFM synchronous intake air amount MCSM* in the present embodiment. In the present embodiment, as shown in FIG. 19, the sum of three values, namely, the AFM synchronous intake air amount MCSM, the difference amount learning value DEV[i], and the shift correction amount SFT, is calculated as the corrected AFM synchronous intake air amount MCSM*. The shift correction amount SFT is calculated with the shift correction amount calculation process P70.

In the present embodiment, the difference amount learning value DEV[i] is learned in a state in which the body-independent portion of the difference between the AFM system intake air amount MCAFM and the AFM synchronous intake air amount MCSM is incorporated in advance through correction with the shift correction amount SFT. Thus, regarding the difference amount learning value DEV [i], only the body-dependent portion needs to be learned in the difference. Accordingly, in the present embodiment, the learning of the difference amount learning value DEV[i] can be completed quickly.

Seventh Embodiment

The difference amount DEV of the intake air amount calculated value between the calculation modes varies depending on environmental conditions such as the temperature and pressure of intake air. Thus, when learning is performed with different environmental conditions, variation occurs in the learning result. In the seventh embodiment, environmental correction is performed to limit a decrease in the learning accuracy that occurs due to environmental conditions. The environmental conditions refer to temperature conditions such as the intake air temperature THA, external temperature, engine coolant temperature, engine oil temperature, and temperature of the wall surface of the intake port 18 and refer to pressure conditions such as the atmospheric pressure PA, surge tank pressure, and boost pressure in a forced induction engine. In the present embodiment, an example in which environmental correction is performed in accordance with the intake air temperature THA will be described. The engine controller according to the seventh embodiment will now be described with also reference to FIGS. 20 to 22.

The engine controller of the present embodiment performs an environmental correction coefficient calculation process P80 (refer to FIGS. 21 and 22) for calculating an environmental correction coefficient ENV, which is used to perform environmental correction in accordance with the intake air temperature THA. In the environmental correction coefficient calculation process P80, the environmental correction coefficient ENV is calculated in accordance with the intake air temperature THA.

The value of the environmental correction coefficient ENV of each intake air temperature THA is determined in advance based on the following measurement result. That is, in the engines 10, in a state in which the conditions other than the intake air temperature THA are set to be constant, the difference between the AFM system intake air amount MCAFM and the AFM synchronous intake air amount MCSM is measured while changing the intake air temperature THA. From the average of the measured values of each intake air temperature THA of each engine 10, the value of the environmental correction coefficient ENV is determined.

Figure 20:
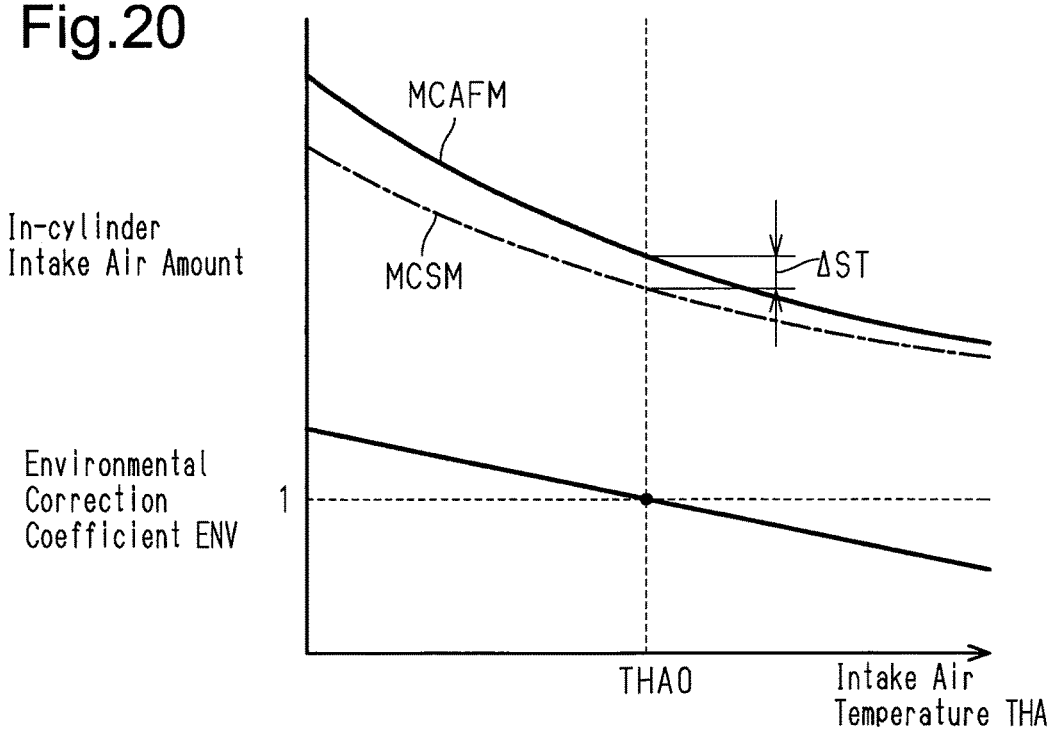
FIG. 20 is a graph illustrating the relationship between an AFM system intake air amount, an AFM synchronous intake air amount, an environmental correction coefficient, and an intake air temperature in an engine controller according to a seventh embodiment of the present disclosure.

FIG. 20 shows the relationship between the intake air temperature THA and the average value of the AFM system intake air amount MCAFM and the AFM synchronous intake air amount MCSM of each engine 10 in the above-described measurement. The difference amount of each average value of the AFM system intake air amount MCAFM and the AFM synchronous intake air amount MCSM when the intake air temperature THA is a preset reference temperature THAO is referred to as a reference difference amount ΔST. The quotient of the difference amount of each average value of the AFM system intake air amount MCAFM and the AFM synchronous intake air amount MCSM in each intake air temperature THA divided by the reference difference amount ΔST is set as the value of the environmental correction coefficient ENV of each intake air temperature THA.

Figure 21:
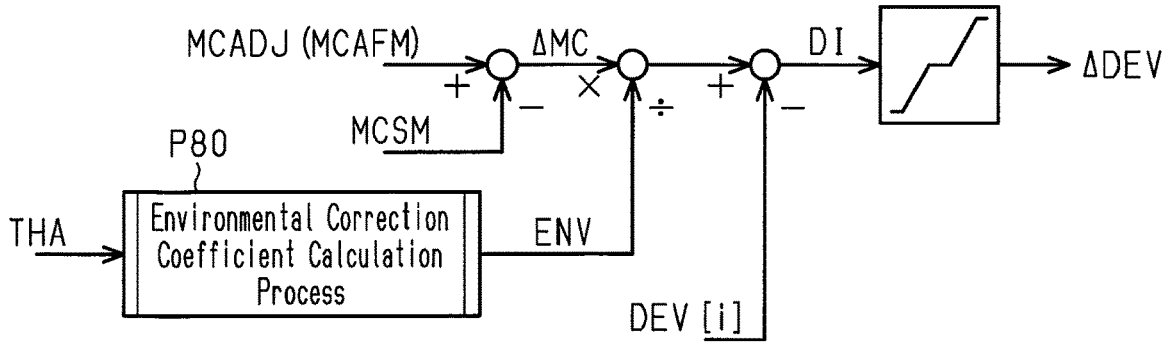
FIG. 21 is a block diagram illustrating a procedure of processes for calculating the update amount of the difference amount learning value in the engine controller of FIG. 20.

FIG. 21 shows a procedure of the processes for calculating the update amount ΔDEV of the difference amount learning value DEV[i] in the present embodiment. The processes of FIG. 21 correspond to the processes of step S220 and step S250 of the difference amount learning routine (FIG. 12) in the engine controller according to the fourth embodiment.

First, when the update amount ΔDEV is calculated, the difference obtained by subtracting the AFM synchronous intake air amount MCSM from the modification intake air amount MCADJ is obtained as the value of the model modified amount ΔMC. The update amount ΔDEV is calculated when the small pulsation determination is made (refer to FIG. 12). In the modification intake air amount estimation process P40, the AFM system intake air amount MCAFM is set as the value of the modification intake air amount MCADJ.

In the present embodiment, the difference obtained by subtracting the value of the difference amount learning value DEV[i] prior to being updated from the quotient of the model modified amount ΔMC divided by the environmental correction coefficient ENV (i.e., ΔMC/ENV−DEV[i]) is obtained as the deviation amount D1. The value of the update amount ΔDEV is calculated from the deviation amount D1 so as to satisfy the relationship illustrated in FIG. 13.

Figure 22:
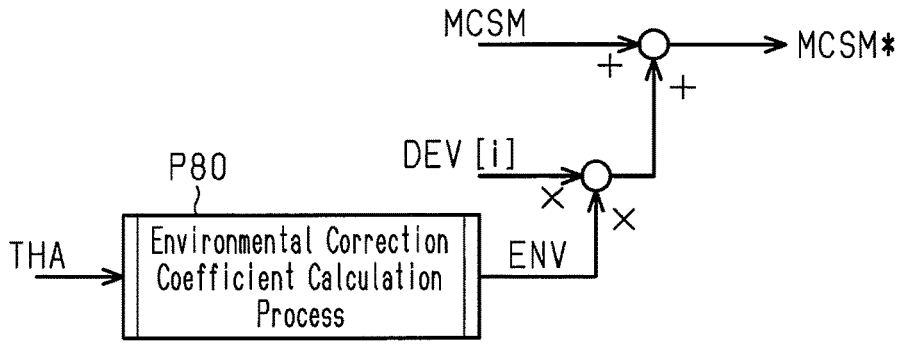
FIG. 22 is a block diagram illustrating a procedure of processes for calculating the corrected AFM synchronous intake air amount in the engine controller of FIG. 20.

FIG. 22 shows a procedure of processes for calculating the corrected AFM synchronous intake air amount MCSM* in the present embodiment. In the present embodiment, as shown in FIG. 22, the sum of the AFM synchronous intake air amount MCSM and the product of the difference amount learning value DEV[i] multiplied by the environmental correction coefficient ENV (i.e., MCSM+DEV[i]×ENV) is calculated as the value of the corrected AFM synchronous intake air amount MCSM*.

The calculation of the update amount ΔDEV is performed when the small pulsation determination is made. The value of the model modified amount ΔMC during the small pulsation determination serves as the difference amount of the AFM synchronous intake air amount MCSM from the AFM system intake air amount MCAFM. Further, in the calculation of the update amount ΔDEV, while the model modified amount ΔMC is divided by the environmental correction coefficient ENV, the model modified amount ΔMC is multiplied by the environmental correction coefficient ENV. The correction of the environmental correction coefficient ENV for the model modified amount ΔMC in the calculation of the update amount ΔDEV is referred to as environmental correction. The correction of the environmental correction coefficient ENV for the difference amount learning value DEV[i] in the calculation of the corrected AFM synchronous intake air amount MCSM* is referred to as inverse correction of the environmental correction. Thus, in the present embodiment, the learning of the difference amount in the difference amount calculation process P60 is performed by updating the value of the difference amount learning value DEV[i] based on the value obtained by performing environmental correction on the difference amount (model modified amount ΔMC) in accordance with the environmental condition of the engine 10. Then, the value obtained by performing inverse correction of the environmental correction on the difference amount learning value DEV[i] is used as the value of the difference amount DEV to calculate the corrected AFM synchronous intake air amount MCSM*.

In the present embodiment, the learning of the difference amount learning value DEV[i] is performed through environmental correction in a state in which the change in the difference amount DEV resulting from the intake air temperature THA is reflected in advance. This limits reflection of the variation in the difference amount DEV, which results from the difference in the environmental condition (intake air temperature THA), on the difference amount learning value DEV[i] and thus increases the learning accuracy.

Figure 23:
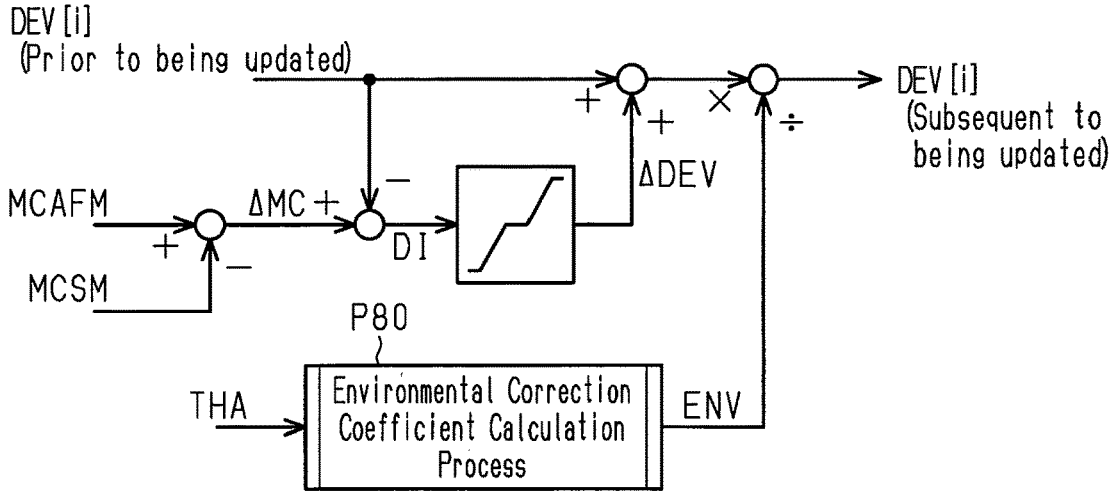
FIG. 23 is a block diagram illustrating a procedure of processes for updating the difference amount learning value in a modification of the engine controller of the present disclosure.

The difference amount learning value DEV[i] may be updated with the mode shown in FIG. 23. In the case of FIG. 23, the difference obtained by subtracting the value of the difference amount learning value DEV[i] prior to being updated from the model modified amount ΔMC is obtained as the value of the deviation amount D1, and the update amount ΔDEV is calculated from the deviation amount D1. The value of the difference amount learning value DEV[i] is updated such that the quotient of, divided by the environmental correction coefficient ENV, the sum of the update amount ΔDEV and the difference amount learning value DEV[i] prior to being updated becomes the value of the difference amount learning value DEV[i] subsequent to being updated.

Environmental correction may be performed based on state quantities other than the intake air temperature THA serving as the environmental condition of the engine 10, for example, the external temperature, engine coolant temperature, engine oil temperature, and temperature of the wall surface of the intake port 18, atmospheric pressure PA, surge tank pressure, and boost pressure in a forced induction engine. Additionally, environmental correction may be performed based on multiple quantities. In this case, the value of the environmental correction coefficient ENV in FIGS. 21 and 22 is the product of the environmental correction coefficients of the state quantities multiplied by each other.

Each of the above-described embodiments may be modified as described below. The above-described embodiment and the following modifications may be implemented in combination with each other as long as technical contradiction does not occur.

In the shift correction amount calculation process P70 of the sixth embodiment shown in FIGS. 18 and 19, the shift correction amount SFT is calculated based on the engine rotation speed NE and the intake pipe pressure (AFM synchronous intake pipe pressure PMSM). In the shift correction amount calculation process P70, instead of using the intake pipe pressure, the shift correction amount SFT may be calculated using other parameters serving as the index values of the load on the engine 10 such as the throttle opening degree TA and the load ratio In the seventh embodiment shown in FIG. 21, environmental correction according to the environmental condition of the engine 10 for the model modified amount ΔMC when calculating the update amount ΔDEV of the difference amount learning value DEV[i] is performed by dividing the environmental correction coefficient ENV. Such environmental correction may be subtracting, from the model modified amount ΔMC, a correction amount ENV* set in accordance with the environmental condition of the engine 10. In this case, the correction of the difference amount learning value DEV[i] when calculating the corrected AFM synchronous intake air amount MCSM* is performed such that the correction serves as inverse correction of the environmental correction, that is, performed by adding the correction amount ENV* to the difference amount learning value DEV[i]. When environmental correction is performed based on the relationship between the intake air temperature THA and the difference amount shown in FIG. 20, the correction amount ENV* simply needs to be set as follows. That is, in this case, the difference obtained by subtracting the reference difference amount ΔST from the difference amount of each average value of the AFM system intake air amount MCAFM and the AFM synchronous intake air amount MCSM simply needs to be set as the value of the environmental correction coefficient ENV in each intake air temperature THA.

In the determination processes P6 and P50, it is determined whether intake pulsation is large based on the pulsation ratio RTE, which is calculated from the AFM detection intake air amount GA. However, such determination does not have to be made in this manner. For example, the determination may be made depending on whether the difference obtained by subtracting the minimum value GMIN from the maximum value GMAX is greater than or equal to a preset determined value. Alternatively, it may be determined whether intake pulsation is large by making the above-described determination based on the running state of the engine 10 (for example, engine rotation speed NE or estimated intake air amount).

The modes of setting the difference amount learning region in the engine controller of the fourth embodiment and the fifth embodiment are not limited to the above-described examples and may be changed.

In the engine controller of the third to seventh embodiments, the air model may be replaced with a model corresponding to a forced induction engine so that the model can be applied to the forced induction engine.

Eighth Embodiment

An engine controller according to an eighth embodiment of the present disclosure will now be described with reference to FIGS. 1 to 6 and FIGS. 24 to 28. FIGS. 1 to 6 illustrate the original engine controller of the engine controller according to the eighth embodiment. That is, the engine controller according to the eighth embodiment is configured by modifying the original engine controller illustrated in FIGS. 1 to 6 (hereinafter referred to as premise configuration).

The difference of the configuration of the engine controller according to the eighth embodiment from the premise configuration of FIGS. 1 to 6 will now be described with reference to FIGS. 24 to 28. In the difference amount calculation process P7, the engine controller of the eighth embodiment learns the difference amount learning value, which is a learning value of the difference amount DEV, by updating the value of the difference amount DEV to the side where the deviation amount D1 decreases based on the deviation amount D1 of the corrected second intake air amount MC3 from the first intake air amount MC1 while the engine is running. Further, in the present embodiment, the difference amount learning value is learned separately for each of the difference amount learning regions, which are divided in accordance with the engine rotation speed.

Figure 24:
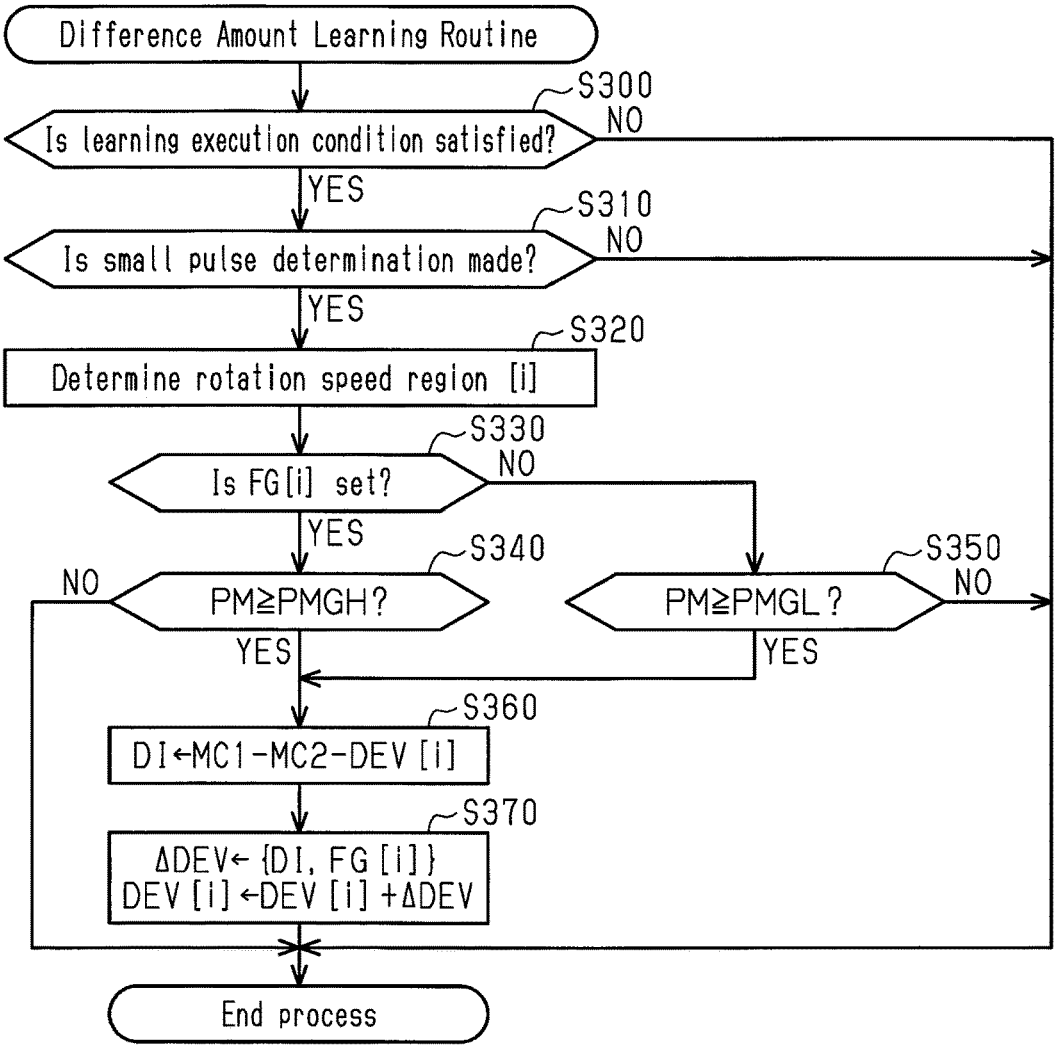
FIG. 24 is a flowchart illustrating the difference amount learning routine executed by an engine controller according to an eighth embodiment.

FIG. 24 shows the flowchart of a difference amount learning routine for learning the difference amount learning value. While the engine 10 is running, the processes of this routine are repeatedly executed by the electronic control unit 25 in each calculation cycle of the intake air amount.

When the processes of this routine are started, it is first determined in step S300 whether a learning execution condition has been satisfied. When the learning execution condition has not been satisfied (S300: NO), the current routine is ended. In the present embodiment, the learning execution condition is met by satisfying all of the following conditions: (1) warm-up of the engine 10 has been completed; (2) the engine 10 is not in a transient state in which the running condition of the engine 10 changes greatly; and (3) the systems of sensors and actuators have no abnormalities.

When the learning execution condition has been satisfied (S300: YES), the process is advanced to step S310. In step S310, it is determined whether the small pulsation determination is being made. More specifically, this determination is made based on the large pulsation flag F shown in FIG. 5. That is, it is determined that the small pulsation determination is being made when the large pulsation flag F is cleared, and it is determined that the small pulsation determination is not being made (i.e., large pulsation determination is being made) when the large pulsation flag F is set. When the small pulsation determination is being made (S310: YES), the process is advanced to step S320. When the small pulsation determination is not being made (S310: NO), that is, when the large pulsation determination is being made, the processes of the current routine are ended.

In the present embodiment, the running region of the engine 10 is divided into multiple rotation speed regions in accordance with the engine rotation speed. The learning of the difference amount DEV is performed separately for each rotation speed region. In the present embodiment, an example in which five rotation speed regions are set will be described. In the following description, the five rotation speed regions are referred to as, sequentially from ones with a small engine rotation speed NE, a rotation speed region [1], a rotation speed region [2], a rotation speed region [3], a rotation speed region [4], and a rotation speed region [5]. Further, when i is any one of 1, 2, 3, 4, and 5, the learning value of the difference amount DEV corresponding to a rotation speed region [i] is referred to as the difference amount learning value DEV[i].

When the process is advanced to step S320, the rotation speed region where the engine 10 is currently running is identified in step S320. In the following description, the rotation speed region where the engine 10 is currently running is referred to as a current rotation speed region. Subsequently, it is determined in step S330 whether a learning complete flag FG[i] corresponding to the current rotation speed region [i] has been set. The learning complete flag FG[i] is set separately for each rotation speed region [i], that is, each difference amount learning value DEV[i]. In a state in which the learning complete flag FG[i] is set, the learning complete flag FG[i] indicates that the learning of the difference amount learning value DEV[i] in the corresponding rotation speed region [i] has been completed. In a state in which the learning complete flag FG[i] is cleared, the learning complete flag FG[i] indicates that the learning of the difference amount learning value DEV[i] of the corresponding rotation speed region [i] has not been completed. The state of the learning complete flag FG[i] is operated in the processes of a learning complete determination routine, which will be described later.

When the learning complete flag FG[i] in the current rotation speed region is cleared (S330: NO), that is, when the learning of the difference amount learning value DEV[i] in the current rotation speed region [i] is not completed, it is determined in step S350 whether the intake pipe pressure PM is greater than or equal to a preset first lower limit value PMGL. When the intake pipe pressure PM is greater than or equal to the first lower limit value PMGL (S350: YES), the process is advanced to step S360. When the intake pipe pressure PM is less than the first lower limit value PMGL (S350: NO), the current routine is ended. The first lower limit value PMGL is the value of pressure that is lower than the minimum value of the intake pipe pressure PM in the pulsation region. The pulsation region is the running region of the engine 10 where a large intake pulsation occurs enough to decrease the detection accuracy of the air flowmeter 13.

When the learning complete flag FG[i] of the current rotation speed region is set (S330: YES), that is, when the learning of the difference amount learning value DEV[i] in the current rotation speed region is completed, it is determined in step S340 whether the intake pipe pressure PM is greater than or equal to a preset second lower limit value PMGH. When the intake pipe pressure PM is greater than or equal to the second lower limit value PMGH (S340: YES), the process is advanced to step S360. When the intake pipe pressure PM is less than the second lower limit value PMGH (S340: NO), the current routine is ended. The second lower limit value PMGH is the value of pressure that is lower than the minimum value of the intake pipe pressure PM in the pulsation region and higher than the first lower limit value PMGL (PMGL<PMGH<the minimum value of PM in the pulsation region).

As a result of the determination in step S340 or step S350, when the process is advanced to step S360, in step S360, the value obtained by subtracting the difference amount learning value DEV[i] in the current rotation speed region from the difference of the second intake air amount MC2 from the first intake air amount MC1 (i.e., MC1−MC2−DEV[i]) is calculated as the value of the deviation amount D1. That is, the difference of the corrected second intake air amount MC3 (MC3=MC2+DEV[i]) from the first intake air amount MC1 is calculated as the value of the deviation amount D1. Subsequently, in step S370, the difference amount learning value DEV[i] in the current rotation speed region is updated based on the deviation amount D1. Then, the processes of the current routine are ended. The update amount ΔDEV of the difference amount learning value DEV[i] is determined by the deviation amount D1 and the state of the learning complete flag FG[i].

Figure 25:
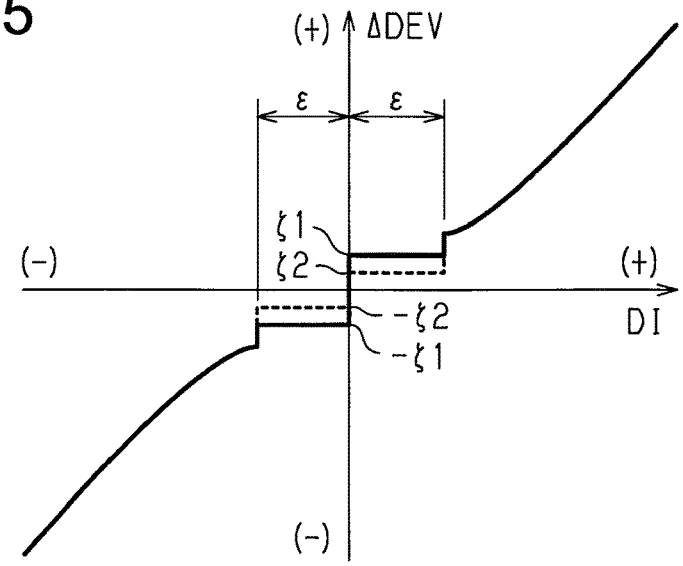
FIG. 25 is a graph illustrating the relationship between the update amount and the deviation amount of the difference amount learning value calculated in the difference amount learning routine in the engine controller of FIG. 24.

FIG. 25 shows the relationship between the update amount ΔDEV of the deviation amount D1 and the update amount ΔDEV of the difference amount learning value DEV[i] by the solid lines when the learning complete flag FG[i] is cleared. FIG. 25 also shows the relationship between the deviation amount D1 and the update amount ΔDEV of the difference amount learning value DEV[i] by the dotted lines when the learning complete flag FG[i] is set. The value ε shown in FIG. 25 is a convergence determination value. The convergence determination value ε is used to determine whether the learning of the difference amount learning value DEV[i] has been completed in the learning complete determination routine.

In the region where the absolute value of the deviation amount D1 is greater than the convergence determination value ε (ε<|D1|), as long as the deviation amount D1 has the same value, the same value is set as the update amount ΔDEV even if the learning complete flag FG[i] is either set or cleared. More specifically, the value of the update amount ΔDEV in the region (ε<|D1|) is set so as to be the following value. That is, the value of the update amount ΔDEV when the value of the deviation amount D1 is gradually increased from the convergence determination value ε is set so as to increase as the deviation amount D1 increases. The value of the update amount ΔDEV when the value of the deviation amount D1 is gradually decreased from −ε is set so as to decrease as the deviation amount D1 decreases.

In a region where the deviation amount D1 is greater than 0 and less than or equal to ε (0<D1≤ε), when the learning complete flag FG[i] is cleared (shown by the solid line in FIG. 25), a preset positive value ζ1 is set as the value of the update amount ΔDEV. When the learning complete flag FG[i] is set (shown by the dotted line in FIG. 25), a positive value ζ2, which is smaller than ζ1, is set as the value of the update amount ΔDEV. In a region where the deviation amount D1 is less than 0 and greater than or equal to ε (−ε≤D1<0), −ζ1 is set as the value of the update amount ΔDEV when the learning complete flag FG[i] is cleared (shown by the solid line in FIG. 25), and a negative value −ζ2, which is larger than −ζ1 (having a smaller absolute value), is set as the value of the update amount ΔDEV when the learning complete flag FG[i] is set (dotted by the solid line in FIG. 25). When the deviation amount D1 is 0 (DE=0), 0 is set as the value of the update amount ΔDEV regardless of the state of the learning complete flag FG[i].

In the above-described difference amount learning routine, the learning of the difference amount learning value DEV[i] is performed by updating the value of the difference amount learning value DEV[i] in accordance with the deviation amount D1 of the corrected second intake air amount MC3 from the first intake air amount MC1 when the small pulsation determination is made. Further, in the difference amount learning routine, the difference amount learning region, which is the running region of the engine 10 where the learning of the difference amount learning value DEV[i] is performed in accordance with the deviation amount D1 during the small pulsation determination, is switched depending on whether the learning of the difference amount learning value DEV[i] has been completed.

Figure 26:
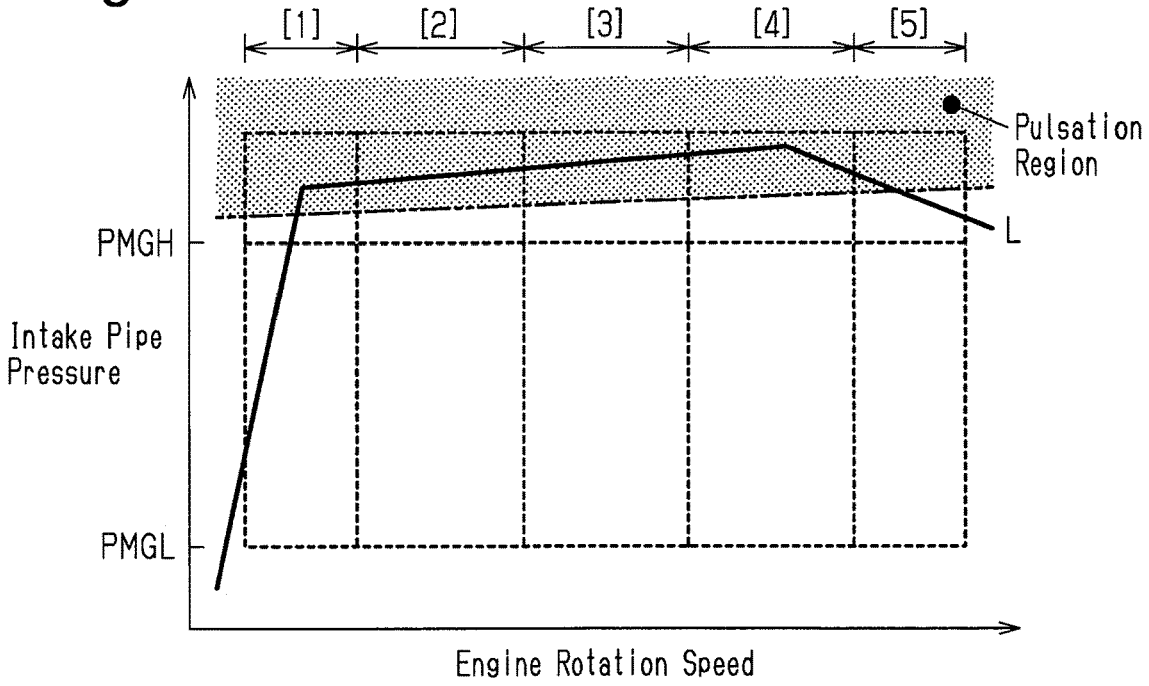
FIG. 26 is a graph illustrating the setting mode of the difference amount learning region in the engine controller of FIG. 24.

FIG. 26 shows the setting of the difference amount learning region in the present embodiment. In FIG. 26, line L represents the maximum value of the intake pipe pressure per engine rotation speed in the running region of the engine 10. Further, the pulsation region shown with hatching in FIG. 26 represents the running region of the engine 10 where a large intake pulsation occurs enough to decrease the detection accuracy of the air flowmeter 13.

As described above, in the difference amount learning routine, before the learning of the difference amount learning value DEV[i] is completed (S330: NO), when the intake pipe pressure PM is greater than or equal to the first lower limit value PMGL (S350: YES), the difference amount learning value DEV[i] is updated in accordance with the deviation amount D1 in step S360 and step S370. After the learning of the difference amount learning value DEV[i] is completed (S330: YES), when the intake pipe pressure PM is greater than or equal to the second lower limit value PMGH, which is greater than PMGL, the difference amount learning value DEV[i] is updated in accordance with the deviation amount D1 in step S360 and step S370. The first lower limit value PMGL and the second lower limit value PMGH are the values of pressure that are lower than the minimum value of the intake pipe pressure PM in the pulsation region. The region where the intake pipe pressure PM in each rotation speed region [i] is greater than or equal to the first lower limit value PMGL is referred to as a first learning region, and the region where the intake pipe pressure PM in each rotation speed region [i] is greater than or equal to the second lower limit value PMGH is referred to as a second learning region. In the present embodiment, the learning of the difference amount learning value DEV[i] according to the deviation amount D1 in each rotation speed region [i] is performed in the first learning region, which includes the pulsation region before completing the learning of the difference amount learning value DEV[i], and is performed in the second learning region, which is narrower than the first learning region and includes the pulsation region after completing the learning of the difference amount learning value DEV[i].

Figure 27:
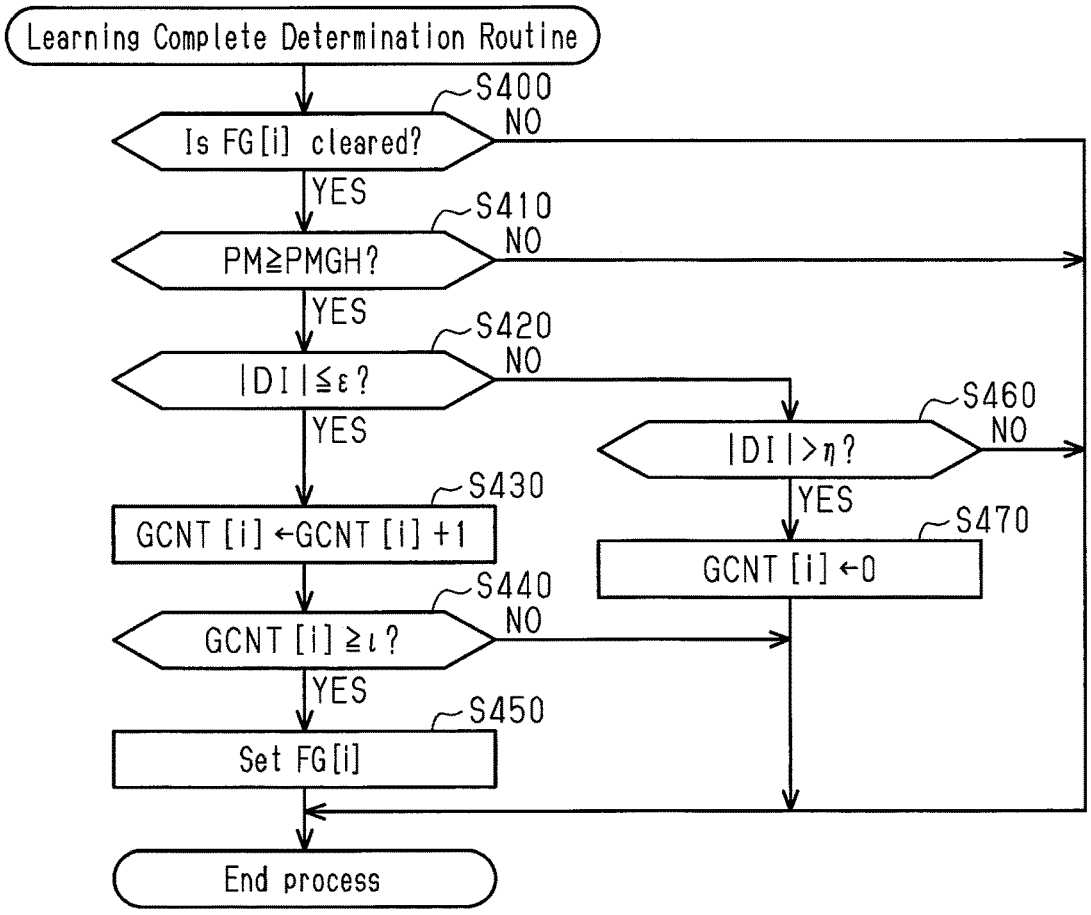
FIG. 27 is a flowchart illustrating a learning complete determination routine executed by the engine controller of FIG. 24.

FIG. 27 shows the flowchart of the learning complete determination routine. While the engine 10 is running, the processes of this routine are repeatedly executed by the electronic control unit 25 in each calculation cycle.

When the processes of this routine are started, it is first determined in step S400 whether the learning complete flag FG[i] in the current rotation speed region [i] has been cleared. When the learning complete flag FG[i] is cleared (S400: YES), the process is advanced to step S410. When the learning complete flag FG[i] is already set (S400: NO), the current routine is ended.

When the process is advanced to step S410, it is determined in step S410 whether the intake pipe pressure PM is greater than or equal to the above-described preset value (i.e., second lower limit value PMGH). When the intake pipe pressure PM is greater than or equal to the second lower limit value PMGH (S410: YES), the process is advanced to S420. When the intake pipe pressure PM is less than the second lower limit value PMGH (S410: NO), the processes of the current routine are ended.

When the process is advanced to step S420, it is determined in step S420 whether the absolute value of the deviation amount D1 is less than or equal to the convergence determination value ε. When the absolute value of the deviation amount D1 is less than or equal to the convergence determination value ε (S420: YES), the process is advanced to step S430. When the absolute value of the deviation amount D1 is greater than the convergence determination value ε (S420: NO), the process is advanced to step S460.

When the process is advanced to step S430, a determination counter GCNT[i] set for each rotation speed region [i] is counted up in step S430. That is, the value of the determination counter GCNT is updated such that the sum of 1 and the value prior to being updated becomes the value subsequent to being updated. Subsequently, it is determined in step S440 whether the determination counter GCNT[i] is greater than or equal to a learning complete determination value ι. When the determination counter GCNT[i] is greater than or equal to a learning complete determination value ι (S440: YES), the process is advanced to step S450. When the determination counter GCNT[i] is less than the learning complete determination value ι (S440: NO), the current process is ended. When the process is advanced to step S450, the learning complete flag FG[i] in the current rotation speed region [i] is set in step S450. Then, the processes of the current routine are ended.

When the process is advanced to step S460, it is determined in step S460 whether the absolute value of the deviation amount D1 is greater than a discrepancy determination value η. The discrepancy determination value η is set to be larger than the convergence determination value ε (ε<η). When the absolute value of the deviation amount D1 is greater than the discrepancy determination value η (S460: YES), the process is advanced to step S470. When the absolute value of the deviation amount D1 is less than or equal to the discrepancy determination value η (S460: NO), the current process is ended. When the process is advanced to step S470, the value of the learning complete flag FG[i] is reset to 0 in step S470. Then, the processes of the current routine are ended.

Figure 28:
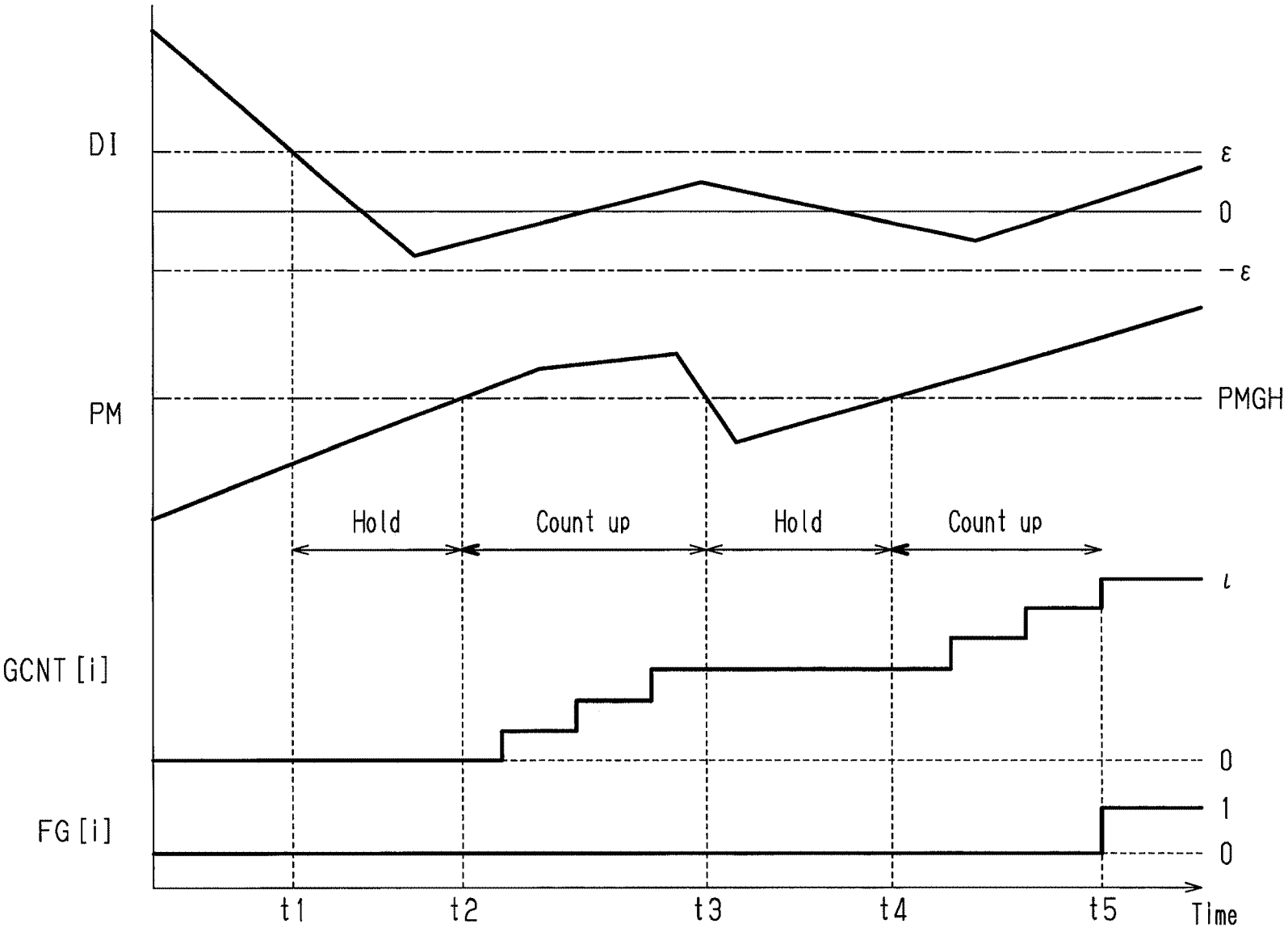
FIG. 28 is a time chart illustrating an example of the mode for implementing the learning complete determination routine in the engine controller of FIG. 24.

FIG. 28 shows one example of the mode of implementing the learning complete determination of the difference amount learning value DEV[i] through the above-described learning complete determination routine. The difference amount learning value DEV[i] is learned such that the deviation amount D1 of the corrected second intake air amount MC3 from the first intake air amount MC1 is sufficiently small in order to prevent the occurrence of a step in the calculated value of the intake air amount when switching the calculation mode of the intake air amount in accordance with intake pulsation. In the present embodiment, in the learning complete determination routine, the determination of whether the absolute value of the deviation amount D1 of the corrected second intake air amount MC3 from the first intake air amount MC1 is less than or equal to the convergence determination value ε is performed in each calculation cycle. It is determined that the learning of the difference amount learning value DEV[i] has been completed on the condition that the value of the determination counter GCNT[i], which indicates the number of times of determining that the absolute value of the deviation amount D1 is less than or equal to the convergence determination value ε, is greater than or equal to the learning complete determination value ι.

In the period subsequent to the point in time t1 in FIG. 28, the absolute value of the deviation amount D1 of the corrected second intake air amount MC3 from the first intake air amount MC1 is less than or equal to the convergence determination value ε. In the present embodiment, when the absolute value of the deviation amount D1 is less than or equal to the convergence determination value ε and the intake pipe pressure PM is greater than or equal to the second lower limit value PMGH, the value of the determination counter GCNT[i] is counted up. That is, the determination counter GCNT[i] is counted up only in the second learning region. Thus, even if the absolute value of the deviation amount D1 is less than or equal to the convergence determination value ε, the value of the determination counter GCNT[i] is kept from the point in time t1 to the point in time t2 and from the point in time t3 to the point in time t4, when the intake pipe pressure PM is less than the second lower limit value PMGH. When the determination counter GCNT [i] is counted up in a state in which the absolute value of the deviation amount D1 is less than or equal to the convergence determination value ε and the intake pipe pressure PM is greater than or equal to the second lower limit value PMGH, the learning complete flag FG[i] is set to the point in time t5, when the value of the determination counter GCNT[i] reaches the learning complete determination value ι, based on the fact that the learning has been completed.

In the present embodiment, when the engine 10 is running in the second learning region, the determination of whether the absolute value of the deviation amount D1 is less than or equal to the preset convergence determination value ε is made in each determination cycle. The number of times of determining that the absolute value of the deviation amount D1 is less than or equal to the convergence determination value ε is recorded as the value of the determination counter GCNT. When the number of times of determining that the value of the determination counter GCNT, that is, the absolute value of the deviation amount D1, is less than or equal to the convergence determination value ε is greater than or equal to the preset learning complete determination value ι, it is determined that the learning of the difference amount learning value DEV[i] has been completed. The determination of whether the learning of the difference amount learning value DEV[i] has been completed is made separately for each rotation speed region [i].

The operation and advantages of the present embodiment will now be described.

In the engine controller of the present embodiment, when the small pulsation determination is made, the first intake air amount MC1 calculated based on the detection result of the air flowmeter 13 through the first intake air amount calculation process P4 is calculated as the intake air amount calculated value MC. During the large pulsation determination is made, when the detection accuracy of the air flowmeter 13 decreases, the corrected second intake air amount MC3 is calculated as the intake air amount calculated value MC. The corrected second intake air amount MC3 is obtained as the sum of the difference amount learning value DEV[i] and the second intake air amount MC2, which is calculated without using the detection result of the air flowmeter 13 through the second intake air amount calculation process P5. The difference amount learning value DEV[i] is learned by updating the value in accordance with the deviation amount D1 of the corrected second intake air amount MC3 from the first intake air amount MC1 when the small pulsation determination is made.

In this manner, the difference amount learning value DEV[i] is used to calculate the intake air amount calculated value MC when the large pulsation determination is made. That is, the difference amount learning value DEV[i] is reflected on the intake air amount calculated value MC only in the high-load running region of the engine 10, which is a pulsation region. The difference between the first intake air amount MC1 and the second intake air amount MC2 resulting from the difference in the calculation mode differs depending on the running region of the engine 10. Thus, the low-load running region and the high-load running region may have different learning results of the difference amount learning value DEV[i]. Accordingly, it is desired that the difference amount learning value DEV[i] be learned only in the high-load running region in order to ensure the learning accuracy. However, the difference amount learning value DEV[i] needs to be learned when the small pulsation determination is made. Thus, learning opportunities are limited only in the high-load running region. As a result, when the difference amount learning value DEV[i] is learned only in the second learning region, the completion of learning tends to be long.

In the present embodiment, before the learning of the difference amount learning value DEV[i] is completed, the learning of the difference amount learning value DEV[i] is performed in the first learning region, which includes the low-load running region located away from the pulsation region. This ensures learning opportunities, thereby shortening the time to complete the learning. Further, after completion of the learning, the difference amount of the first intake air amount MC1 and the second intake air amount MC2 vary depending on changes over time in, for example, the detection characteristics of the air flowmeter 13 and the opening degree characteristics of the throttle valve 14. Such changes gradually progress with a long period of time. Thus, even if the number of learning opportunities is not large, the value of the difference amount learning value DEV[i] follows the changes. In the present embodiment, after completion of the learning, the difference amount learning value DEV[i] is learned only in the second learning region. In the present embodiment, as the running region of the engine 10 where the difference amount learning value DEV[i] is learned, the region is set to be wide before completion of the learning in order to ensure learning opportunities whereas the region is set to be narrow before completion of the learning in order to ensure learning opportunities. This allows the learning of the difference amount learning value DEV[i] to be performed in a favorable manner.

As described above, the difference between the first intake air amount MC1 and the second intake air amount MC2 resulting from the difference in the calculation mode differs depending on the running region of the engine 10. Thus, even if the deviation amount D1 is sufficiently small in the running region located away from the pulsation region, the deviation amount D1 may not be sufficiently decreased in the running region located close to the pulsation region. In the present embodiment, whereas the learning of the difference amount learning value DEV[i] is performed in the first learning region before completion of the learning, completion of the learning is determined only in the second learning region. This increases the accuracy of the learning completion determination while shortening the time required for learning completion.

Each of the above embodiments may be modified as described below. The present embodiment and the following modifications may be implemented in combination with each other as long as technical contradiction does not occur.

In the above-described embodiment, the learning of the difference amount learning value DEV[i] is performed separately for each of the five rotation speed regions [i], which are divided from one another in accordance with the engine rotation speed NE. Instead, the number of the rotation speed regions [i] may be changed. Alternatively, a single difference amount learning value may be used without dividing the rotation speed region.

In the above-described embodiment, the calculation of the second intake air amount MC2 in the second intake air amount calculation process P5 is performed with the throttle speed mode, that is, using the estimated value of the intake air flow rate based on the throttle opening degree TA and the engine rotation speed NE. Instead, the calculation of the second intake air amount MC2 may be performed with the speed density mode, that is, using the estimated value of the intake air flow rate based on the detection result of the intake pipe pressure PM and the engine rotation speed NE.

In the above-described embodiment, the second lower limit value PMGH is fixed regardless of the engine rotation speed NE. Instead, the second lower limit value PMGH may be changed for each rotation speed region [i] when, for example, the intake pipe pressures PM, which are the lower limits of the pulsation region, differ from each other depending on the engine rotation speed NE. Alternatively, the second lower limit value PMGH may be set as a value that changes depending on the engine rotation speed NE.

In the above-described embodiment, the ranges of the first learning region and the second learning region are defined using the engine rotation speed NE and the intake pipe pressure PM. Instead, the ranges of the first learning region and the second learning region may be set using parameters correlated with the engine load such as the engine load ratio KL and the throttle opening degree TA instead of the intake pipe pressure PM.

Ninth Embodiment

In some onboard engines, the engine control mode is switched through manual operation by a driver. In such an engine, the control content of the engine changes depending on the control mode, thereby changing the pulsation region. In the ninth embodiment, the mode for setting the second learning region in the engine that switches the control mode will be described also with reference to FIGS. 29 to 32.

Figure 29:
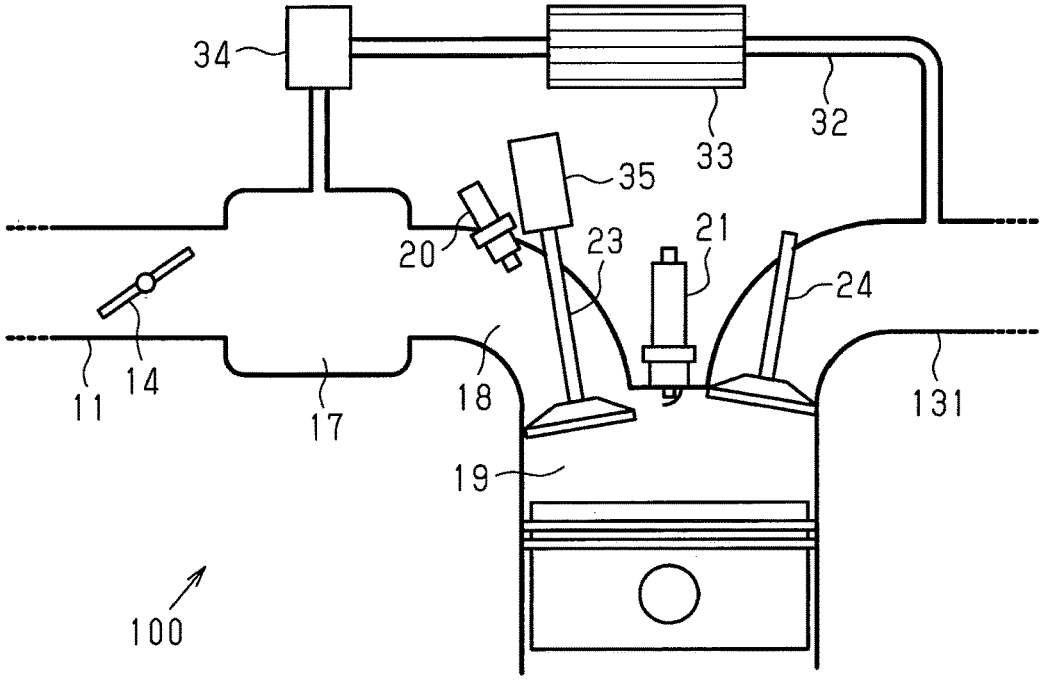
FIG. 29 is a schematic diagram illustrating the structure of an engine that switches a control mode in an engine controller according to a ninth embodiment of the present disclosure.

FIG. 29 shows the structure of one example of an engine 100 that switches the control mode. As shown in FIG. 29, the engine 100 includes an exhaust gas recirculation (EGR) system that recirculates some of exhaust gas into intake air. The EGR system includes an EGR passage 32 that connects an exhaust passage 131 to a portion of the intake passage 11 located downstream of the throttle valve 14 (for example, intake manifold 17). The EGR passage 32 includes an EGR cooler 33 and an EGR valve 34. The EGR cooler 33 cools exhaust gas (EGR gas) that passes through the EGR passage 32 and is recirculated into intake air. The EGR valve 34 is a flow rate adjustment valve for adjusting the flow rate of EGR gas. The engine 100 also includes a variable valve mechanism 35 that varies the valve timing of the intake valve 23 (the timing of opening and closing the valve).

In the engine 100, operation of a switch on the driver seat allows a fuel-efficient mode or a power mode to be selected as the control mode of the engine 100. The fuel-efficient mode is a control mode for improving the fuel efficiency of the engine 100 by drawing in a vast amount of EGR gas even during the high-load running. The power mode is a control mode for increasing the maximum output of the engine 100 by reducing the amount of EGR gas drawn in during the high-load running and then increasing the amount of air drawn in the combustion chamber 19.

In the power mode, the variable valve mechanism 35 is controlled during the high-load running such that the timing of closing the intake valve 23 is later than the intake bottom dead center. When the timing of closing the intake valve 23 is set to be later than the intake bottom dead center, some of the intake air drawn in the combustion chamber 19 during a period from the intake bottom dead center to the timing of closing the intake valve 23 is pushed back into the intake passage 11, thereby increasing the intake pipe pressure PM. Thus, in the fuel-efficient mode, the variable valve mechanism 35 is controlled such that the timing of closing the intake valve 23 during the high-load running is earlier than that of the power mode in order to ensure an intake negative pressure necessary to draw in a vast amount of EGR gas.

In the engine 100, the opening degree of the EGR valve 34 and the valve timing of the intake valve 23 are elements for determining the intake air amount. Thus, in the first intake air amount calculation process P4 applied to the engine 100, the first intake air amount MC1 simply needs to be calculated based on the opening degree of the EGR valve 34 and the valve timing of the intake valve 23 in addition to the AFM detection intake air amount GA and the engine rotation speed NE. In the second intake air amount calculation process P5, the second intake air amount MC2 simply needs to be calculated based on the opening degree of the EGR valve 34 and the valve timing of the intake valve 23 in addition to the throttle opening degree TA and the engine rotation speed NE.

In the present embodiment, in the same manner as the eighth embodiment, the difference amount learning value DEV[i] is learned in accordance with the deviation amount D1 of the second intake air amount MC2 from the first intake air amount MC1 when the small pulsation determination is made, and the intake air amount is calculated using the difference amount learning value DEV[i] when the large pulsation determination is made. Further, the running region where the learning of the difference amount learning value DEV[i] is performed is switched from the first learning region to the second learning region in accordance with completion of the learning.

As described above, the engine load ratio KL and the throttle opening degree TA may be used in addition to the intake pipe pressure PM as the index value of the engine load that defines the range of the second learning region. In the engine 100 for switching the control mode, a change in the pulsation region due to the control mode needs to be taken into account when setting the range of the second learning region. In the following description, any one of the intake pipe pressure PM, the engine load ratio KL, and the throttle opening degree TA is used as the index value of the engine load, and the range of the pulsation region is depicted in an orthogonal coordinate system that includes the index value of the engine load and the engine rotation speed NE as coordinate axes. The line indicating the relationship between the engine rotation speed NE and the lower limit value of the index value of the engine load in the pulsation region is referred to as a pulsation region boundary line. Further, the line indicating the relationship between the engine rotation speed NE and the lower limit value of the engine load in the second learning region when depicting the range of the second learning region in the orthogonal coordinate system is referred to as a learning switching line.

First, a case in which the range of the second learning region is defined using the engine load ratio KL in the engine 100 for switching the control mode will be described.

Figure 30:
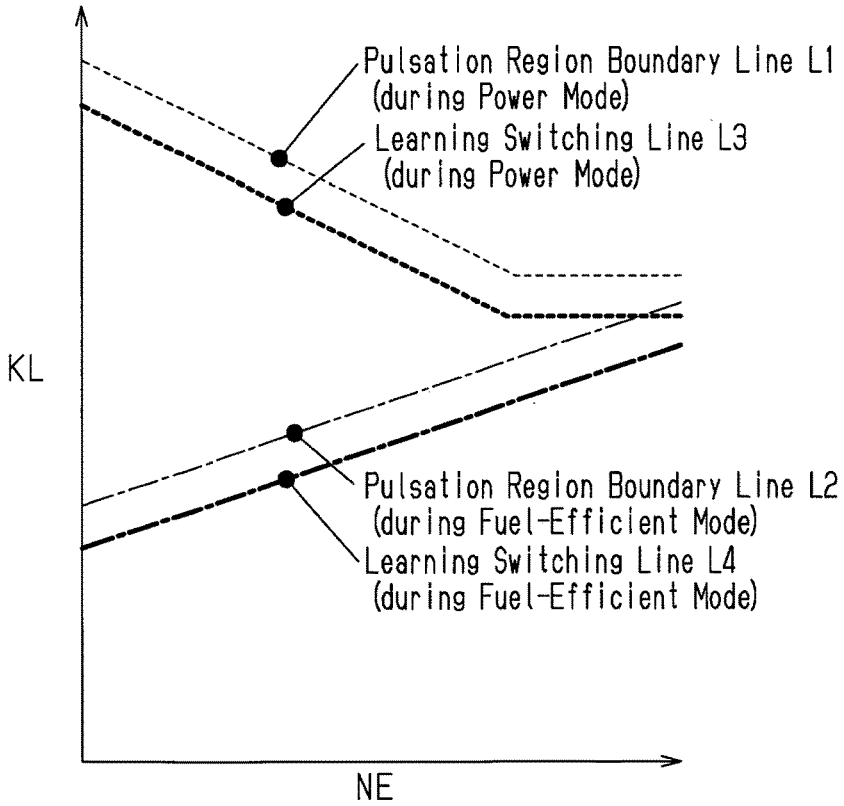
FIG. 30 is a graph illustrating the mode for setting the difference amount learning region using a load ratio in the engine that switches the control mode in the engine controller of FIG. 29.

The detection accuracy of the air flowmeter 13 resulting from intake pulsation is decreased by the following phenomenon. That is, when gas (intake air and EGR gas) intermittently flows into the combustion chamber 19 as the intake valve 23 opens and closes, the pressure in the intake port 18 varies. The pressure variation in the intake port 18 goes up through the intake passage 11 to the position where the air flowmeter 13 is arranged. As a result, the detection accuracy of the air flowmeter 13 decreases. When the engine rotation speed NE is the same, the pressure variation in the intake port 18 increases as the flow rate of gas flowing through the intake port 18 (hereinafter referred to as port flow rate) increases. When the engine rotation speed NE and the engine load ratio KL are constant, the port flow rate increases to a larger extent in the fuel-efficient mode than in the power mode as the amount of EGR gas drawn in increases. Thus, when the engine rotation speed NE is constant, the lower limit value of the engine load ratio KL in the pulsation region is smaller in the fuel-efficient mode than in the power mode. The second learning region needs to be set as the high-load running region located close to the pulsation region. Thus, in the engine 100 for switching the control mode as described above, when the second learning region is defined using the engine load ratio KL, the range of the second learning region needs to be switched depending on the control mode in accordance with changes in the pulsation region that result from the control mode. FIG. 30 shows examples of the mode of setting pulsation region boundary lines L1 and L2 during the power mode and the fuel-efficient mode in this case and the mode of setting learning switching lines L3 and L4 during the power mode and the fuel-efficient mode when the second learning region is set in accordance with the second learning regions L1 and L2.

Figure 31:
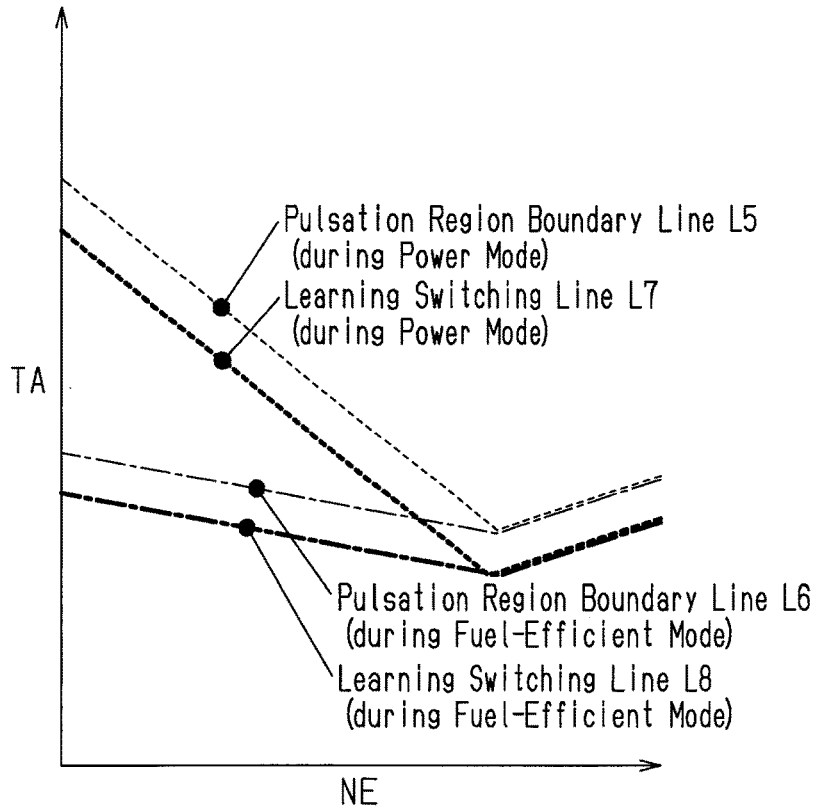
FIG. 31 is a graph illustrating the mode for setting the difference amount learning region using a throttle opening degree in the engine that switches the control mode in the engine controller of FIG. 29.

Subsequently, a case in which the range of the second learning region is defined using the throttle opening degree TA in the engine 100 for switching the control mode will be described. When the engine rotation speed NE and the throttle opening degree TA are constant, the port flow rate increases to a larger extent in the fuel-efficient mode than in the power mode as the amount of EGR gas drawn in increases. Thus, when the engine rotation speed NE is constant, the lower limit value of the throttle opening degree TA in the pulsation region is smaller in the fuel-efficient mode than in the power mode. Thus, in this case, the range of the second learning region needs to be switched depending on the control mode in accordance with changes in the pulsation region that result from the control mode. FIG. 31 shows examples of the mode of setting pulsation region boundary lines L5 and L6 during the power mode and the fuel-efficient mode in this case and the mode of setting learning switching lines L7 and L8 during the power mode and the fuel-efficient mode when the second learning region is set in accordance with the second learning regions L5 and L6.

Figure 32:
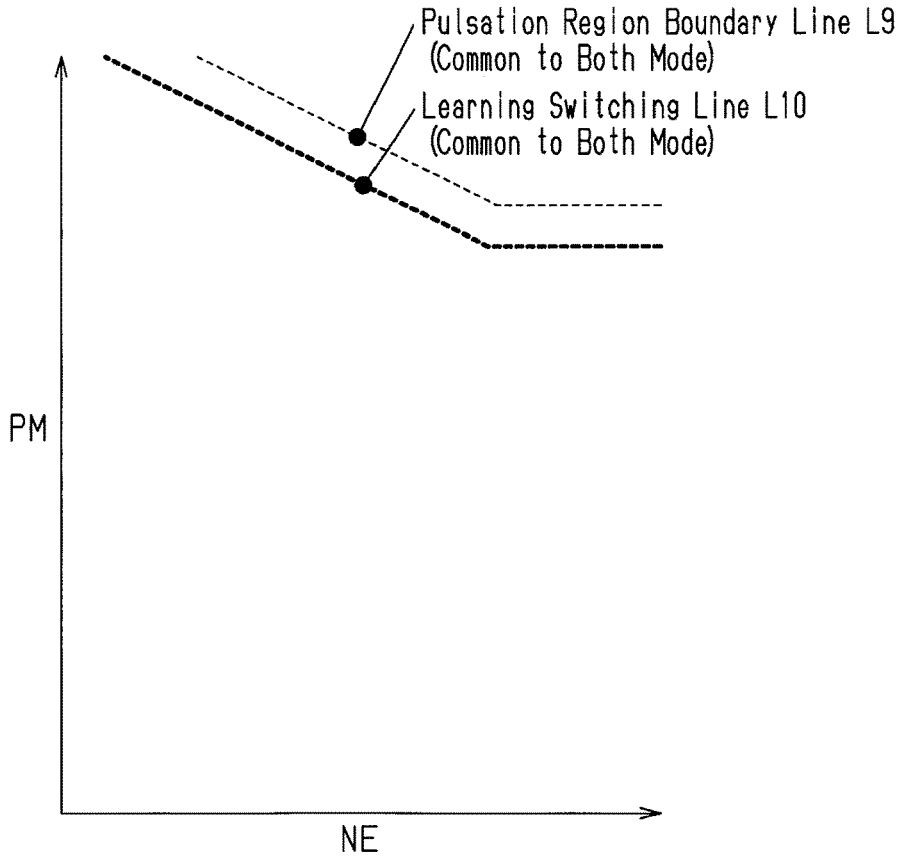
FIG. 32 is a graph illustrating the mode for setting the difference amount learning region using an intake pipe pressure in the engine that switches the control mode in the engine controller of FIG. 29.

Lastly, a case in which the range of the second learning region is defined using the intake pipe pressure PM in the engine 100 for switching the control mode will be described. The port flow rate is determined almost unambiguously by the engine rotation speed NE and the intake pipe pressure PM. Thus, the relationship between the intake pipe pressure PM and the engine rotation speed NE, which are the lower limit values of the pulsation region, does not change even when the control mode changes. This eliminates the need to switch the range of the second learning region with the control mode. That is, when the running region of the engine 100 is defined by the engine rotation speed NE and the intake pipe pressure PM, the range of the pulsation region is the same in both control modes, namely, the power mode and the fuel-efficient mode. Thus, the common range can be set as the second learning region. FIG. 32 shows examples of the mode of a setting pulsation region boundary line L9 in this case and the mode of setting a learning switching line L10 when setting the second learning region in accordance with the pulsation region boundary line L9. As shown in FIG. 32, in this case, the pulsation region boundary line L9 and the learning switching line L10 are common in both control modes, namely, the power mode and the fuel-efficient mode.

Tenth Embodiment

An engine controller according to a second embodiment of the present disclosure will now be described with reference to FIGS. 1 to 6 and FIGS. 33 to 40.

FIGS. 1 to 6 illustrate the original engine controller of the engine controller according to the tenth embodiment.

That is, the engine controller according to the tenth embodiment is configured by modifying the original engine controller illustrated in FIGS. 1 to 6 (hereinafter referred to as the engine controller having the premise configuration).

In FIG. 3, the calculated value of the intake air amount obtained in the intake air amount calculation process P1 is used for various types of engine control such as ignition timing control in addition to control of a fuel injection amount.

The difference of the configuration of the engine controller according to the tenth embodiment from the premise configuration of FIGS. 1 to 6 will now be described with reference to FIGS. 33 to 40.

The intake air amount of the engine is controlled by changing the throttle opening degree TA. In some cases, the engine includes a mechanism that changes the intake air amount in addition to a throttle valve. In such an engine, the control state of such a mechanism may affect the calculation results of the first intake air amount MC1 and the second intake air amount MC2.

Figure 33:
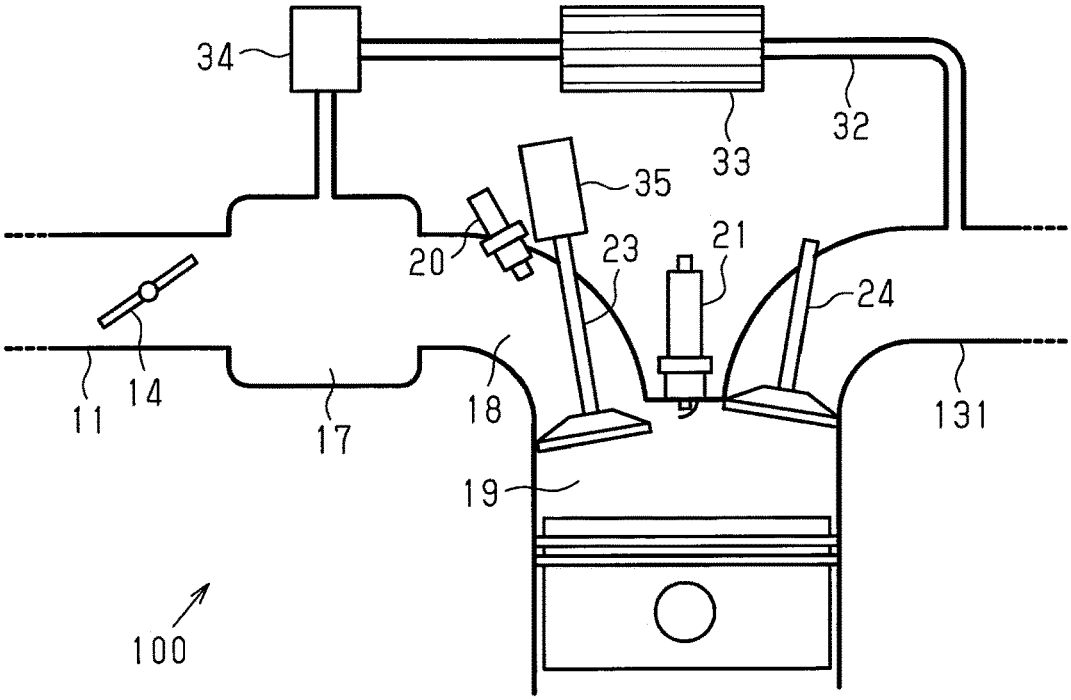
FIG. 33 is a schematic diagram illustrating the structure of an engine for which an engine controller according to a tenth embodiment is employed.

FIG. 33 shows the structure of one example of the engine 100. As shown in FIG. 33, the engine 100 includes an exhaust gas recirculation mechanism that recirculates some of exhaust gas into intake air. The exhaust gas recirculation mechanism includes the exhaust gas recirculation (EGR) passage 32, which connects the exhaust passage 131 to the portion of the intake passage 11 located downstream of the throttle valve 14 (for example, intake manifold 17). The EGR passage 32 includes an EGR cooler 33 and an EGR valve 34. The EGR cooler 33 cools exhaust gas (EGR gas) that passes through the EGR passage 32 and is recirculated into intake air. The EGR valve 34 is a flow rate adjustment valve for adjusting the flow rate of EGR gas. The engine 100 also includes a variable valve mechanism 35 that varies the valve timing of the intake valve 23 (the timing of opening and closing the valve).

In the engine 100, the throttle valve 14 is a mechanism that directly varies the intake air amount by adjusting the flow rate of intake air that passes through the intake passage 11 into the combustion chamber 19. When the exhaust gas recirculation mechanism recirculates exhaust gas, even when the amount of gas flows into the combustion chamber 19 is constant, the amount of air in the gas (intake air amount) decreases by an amount corresponding to the recirculated exhaust gas. Further, the intake air amount is varied by changing the valve timing of the intake valve 23 with the variable valve mechanism 35. The exhaust gas recirculation mechanism and the variable valve mechanism 35 are mechanisms for indirectly varying the intake air amount of the engine 100 (indirect variable intake air mechanism).

In the engine 100, operation of a switch on the driver seat allows the fuel-efficient mode or the power mode to be selected as the control mode of the engine 100. The fuel-efficient mode is a control mode for improving the fuel efficiency of the engine 100 by recirculating a vast amount of exhaust gas. The power mode is a control mode for increasing the maximum output of the engine 100 by reducing the amount of recirculated exhaust gas as compared to the fuel-efficient mode and then increasing the amount of air drawn in the combustion chamber 19.

In the power mode, the variable valve mechanism 35 is controlled during the high-load running such that the timing of closing the intake valve 23 is later than the intake bottom dead center. When the timing of closing the intake valve 23 is set to be later than the intake bottom dead center, some of the intake air drawn in the combustion chamber 19 during the period from the intake bottom dead center to the timing of closing the intake valve 23 is pushed back into the intake passage 11, thereby increasing the intake pipe pressure PM. In the EGR system, the intake negative pressure is used to recirculate some of the exhaust gas in the intake air, Thus, as the intake pipe pressure PM increases (the intake negative pressure decreases) due to retardation of the timing of closing the intake valve 23, the amount of exhaust gas that can be recirculated into intake air decreases. Thus, in the fuel-efficient mode for recirculating a vast amount of exhaust gas, advancement control is performed on the timing of closing the intake valve 23 such that the timing of closing the intake valve 23 is earlier than that of the power mode. In the fuel-efficient mode, the recirculation of a vast amount of exhaust gas and the advancement control on the timing of closing the intake valve 23 are performed in a limited running region such as the high-load running region. The running region where a vast amount of exhaust gas is recirculated in the fuel-efficient mode does not completely overlap with the running region where advancement control is performed on the timing of closing the intake valve 23 in the fuel-efficient mode. Thus, in some cases, only one of the recirculation of a vast amount of exhaust gas and the advancement control on the timing of closing the intake valve 23 is performed.

In the engine controller of the present embodiment, the basic flow of the intake air amount calculation process P1 is the same as that in the premise configuration. That is, for example, as shown in FIG. 3, in the first intake air amount calculation process P4, the first intake air amount MC1 is calculated with the mass flow mode using the detected value of the intake air flow rate of the air flowmeter 13. In the second intake air amount calculation process P5, the second intake air amount MC2 is calculated with the throttle speed mode using the estimated value of the intake air flow rate based on the throttle opening degree TA and the engine rotation speed NE. Further, it is determined in the determination process P6 whether the intake pulsation is large in the intake passage 11. In the difference amount calculation process P7, when the small pulsation determination is made in the determination process P6, the difference amount DEV of the second intake air amount MC2 from the first intake air amount MC1 is calculated. In the calculation mode switching process P8, the first intake air amount MC1 is set as the intake air amount calculated value MC when the small pulsation determination is made. When the large pulsation determination is made, the corrected second intake air amount MC3, which is the sum of the second intake air amount MC2 and the difference amount DEV, is set as the intake air amount calculated value MC. In this manner, the intake air amount calculation process P1 is performed.

In the engine controller of the present embodiment, in the difference amount calculation process P7, the difference amount learning value, which is the learning value of the difference amount DEV, is learned for each of the difference amount learning regions divided from one another in accordance with the engine rotation speed NE. The difference amount learning value is learned, when the small pulsation determination is made, by updating the difference amount learning value in the difference amount learning region where the engine 100 is currently running (hereinafter referred to as the current learning region) in accordance with the difference amount of the second intake air amount MC2 from the first intake air amount MC1. The learning of the difference amount learning value in the engine controller of the present embodiment will now be described in detail.

Figure 34:
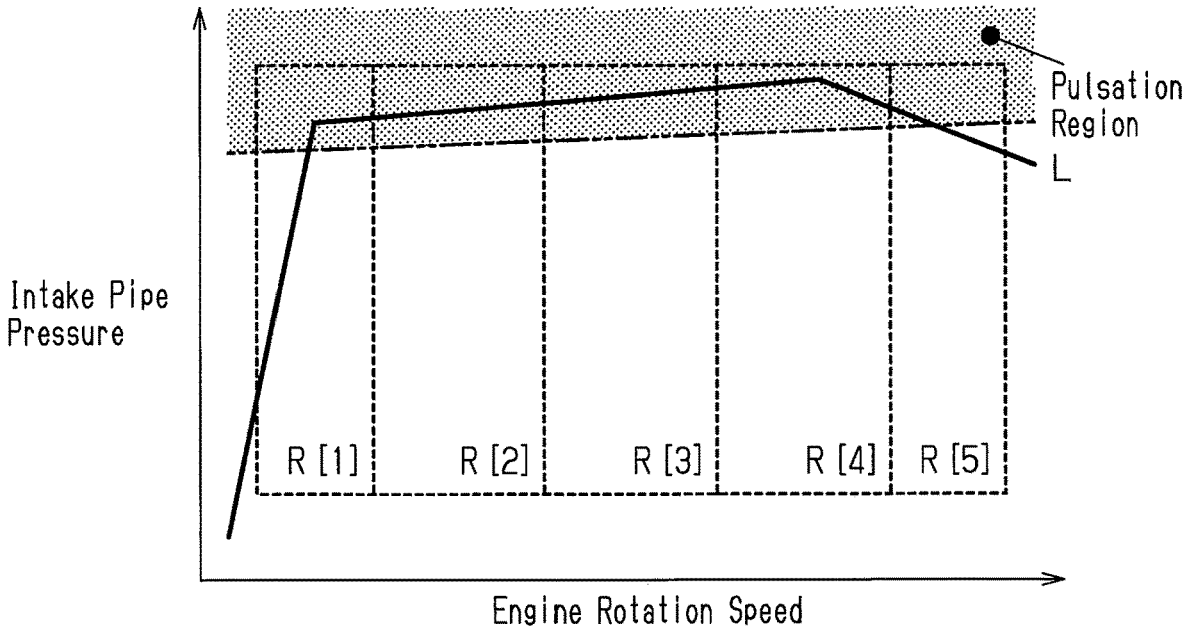
FIG. 34 is a graph illustrating the setting mode of the difference amount learning region in the engine controller of FIG. 33.

FIG. 34 shows one example of the setting of the difference amount learning region. As shown in FIG. 34, in the present embodiment, multiple (five in the example of FIG. 34) difference amount learning regions divided from one another in accordance with the engine rotation speed NE are set. In FIG. 34, line L represents the maximum value of the intake pipe pressure per engine speed in the running region of the engine 100. Further, the pulsation region shown with hatching in FIG. 34 represents the running region of the engine 10 where a large intake pulsation occurs enough to decrease the detection accuracy of the air flowmeter 13. The pulsation region is limited to the running region where the intake pipe pressure is high.

In the following description, the five difference amount learning regions are referred to as, sequentially from ones with a small engine rotation speed NE, the difference amount learning region R[1], the difference amount learning region R[2], the difference amount learning region R[3], the difference amount learning region R[4], and the difference amount learning region R[5]. Further, the learning value of the difference amount DEV in the difference amount learning region R[i] where i is any one of 1, 2, 3, 4, and 5 is referred to as the difference amount learning value DEV[i].

Figure 35:
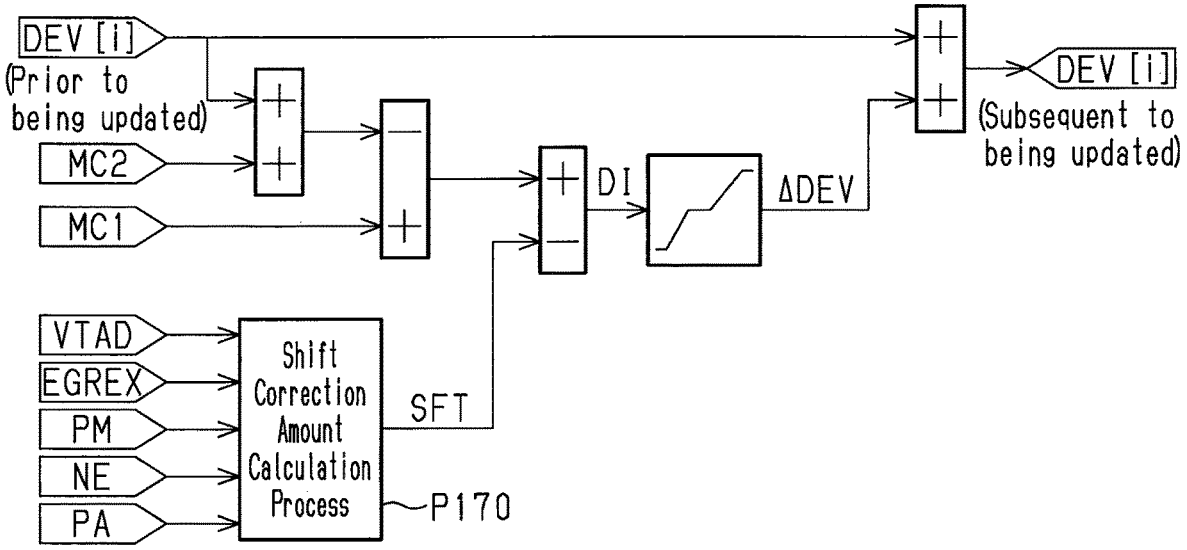
FIG. 35 is a control block diagram illustrating the procedure of a learning value updating process executed by the engine controller of FIG. 33.

FIG. 35 shows a procedure of processes for updating the difference amount learning value DEV[i]. In the difference amount calculation process P7, when the small pulsation determination is made, the electronic control unit 25 updates the difference amount learning value DEV[i] with the mode shown in FIG. 35.

Figure 36:
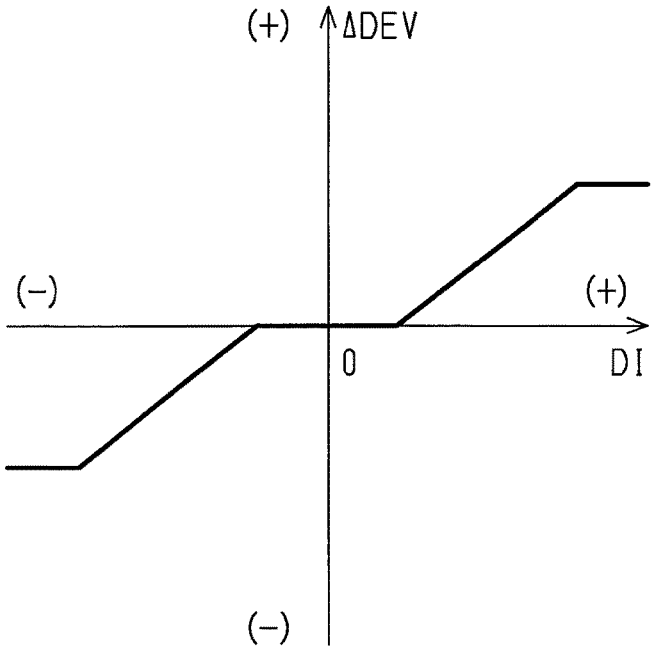
FIG. 36 is a graph illustrating the relationship between the update amount and the deviation amount of the difference amount learning value calculated in the learning value updating process in FIG. 35.

The difference amount learning value updating process first calculates the difference obtained by subtracting, from the first intake air amount MC1, the sum of the second intake air amount MC2 and the difference amount learning value DEV[i] in the current learning region prior to being updated (i.e., MC1−MC2−DEV[i]). From this difference, the shift correction amount SFT calculated in a shift correction amount calculation process P170, which will be described later, is further calculated. This value obtained through this calculation is obtained as the value of the deviation amount D1 (D1=MC1−MC2−DEV[i]−SFT). Further, the value of the update amount ΔDEV is obtained in accordance with the deviation amount D1. As shown in FIG. 36, the positive and negative values of the update amount ΔDEV are equal to those of the deviation amount D1, and the absolute value of the deviation amount D1 is set to be smaller than absolute value of the update amount ΔDEV. In addition, the value of the update amount ΔDEV is set such that the absolute value of the update amount ΔDEV is larger when the deviation amount D1 has a large absolute value than when the deviation amount D1 has a small absolute value. Then, the difference amount learning value DEV[i] in the current learning region is updated such that the sum of the update amount ΔDEV and the value of DEV[i] prior to being updated becomes the value of DEV[i] subsequent to being updated. In this manner, the difference amount learning value DEV[i] is updated so as to approximate the value obtained by subtracting the shift correction amount SFT from the difference of the second intake air amount MC2 from the first intake air amount MC1. It is determined that the learning of the difference amount learning value DEV[i] has been completed when the absolute value of the difference amount learning value DEV[i] is less than or equal to the preset learning complete determination value. Such determination of learning completion is performed separately for each difference amount learning region.

Figure 37:
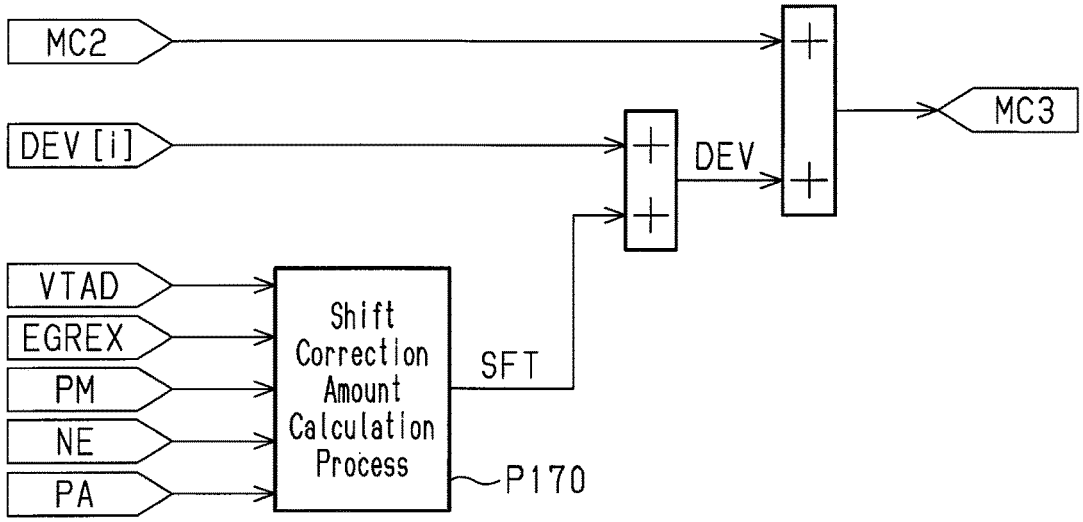
FIG. 37 is a control block diagram illustrating the procedure of a corrected second intake air amount calculation process executed by the engine controller of FIG. 33.

FIG. 37 shows a procedure of processes for calculating the corrected second intake air amount MC3 in the present embodiment. As shown in FIG. 37, in the present embodiment, the sum of the shift correction amount SFT, which is calculated in the shift correction amount calculation process P170, and the difference amount learning value DEV[i] in the current learning region is obtained as the value of the difference amount DEV. Then, the sum of the second intake air amount MC2 and the difference amount DEV (i.e., MC2+DEV=MC2+DEV[i]+SFT) is calculated as the value of the corrected second intake air amount MC3.

Figure 38:
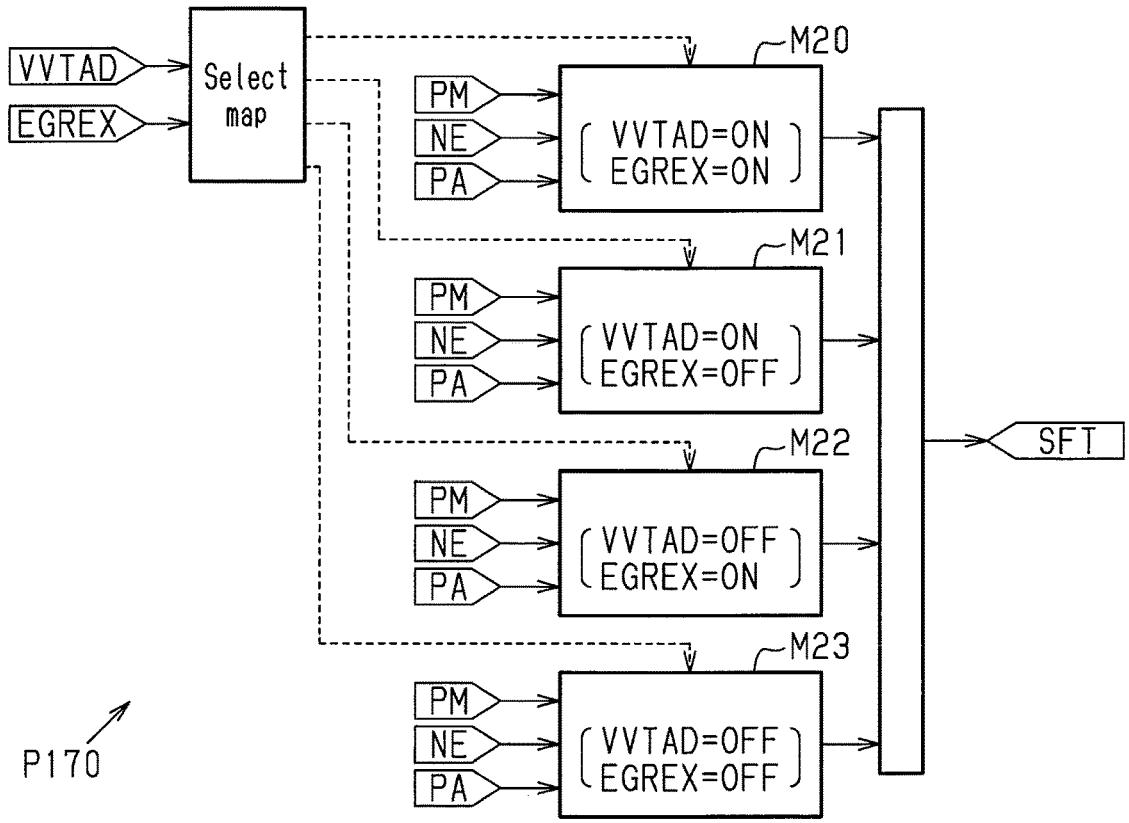
FIG. 38 is a control block diagram illustrating the procedure of a shift correction amount calculation process executed in the learning value updating process of FIG. 35.

FIG. 38 shows a procedure of the shift correction amount calculation process P170. As shown in FIG. 38, in the present embodiment, four calculation maps M20 to M23 are prepared as the calculation map of the shift correction amount SFT. Each of the calculation maps M20 to M23 stores the relationship between the engine rotation speed NE, the intake pipe pressure PM, and the atmospheric pressure PA with the shift correction amount SFT in advance. In the shift correction amount calculation process P170, the calculation map used to calculate the current shift correction amount SFT is selected from the calculation maps M20 to M23 in accordance with an intake valve advancement flag VVTAD and a mass EGR implementation flag EGREX. Using the selected calculation map, the value of the shift correction amount SFT is calculated from the engine rotation speed NE, the intake pipe pressure PM, and the atmospheric pressure PA.

The intake valve advancement flag VVTAD is activated (ON) when the valve timing advancement amount of the intake valve 23 is greater than or equal to a preset advancement determined value and is deactivated (OFF) when the valve timing advancement amount is less than the advancement determined value. When the latest timing of the change range of the valve timing of the intake valve 23 by the variable valve mechanism 35 is referred to as the most retarded timing, the valve timing advancement amount represents the advancement amount from the most retarded timing of the current valve timing of the intake valve 23. The intake valve advancement flag VVTAD is activated when advancement control is implemented on the timing of closing the intake valve 23 with the fuel-efficient mode. The mass EGR implementation flag EGREX is activated (ON) when the amount of exhaust gas recirculated by the exhaust gas recirculation mechanism (hereinafter referred to as EGR amount) is greater than or equal to a preset large EGR determined value and deactivated when the EGR amount is less than the large EGR determined value. The mass EGR implementation flag EGREX is activated when a vast amount of exhaust gas is recirculated with the fuel-efficient mode. The calculation map M20 is used to calculate the shift correction amount SFT when both the intake valve advancement flag VVTAD and the mass EGR implementation flag EGREX are activated. In the same manner, the calculation map M21 is used to calculate the shift correction amount SFT when the intake valve advancement flag VVTAD is activated and the mass EGR implementation flag EGREX is deactivated, the calculation map M22 is used to calculate the shift correction amount SFT when the intake valve advancement flag VVTAD is deactivated and the mass EGR implementation flag EGREX is activated, and the calculation map M23 is used to calculate the shift correction amount SFT when both the intake valve advancement flag VVTAD and the mass EGR implementation flag EGREX are deactivated.

The body of the engine 100 having average intake characteristics is referred to as a standard body. The value of the difference amount DEV in each running state and each environmental condition of the standard body can be obtained in advance. For example, the values of multiple bodies are measured for running states and environmental conditions. The difference amount DEV of each running state and each environmental condition of the standard body can be obtained by averaging the measured values of the difference amounts DEV of the running states and the environmental conditions of each body.

The calculation maps M20 to M23 are created based on such a measurement result of the difference amount DEV of the standard body. That is, the calculation map M20 stores in advance the relationship between the difference amount DEV with the engine rotation speed NE, the intake pipe pressure PM, and the atmospheric pressure PA of the standard body with both the intake valve advancement flag VVTAD and the mass EGR implementation flag EGREX activated. In the same manner, the relationship between the difference amount DEV with the engine rotation speed NE, the intake pipe pressure PM, and the atmospheric pressure PA of the standard body is stored in advance in the calculation map M21 with the intake valve advancement flag VVTAD activated and the mass EGR implementation flag EGREX deactivated, stored in advance in the calculation map M22 with the intake valve advancement flag VVTAD deactivated and the mass EGR implementation flag EGREX activated, and stored in advance in the calculation map M23 with both the intake valve advancement flag VVTAD and the mass EGR implementation flag EGREX deactivated.

The operation and advantages of the present embodiment will now be described.

In the present embodiment, when the small pulsation determination is made, in the difference amount calculation process P7, the difference amount learning value DEV[i] is learned by updating the value so as to approximate the value obtained by subtracting the shift correction amount SFT from the difference obtained by subtracting the second intake air amount MC2 from the first intake air amount MC1 (i.e., MC1−MC2−SFT). Then, the sum of the difference amount learning value DEV[i] and the shift correction amount SFT is calculated as the value of the difference amount DEV. Further, the corrected second intake air amount MC3, which is the sum of the difference amount DEV and the second intake air amount MC2, is set as the intake air amount calculated value MC during the large pulsation determination.

Figure 39:
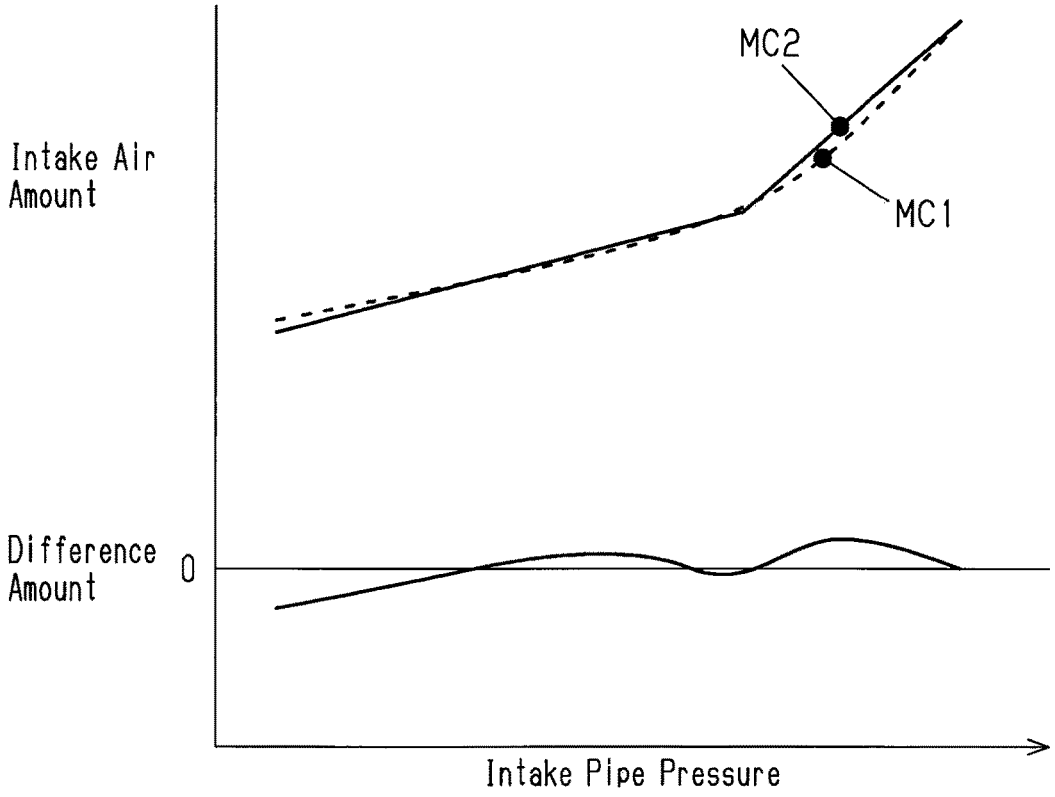
FIG. 39 is a graph illustrating the relationship between the calculated values of a first intake air amount and a second intake air amount, the difference amounts of the first intake air amount and the second intake air amount, and the intake pipe pressure in an engine controller of FIG. 33.

FIG. 39 shows the relationship between the intake pipe pressure PM with the calculated values of the first intake air amount MC1 and the second intake air amount MC2 and the difference amounts DEV of the first intake air amount MC1 and the second intake air amount MC2 when the intake pipe pressure PM is changed with the engine rotation speed NE and the valve timing of the intake valve 23 fixed and the EGR valve 34 fully open. As shown in FIG. 39, even if no change occurs in the control state of the engine 100 other than the intake pipe pressure PM, the value of the difference amount DEV differs when the intake pipe pressure PM changes. Further, the engine rotation speed NE is one of the factors that change the difference amount DEV in the same manner as the intake pipe pressure PM.

Figure 40:
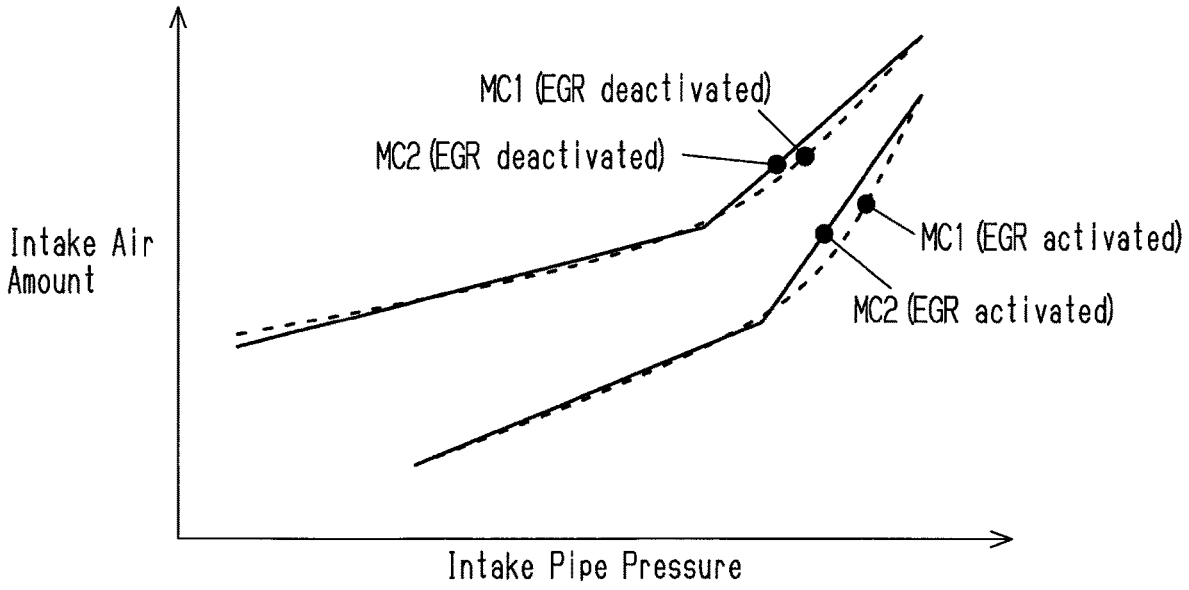
FIG. 40 is a graph illustrating the relationship between the calculated values of the first intake air amount and the second intake air amount and the intake pipe pressure when exhaust gas recirculation is implemented and when the exhaust gas recirculation is not implemented in an engine controller of FIG. 33.

FIG. 40 shows the relationship between the intake pipe pressure PM with the calculated values of the first intake air amount MC1 and the second intake air amount MC2 when the intake pipe pressure PM is changed with the engine rotation speed NE and the valve timing of the intake valve 23 fixed in a state in which the EGR valve 34 is fully open (when EGR activated) and the EGR valve 34 is fully closed (when EGR deactivated). As shown in FIG. 40, the difference amount DEV changes depending on whether a vast amount of exhaust gas is recirculated.

The difference amount DEV also changes depending on whether advancement control is performed on the timing of closing the intake valve 23. The control mode is used to switch whether exhaust gas is recirculated and whether advancement control is performed on the timing of closing the intake valve 23. As described above, in the engine 100, the control mode is used to switch whether exhaust gas is recirculated and whether advancement control is performed on the timing of closing the intake valve 23. In the engine 100 having such a configuration, the exhaust gas recirculation mechanism and the variable valve mechanism 35 are controlled independently from the throttle opening degree TA to change the intake air amount. Thus, in the engine 100, the control state of the indirect variable intake air mechanism is one of the factors for determining the difference amount DEV in addition to the engine rotation speed NE and the intake pipe pressure PM.

In addition, the environmental condition in which the engine 100 is operated is one of the factors for changing the difference amount DEV. For example, when the atmospheric pressure PA is high, the intake air amount is large even if the engine rotation speed NE and the throttle opening degree TA are the same. A change in the intake air flow rate caused by the atmospheric pressure PA appears in the detected value of the intake air flow rate of the air flowmeter 13. Thus, the influence of the atmospheric pressure PA on the intake air amount is reflected accurately to a certain extent on the first intake air amount MC1, which is calculated with the mass flow mode using the detected value of the intake air flow rate of the air flowmeter 13. In contrast, the influence of the atmospheric pressure PA on the intake air amount is not reflected on the second intake air amount MC2, which is calculated with the throttle opening degree TA using the estimated value of the intake air flow rate based on the throttle opening degree TA and the engine rotation speed NE, as accurately as the first intake air amount MC1. The state quantities of the environmental condition that affect the difference amount DEV include a pressure state quantity such as the atmospheric pressure PA, surge tank pressure, and boost pressure in a forced induction engine and a temperature state quantity such as the intake air temperature THA, external temperature, engine coolant temperature, engine oil temperature, and wall surface temperature of the intake port 18.

In the present embodiment, the amount corresponding to a change in the difference amount DEV caused by the environmental condition (the atmospheric pressure PA) and the running state (the engine rotation speed NE, the intake pipe pressure PM, and the control state of the exhaust gas recirculation mechanism and the variable valve mechanism 35) of the engine 100 is calculated as the value of the shift correction amount SFT. Further, the difference obtained by subtracting the shift correction amount SFT from the difference of the second intake air amount MC2 from the first intake air amount MC1 when the small pulsation determination is made is learned as the difference amount learning value DEV[i]. Thus, the difference amount learning value DEV[i] learns the value obtained by excluding in advance the amount corresponding to the change caused by the running state and the environmental condition of the engine 100 from the difference between the first intake air amount MC1 and the second intake air amount MC2, that is, learns the amount corresponding to the change in the difference caused by the individual difference of intake characteristics and changes over time in the engine 100. The sum of the difference amount learning value DEV[i] and the shift correction amount SFT is calculated as the value of the difference amount DEV, and the sum of the difference amount DEV and the second intake air amount MC2 is obtained as the value of the corrected second intake air amount MC3, which is set as the intake air amount calculated value MC when the large pulsation determination is made. Thus, the intake air amount can be properly calculated during the large pulsation determination even if the running state and the environmental condition differ between when the difference amount learning value DEV[i] is learned and when the difference amount learning value DEV[i] is reflected on the intake air amount calculated value MC. This enlarges the range of the running state and the environmental condition of the engine 100 where the learning of the difference amount learning value DEV[i] is performed. That is, the opportunities to perform learning can be increased, thereby shortening the time to complete learning.

Each of the above embodiments may be modified as described below. The present embodiment and the following modifications may be implemented in combination with each other as long as technical contradiction does not occur.

In the above-described embodiment, the difference amount learning value DEV[i] is learned separately for each of the difference amount learning regions, which are divided in accordance with the engine rotation speed NE. Instead, a single difference amount learning value may be learned in the entire running region of the engine without dividing the difference amount learning region.

In the above-described embodiment, the calculation maps M20 to M23 are switched in accordance with the control states of the exhaust gas recirculation mechanism and the variable valve mechanism 35. Instead, the control states of the exhaust gas recirculation mechanism and the variable valve mechanism 35 may be reflected on the shift correction amount SFT in other modes. For example, the shift correction amount SFT may be calculated using a single calculation map that includes the shift correction amount SFT as a return value and includes, as arguments, the engine rotation speed NE, the atmospheric pressure PA, the exhaust gas recirculation amount (or the opening degree of the EGR valve 34), and the valve timing advancement amount of the intake valve 23.

In the above-described embodiment, two control states, namely, the control state of the exhaust gas recirculation mechanism and the control state of the variable valve mechanism, are employed as the control states of the indirect variable intake air mechanism used to calculate the shift correction amount SFT. Instead, when the engine does not include one of the exhaust gas recirculation mechanism and the variable valve mechanism or when one of them is controlled in cooperation with the throttle opening degree TA, only one of the control state of the exhaust gas recirculation mechanism and the control state of the variable valve mechanism may be employed as the control states of the indirect variable intake air mechanism used to calculate the shift correction amount SFT. Alternatively, when the engine includes a mechanism that changes the intake air amount independently from the throttle opening degree TA, the control state of this mechanism may be employed as the control states of the indirect variable intake air mechanism used to calculate the shift correction amount SFT. Examples of the indirect variable intake air mechanism other than the exhaust gas recirculation mechanism and the variable valve mechanism include the following mechanisms.

One type of the variable valve mechanism is a mechanism that varies the valve lift amount of the intake valve 23 (lift amount variable mechanism). When such a lift amount variable mechanism is controlled independently from the throttle opening degree TA, the relationship between the engine rotation speed NE and the intake pipe pressure PM with the difference amount DEV changes in accordance with the control state of the lift amount variable mechanism (the valve lift amount of the intake valve 23). Such a lift amount variable mechanism is a mechanism arranged in the engine and corresponds to the indirect variable intake air mechanism that is controlled independently from the throttle opening degree TA to change the intake air amount of the engine. In this case, the control state of the lift amount variable mechanism simply needs to be used as one of the control states of the indirect variable intake air mechanism that are referred to when calculating the shift correction amount SFT.

Some engines provided with turbochargers include a variable forced induction mechanism that changes the number of running turbochargers. When such a variable forced induction mechanism is controlled independently from the throttle opening degree TA, the relationship between the engine rotation speed NE and the intake pipe pressure PM with the difference amount DEV changes in accordance with the control state of the variable forced induction mechanism (the number of running turbochargers). Such a variable forced induction mechanism is a mechanism arranged in the engine and corresponds to the indirect variable intake air mechanism that is controlled independently from the throttle opening degree TA to change the intake air amount of the engine. In this case, the control state of the variable forced induction mechanism simply needs to be used as one of the control states of the indirect variable intake air mechanism that are referred to when calculating the shift correction amount SFT.

There is an engine including two types of fuel injection valves, namely, a port injection valve that injects fuel into the intake port 18 and an in-cylinder injection valve that injects fuel into the combustion chamber 19. This engine is provided with an injection switching mechanism for switching a fuel injection valve that injects fuel in accordance with the running status of the engine. In such an engine, when fuel injection is performed by the in-cylinder injection valve, the evaporation heat of the injected fuel cools the inside of the combustion chamber 19. This increases the density of intake air drawn in the combustion chamber 19, thereby increasing the intake air amount, that is, the mass of intake air drawn in the combustion chamber 19, as compared to when fuel injection is performed only by the port injection valve. When such an injection switching mechanism is controlled independently from the throttle opening degree TA, the relationship between the engine rotation speed NE and the intake pipe pressure PM with the difference amount DEV changes in accordance with the control state of the injection switching mechanism (switching of the fuel injection valve that performs fuel injection). Such an injection switching mechanism is a mechanism arranged in the engine and corresponds to the indirect variable intake air mechanism that is controlled independently from the throttle opening degree TA to change the intake air amount of the engine. In this case, the control state of the injection switching mechanism simply needs to be used as one of the control states of the indirect variable intake air mechanism that are referred to when calculating the shift correction amount SFT.

Instead of or in addition to the atmospheric pressure PA, the shift correction amount SFT may be calculated based on the state quantity of the environmental condition of the engine other than the atmospheric pressure PA. Examples of such a state quantity include a pressure state quantity such as surge tank pressure turbocharging pressure in a forced induction engine and a temperature state quantity such as the intake air temperature THA, external temperature, engine coolant temperature, engine oil temperature, and wall surface temperature of the intake port 18.

When the environmental condition affects the difference amount to a small extent, the shift correction amount SFT may be calculated based on the engine rotation speed NE, the intake pipe pressure PM, and the control state of the indirect variable intake air mechanism without using the state quantities of the environmental condition.

In the above-described embodiment, the calculation of the second intake air amount MC2 in the second intake air amount calculation process P5 is performed with the throttle speed mode, that is, using the estimated value of the intake air flow rate based on the throttle opening degree TA and the engine rotation speed NE. Instead, the calculation of the second intake air amount MC2 may be performed with the speed density mode, that is, using the estimated value of the intake air flow rate based on the detection result of the intake pipe pressure PM and the engine rotation speed NE.

The electronic control units described above do not have to include the processor and memory to execute software processing. For example, at least part of the processes executed by the software in the above-described embodiment may be executed by hardware circuits dedicated to executing these processes (such as ASIC). That is, the controller may be modified as long as it has any one of the following configurations (i) to (iii): (i) A configuration including a processor that executes all of the above-described processes according to programs and a program storage device such as a ROM (including a non-transitory computer readable storage medium) that stores the programs; (ii) A configuration including a processor and a program storage device that execute part of the above-described processes according to the programs and a dedicated hardware circuit that executes the remaining processes; and (iii) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An engine controller configured to execute:

a first intake air amount calculation process for calculating a first intake air amount, which serves as a calculated value of an intake air amount of an engine, based on a detected value of an intake air flow rate of an air flowmeter;

a second intake air amount calculation process for calculating a second intake air amount, which serves as a calculated value of an intake air amount of the engine, based on any one of a detected value of an intake pipe pressure and a throttle opening degree instead of the detected value of the intake air flow rate;

a determination process for determining whether intake pulsation in an intake passage of the engine is large by determining whether the pulsation is greater than or equal to a preset determination value;

a difference amount calculation process for, when determining in the determination process that the intake pulsation is not large, calculating a difference amount of the second intake air amount from the first intake air amount;

a calculation mode switching process for setting the first intake air amount as an intake air amount calculated value of the engine when determining in the determination process that the intake pulsation is not large, and setting a corrected second intake air amount, which is a sum of the second intake air amount and the difference amount, as the intake air amount calculated value when determining in the determination process that the intake pulsation is large; and an injector driving process for performing a fuel injection control on an injector by determining a fuel injection amount based on the set intake air amount calculated value, wherein the engine controller is further configured to perform learning of, in the difference amount calculation process, a difference amount learning value, which is a learning value of the difference amount, for each of difference amount learning regions divided from one another in accordance with a rotation speed of the engine.

2. The engine controller according to claim 1, wherein the learning of the difference amount in the difference amount calculation process is configured to be performed by collectively updating the difference amount learning values in the difference amount learning regions when the learning of the difference amount is incomplete in all of the difference amount learning regions and by updating only the difference amount learning value of one of the difference amount learning regions in which the engine is currently running when the learning of the difference amount is complete in any one of the difference amount learning regions, and wherein the engine controller is configured to:

determine whether an absolute value of a deviation amount of the learned difference amount from the current difference amount in the difference amount calculation process is less than or equal to a preset convergence determination value to determine the learning of the difference amount learning value has been completed.

3. The engine controller according to claim 1, wherein the learning of the difference amount in the difference amount calculation process is performed by updating the difference amount learning value based on a difference obtained by subtracting, from the difference amount, a shift correction amount calculated in accordance with the rotation speed of the engine and load of the engine, and the corrected second intake air amount is calculated by using a sum of the difference amount learning value and the shift correction amount as a value of the difference amount.

4. The engine controller according to claim 1, wherein the learning of the difference amount in the difference amount calculation process is performed by updating the difference amount learning value based on a value obtained by performing environmental correction according to an environmental condition of the engine on the difference amount, and the corrected second intake air amount is calculated by using a value obtained by performing inverse correction of the environmental correction on the difference amount learning value as a value of the difference amount.

5. The engine controller according to claim 1, further comprising an intake pipe model for calculating a change amount of the intake pipe pressure per unit of time from the detected value of the intake air flow rate of the air flowmeter and calculating the intake pipe pressure by updating a value of the intake pipe pressure in accordance with the change amount of the intake pipe pressure per unit of time, wherein the calculation of the first intake air amount in the first intake air amount calculation process is performed by using the intake pipe pressure calculated with the intake pipe model, and a calculated value of the intake pipe pressure of the intake pipe model is replaced with the detected value of the intake pipe pressure or an estimated value of the intake pipe pressure that is based on the throttle opening degree when the determination of the determination process is switched from the determination that the intake pulsation is large to the determination that the intake pulsation is not large.

6. The engine controller according to claim 1, wherein the engine controller is configured to:

learn a difference amount learning value, which is a learning value of the difference amount, by updating a value of the learning value of the difference amount in accordance with a deviation amount of the corrected second intake air amount from the first intake air amount in the difference amount calculation process;

learn the difference amount learning value according to the deviation amount in a first learning region before completion of the learning of the difference amount learning value wherein completion of the learning of the difference amount learning value is determined based on the deviation amount in the second learning region;

learn the difference amount learning value according to the deviation amount in a second learning region after completion of the learning of the difference amount learning value;

determine whether an absolute value of the deviation amount is less than or equal to a preset convergence determination value in each of preset determination cycles when the engine is running in the second learning region; and determine, when a number of times of determining that the absolute value of the deviation amount is less than or equal to the convergence determination value becomes a preset learning complete determination value or higher, that the learning of the difference amount learning value has been completed, wherein the first learning region includes a pulsation region, which is an engine running region where the intake pulsation occurs, and the second learning region includes the pulsation region and is narrower than the first learning region.

7. The engine controller according to claim 6, wherein the difference amount learning value, the first learning region, and the second learning region are set separately for each of rotation speed regions divided in accordance with the engine rotation speed, and whether the learning of the difference amount learning value has been completed is determined separately in each of the rotation speed regions.

8. The engine controller according to claim 6, wherein the first learning region is a region in which the intake pipe pressure is greater than or equal to a preset first lower limit value, and the second learning region is a region in which the intake pipe pressure is greater than or equal to a second lower limit value, the second lower limit value being higher than the first lower limit value.

9. The engine controller according to claim 1, wherein an indirect variable intake air mechanism is arranged in the engine, when the indirect variable intake air mechanism is configured to be controlled independently from the throttle opening degree and vary the intake air amount of the engine, the engine controller is further configured to perform a shift correction amount calculation process for calculating a shift correction amount based on a control state of the indirect variable intake air mechanism, the intake pipe pressure, and the rotation speed of the engine, and the engine controller is configured to, in the difference amount calculation process, learn a difference amount learning value by updating the difference amount learning value so as to approximate a value obtained by subtracting the shift correction amount from a difference of the second intake air amount from the first intake air amount and calculate a sum of the difference amount learning value and the shift correction amount as a value of the difference amount.

10. The engine controller according to claim 9, wherein the indirect variable intake air mechanism is an exhaust gas recirculation mechanism that recirculates some of exhaust gas into intake air.

11. The engine controller according to claim 9, wherein the indirect variable intake air mechanism is a variable valve mechanism that varies a valve timing of an intake valve.

12. The engine controller according to claim 9, wherein the engine controller is configured to calculate, in the shift correction amount calculation process, the shift correction amount based on a state quantity of an environmental condition of the engine in addition to the control state of the indirect variable intake air mechanism, the intake pipe pressure, and the engine rotation speed.

13. The engine controller according to claim 12, wherein the state quantity is an atmospheric pressure.

14. An engine control method comprising:

calculating a first intake air amount, which serves as a calculated value of an intake air amount of an engine, based on a detected value of an intake air flow rate of an air flowmeter;

calculating a second intake air amount, which serves as a calculated value of an intake air amount of the engine, based on any one of a detected value of an intake pipe pressure and a throttle opening degree instead of the detected value of the intake air flow rate;

determining whether intake pulsation in an intake passage of the engine is large by determining whether the pulsation is greater than or equal to a preset determination value;

in the determining, when determining that the intake pulsation is not large, calculating a difference amount of the second intake air amount from the first intake air amount;

setting the first intake air amount as an intake air amount calculated value of the engine when determining, in the determining, that the intake pulsation is not large, and setting a corrected second intake air amount, which is a sum of the second intake air amount and the difference amount, as the intake air amount calculated value when determining, in the determining, that the intake pulsation is large;

performing a fuel injection control on an injector by determining a fuel injection amount based on the set intake air amount calculated value; and learning of, in the difference amount calculation process, a difference amount learning value, which is a learning value of the difference amount, for each of difference amount learning regions divided from one another in accordance with a rotation speed of the engine.

15. A non-transitory computer-readable storage medium that stores a program causing a processor to execute an engine control process, the engine control process comprising:

a first intake air amount calculation process for calculating a first intake air amount, which serves as a calculated value of an intake air amount of an engine, based on a detected value of an intake air flow rate of an air flowmeter;

a second intake air amount calculation process for calculating a second intake air amount, which serves as a calculated value of an intake air amount of the engine, based on any one of a detected value of an intake pipe pressure and a throttle opening degree instead of the detected value of the intake air flow rate;

a determination process for determining whether intake pulsation in an intake passage of the engine is large by determining whether the pulsation is greater than or equal to a preset determination value;

a difference amount calculation process for, when determining in the determination process that the intake pulsation is not large, calculating a difference amount of the second intake air amount from the first intake air amount;

a calculation mode switching process for setting the first intake air amount as an intake air amount calculated value of the engine when determining in the determination process that the intake pulsation is not large, and setting a corrected second intake air amount, which is a sum of the second intake air amount and the difference amount, as the intake air amount calculated value when determining in the determination process that the intake pulsation is large;

an injector driving process for performing a fuel injection control on an injector by determining a fuel injection amount based on the set intake air amount calculated value; and learning of, in the difference amount calculation process, a difference amount learning value, which is a learning value of the difference amount, for each of difference amount learning regions divided from one another in accordance with a rotation speed of the engine.

* * * * *